US008245796B2

(12) United States Patent
Mock et al.

(10) Patent No.: US 8,245,796 B2
(45) **Date of Patent: *Aug. 21, 2012**

(54) TRACTOR WITH IMPROVED VALVE SYSTEM

(75) Inventors: Philip W. Mock, Costa Mesa, CA (US); Rudolph Ernst Krueger, V, Aliso Viejo, CA (US); Duane Bloom, Anaheim, CA (US); N. Bruce Moore, Aliso Viejo, CA (US); Robert Levay, Yorba Linda, CA (US)

(73) Assignee: WWT International, Inc., Anaheim, CA (US)

( * ) Notice: Subject to any disclaimer, the term of this patent is extended or adjusted under 35 U.S.C. 154(b) by 180 days.

This patent is subject to a terminal disclaimer.

(21) Appl. No.: 12/776,232

(22) Filed: May 7, 2010

(65) Prior Publication Data

US 2010/0307832 A1 Dec. 9, 2010

Related U.S. Application Data

(63) Continuation-in-part of application No. 12/606,986, filed on Oct. 27, 2009, now abandoned, which is a (Continued)

(51) Int. Cl.
*E21B 4/18* (2006.01)
*E21B 23/01* (2006.01)

(52) U.S. Cl. ..... 175/51; 175/98; 175/230

(58) Field of Classification Search ..... 175/51, 175/97, 98, 99, 230

See application file for complete search history.

(56) References Cited

U.S. PATENT DOCUMENTS 2,141,030 A 12/1938 Clark (Continued)

FOREIGN PATENT DOCUMENTS

CA 2 250 483 4/1999

(Continued)

OTHER PUBLICATIONS

UK Search Report dated May 25, 2007 for Application GB0704656.8.

(Continued)

*Primary Examiner* — William P Neuder

(74) *Attorney, Agent, or Firm* — Knobbe, Martens, Olson & Bear LLP

(57) ABSTRACT

A hydraulically powered tractor adapted for advancement through a borehole including an elongate body, aft and forward gripper assemblies, and a valve control assembly housed within the elongate body. The aft and forward gripper assemblies are adapted for selective engagement with the inner surface of the borehole. The valve control assembly includes a gripper control valve for directing pressurized fluid to the aft and forward gripper assemblies. The valve control assembly also includes a propulsion control valve for directing fluid to an aft or forward power chamber for advancing the body relative to the actuated gripper assembly. Aft and forward mechanically actuated valves may be provided for controlling the position of the gripper control valve by detecting and signaling when the body has completed an advancement stroke relative to an actuated gripper assembly. Aft and forward sequence valves may be provided for controlling the propulsion control valve by detecting when the gripper assemblies become fully actuated. Furthermore, a pressure relief valve is preferably provided along an input supply line for limiting the pressure of the fluid entering the valve control assembly.

9 Claims, 41 Drawing Sheets

Related U.S. Application Data

(63) continuation of application No. 12/046,283, filed on Mar. 11, 2008, now Pat. No. 7,607,495, which is a continuation of application No. 11/717,467, filed on Mar. 12, 2007, now Pat. No. 7,353,886, which is a continuation of application No. 11/418,546, filed on May 3, 2006, now Pat. No. 7,188,681, which is a continuation of application No. 10/759,664, filed on Jan. 19, 2004, now Pat. No. 7,080,700, which is a continuation of application No. 10/004,965, filed on Dec. 3, 2001, now Pat. No. 6,679,341, application No. 12/776,232, which is a continuation of application No. 12/368,417, filed on Feb. 10, 2009, now abandoned, which is a continuation of application No. 12/044,502, filed on Mar. 7, 2008, now Pat. No. 7,493,967, which is a continuation of application No. 11/417,535, filed on May 3, 2006, now Pat. No. 7,343,982, which is a continuation of application No. 10/745,400, filed on Dec. 23, 2003, now Pat. No. 7,121,364.

(60) Provisional application No. 60/250,847, filed on Dec. 1, 2000, provisional application No. 60/446,644, filed on Feb. 10, 2003, provisional application No. 60/448,163, filed on Feb. 14, 2003, provisional application No. 60/525,309, filed on Nov. 26, 2003.

U.S. PATENT DOCUMENTS

| | | | |
|---|---|---|---|
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,661,205 | A | 5/1972 | Belorgey |
| 3,664,416 | A | 5/1972 | Nicolas et al. |
| 3,797,589 | A | 3/1974 | Kellner et al. |
| 3,827,512 | A | 8/1974 | Edmond |
| RE28,449 | E | 6/1975 | Edmond |
| 3,941,190 | A | 3/1976 | Conover |
| 3,978,930 | A | 9/1976 | Schroeder |
| 3,992,565 | A | 11/1976 | Gatfield |
| 4,040,494 | A | 8/1977 | Kellner |
| 4,085,808 | A | 4/1978 | Kling |
| 4,095,655 | A | 6/1978 | Still |
| 4,141,414 | A | 2/1979 | Johansson |
| 4,314,615 | A | 2/1982 | Sodder, Jr. et al. |
| 4,365,676 | A | 12/1982 | Boyadjieff et al. |
| 4,372,161 | A | 2/1983 | de Buda et al. |
| 4,385,021 | A | 5/1983 | Neeley |
| 4,440,239 | A | 4/1984 | Evans |
| 4,463,814 | A | 8/1984 | Horstmeyer et al. |
| 4,558,751 | A | 12/1985 | Huffaker |
| 4,573,537 | A | 3/1986 | Hirasuna et al. |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,854,397 | A | 8/1989 | Warren et al. |
| 4,951,760 | A | 8/1990 | Cendre et al. |
| 5,010,965 | A | 4/1991 | Schmelzer |
| 5,052,211 | A | 10/1991 | Cohrs et al. |
| 5,090,259 | A | 2/1992 | Shishido et al. |
| 5,169,264 | A | 12/1992 | Kimura |
| 5,184,676 | A | 2/1993 | Graham et al. |
| 5,186,264 | A | 2/1993 | du Chaffaut |
| 5,203,646 | A | 4/1993 | Landsberger et al. |
| 5,310,012 | A | 5/1994 | Cendre et al. |
| 5,316,094 | A | 5/1994 | Pringle et al. |
| 5,363,929 | A | 11/1994 | Williams et al. |
| 5,394,951 | A | 3/1995 | Pringle et al. |
| 5,419,405 | A | 5/1995 | Patton |
| 5,425,429 | A | 6/1995 | Thompson |
| 5,449,047 | A | 9/1995 | Schivley, Jr. |
| 5,467,832 | A | 11/1995 | Orban et al. |
| 5,519,668 | A | 5/1996 | Montaron |
| 5,542,253 | A | 8/1996 | Ganzel |
| 5,613,568 | A | 3/1997 | Sterner et al. |
| 5,622,231 | A | 4/1997 | Thompson |
| 5,752,572 | A | 5/1998 | Baiden et al. |
| 5,758,731 | A | 6/1998 | Zollinger |
| 5,758,732 | A | 6/1998 | Liw |
| 5,765,640 | A | 6/1998 | Milne et al. |
| 5,794,703 | A | 8/1998 | Newman et al. |
| 5,803,193 | A | 9/1998 | Krueger et al. |
| 5,845,796 | A | 12/1998 | Miller |
| 5,857,731 | A | 1/1999 | Heim et al. |
| 5,947,213 | A | 9/1999 | Angle et al. |
| 5,954,131 | A | 9/1999 | Salwasser |
| 5,960,895 | A | 10/1999 | Chevallier et al. |
| 5,996,979 | A | 12/1999 | Hrsuch |
| 6,003,606 | A | 12/1999 | Moore et al. |
| 6,026,911 | A | 2/2000 | Angle et al. |
| 6,031,371 | A | 2/2000 | Smart |
| 6,089,323 | A | 7/2000 | Newman et al. |
| 6,112,809 | A | 9/2000 | Angle |
| 6,230,813 | B1 | 5/2001 | Moore et al. |
| 6,241,031 | B1 | 6/2001 | Beaufort et al. |
| 6,273,189 | B1 | 8/2001 | Gissler et al. |
| 6,286,592 | B1 | 9/2001 | Moore et al. |
| 6,315,043 | B1 | 11/2001 | Farrant et al. |
| 6,345,669 | B1 | 2/2002 | Buyers et al. |
| 6,347,674 | B1 | 2/2002 | Bloom et al. |
| 6,378,627 | B1 | 4/2002 | Tubel et al. |
| 6,427,786 | B2 | 8/2002 | Beaufort et al. |
| 6,431,291 | B1 | 8/2002 | Moore et al. |
| 6,464,003 | B2 | 10/2002 | Bloom et al. |
| 6,478,097 | B2 | 11/2002 | Bloom et al. |
| 6,601,652 | B1 | 8/2003 | Krueger et al. |
| 6,640,894 | B2 | 11/2003 | Bloom et al. |
| 6,651,747 | B2 | 11/2003 | Chen et al. |
| 6,679,341 | B2 | 1/2004 | Bloom et al. |
| 6,715,559 | B2 | 4/2004 | Bloom et al. |
| 6,745,854 | B2 | 6/2004 | Bloom et al. |
| 6,758,279 | B2 | 7/2004 | Moore et al. |
| 6,827,149 | B2 | 12/2004 | Hache |
| 6,868,906 | B1 | 3/2005 | Vail, III et al. |
| 6,910,533 | B2 | 6/2005 | Guerrero |
| 6,920,936 | B2 | 7/2005 | Sheiretov et al. |
| 6,938,708 | B2 | 9/2005 | Bloom et al. |
| 6,953,086 | B2 | 10/2005 | Simpson |
| 7,048,047 | B2 | 5/2006 | Bloom et al. |
| 7,059,417 | B2 | 6/2006 | Moore et al. |
| 7,080,700 | B2 | 7/2006 | Bloom et al. |
| 7,080,701 | B2 | 7/2006 | Bloom et al. |
| 7,121,364 | B2 | 10/2006 | Mock et al. |
| 7,156,181 | B2 | 1/2007 | Moore et al. |
| 7,174,974 | B2 | 2/2007 | Bloom et al. |
| 7,185,716 | B2 | 3/2007 | Bloom et al. |
| 7,188,681 | B2 | 3/2007 | Bloom et al. |
| 7,191,829 | B2 | 3/2007 | Bloom et al. |
| 7,222,682 | B2 | 5/2007 | Doering et al. |
| 7,273,109 | B2 | 9/2007 | Moore et al. |
| 7,275,593 | B2 | 10/2007 | Bloom et al. |
| 7,303,010 | B2 | 12/2007 | de Guzman et al. |
| 7,343,982 | B2 | 3/2008 | Mock et al. |
| 7,353,886 | B2 | 4/2008 | Bloom et al. |
| 7,392,859 | B2 | 7/2008 | Mock et al. |
| 7,401,665 | B2 | 7/2008 | Guerrero et al. |
| 7,493,967 | B2 | 2/2009 | Mock et al. |
| 7,516,782 | B2 | 4/2009 | Sheiretov et al. |

| | | | |
|---|---|---|---|
| 7,516,792 | B2 | 4/2009 | Lonnes et al. |
| 7,604,060 | B2 | 10/2009 | Bloom et al. |
| 7,607,495 | B2 | 10/2009 | Bloom et al. |
| 7,607,497 | B2 | 10/2009 | Mock et al. |
| 7,624,808 | B2 | 12/2009 | Mock |
| 7,743,849 | B2 | 6/2010 | Kotsonis et al. |
| 7,748,476 | B2 | 7/2010 | Krueger |
| 7,770,667 | B2 | 8/2010 | Moore |
| 7,836,950 | B2 | 11/2010 | Vail, III et al. |
| 7,854,258 | B2 | 12/2010 | Sheiretov et al. |
| 7,900,699 | B2 | 3/2011 | Ramos et al. |
| 7,954,562 | B2 | 6/2011 | Mock |
| 7,954,563 | B2 | 6/2011 | Mock et al. |
| 2001/0045300 | A1 | 11/2001 | Fincher et al. |
| 2002/0032126 | A1 | 3/2002 | Kusmer |
| 2002/0079107 | A1 | 6/2002 | Simpson |
| 2002/0088648 | A1 | 7/2002 | Krueger et al. |
| 2003/0024710 | A1 | 2/2003 | Post et al. |
| 2003/0150609 | A1 | 8/2003 | Stoesz |
| 2003/0183383 | A1 | 10/2003 | Guerrero |
| 2005/0034874 | A1 | 2/2005 | Guerrero et al. |
| 2005/0145415 | A1 | 7/2005 | Doering et al. |
| 2005/0217861 | A1 | 10/2005 | Misselbrook |
| 2006/0180318 | A1 | 8/2006 | Doering et al. |
| 2007/0056745 | A1 | 3/2007 | Contant |
| 2007/0095532 | A1 | 5/2007 | Head et al. |
| 2007/0181298 | A1 | 8/2007 | Sheiretov et al. |
| 2007/0256827 | A1 | 11/2007 | Guerrero et al. |
| 2007/0261887 | A1 | 11/2007 | Pai et al. |
| 2008/0061647 | A1 | 3/2008 | Schmitt |
| 2008/0066963 | A1 | 3/2008 | Sheiretov et al. |
| 2008/0073077 | A1 | 3/2008 | Tunc et al. |
| 2008/0110635 | A1 | 5/2008 | Loretz et al. |
| 2008/0169107 | A1 | 7/2008 | Redlinger et al. |
| 2008/0196901 | A1 | 8/2008 | Aguirre et al. |
| 2008/0202769 | A1 | 8/2008 | Dupree et al. |
| 2008/0223573 | A1 | 9/2008 | Nelson et al. |
| 2008/0314639 | A1 | 12/2008 | Kotsonis et al. |
| 2009/0008150 | A1 | 1/2009 | Lavrut et al. |
| 2009/0025941 | A1 | 1/2009 | Iskander et al. |
| 2009/0071659 | A1 | 3/2009 | Spencer et al. |
| 2009/0071660 | A1 | 3/2009 | Martinez et al. |
| 2009/0091278 | A1 | 4/2009 | Montois et al. |
| 2009/0218105 | A1 | 9/2009 | Hill et al. |
| 2009/0229820 | A1 | 9/2009 | Saeed |
| 2009/0236101 | A1 | 9/2009 | Nelson et al. |
| 2009/0301734 | A1 | 12/2009 | Tunc et al. |
| 2009/0321141 | A1 | 12/2009 | Kotsonis et al. |
| 2010/0018695 | A1 | 1/2010 | Bloom et al. |
| 2010/0038138 | A1 | 2/2010 | Mock et al. |
| 2010/0108387 | A1 | 5/2010 | Bloom et al. |
| 2010/0263856 | A1 | 10/2010 | Lynde et al. |
| 2011/0073300 | A1 | 3/2011 | Mock |

FOREIGN PATENT DOCUMENTS

| | | | |
|---|---|---|---|
| DE | 2439063 | | 2/1976 |
| DE | 2920049 | | 2/1987 |
| EP | 0 149 528 | A1 | 7/1985 |
| EP | 0 951 611 | B1 | 1/1993 |
| EP | 0 257 744 | B1 | 1/1995 |
| EP | 0 767 289 | A1 | 4/1997 |
| EP | 0911483 | | 4/1997 |
| EP | 1 281 834 | A | 2/2003 |
| EP | 1 344 893 | A2 | 9/2003 |
| EP | 1370891 | | 11/2006 |
| EP | 1223305 | | 4/2008 |
| GB | 894117 | | 4/1962 |
| GB | 1105701 | | 3/1968 |
| GB | 2 241 723 | A | 9/1991 |
| GB | 2 305 407 | | 4/1997 |
| GB | 2 310 871 | A | 9/1997 |
| GB | 2 346 908 | A | 8/2000 |
| GB | 2401130 | | 11/2004 |
| WO | WO 89/05391 | | 6/1989 |
| WO | WO 92/13226 | | 8/1992 |
| WO | WO 93/18277 | | 9/1993 |
| WO | WO 94/27022 | | 11/1994 |
| WO | WO 95/21987 | | 8/1995 |
| WO | WO 00/36266 | | 6/2000 |
| WO | WO 00/46461 | | 8/2000 |
| WO | WO 00/63606 | | 10/2000 |
| WO | WO 00/73619 | | 12/2000 |
| WO | WO 02/44509 | A2 | 6/2002 |
| WO | WO 2005/057076 | | 6/2005 |
| WO | WO 2007039025 | | 4/2007 |
| WO | WO 2007134748 | | 11/2007 |
| WO | WO 2008/104177 | | 9/2008 |
| WO | WO 2008/104178 | | 9/2008 |
| WO | WO 2008/104179 | | 9/2008 |
| WO | WO 2008/128542 | | 10/2008 |
| WO | WO 2008/128543 | | 10/2008 |
| WO | WO 2009/062718 | | 5/2009 |
| WO | WO 2010/062186 | | 6/2010 |
| WO | WO 2011/005519 | | 1/2011 |

OTHER PUBLICATIONS

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

"Kilobomac to Challenge Tradition" Norwegian Oil Review, 1988, pp. 50-52.

Provisional Patent Application No. 60/201,353, and cover sheet, filed May 2, 2000 entitled "Borehole Retention Device" in 23 pages.

TRACTOR WITH IMPROVED VALVE SYSTEM

CLAIM FOR PRIORITY

This application is a continuation-in-part of and claims priority to co-pending U.S. application Ser. No. 12/606,986, filed Oct. 27, 2009, which is a continuation of U.S. application Ser. No. 12/046,283, filed Mar. 11, 2008, now U.S. Pat. No. 7,607,495, which is a continuation of U.S. application Ser. No. 11/717,467, filed Mar. 12, 2007, now U.S. Pat. No. 7,353,886, which is a continuation of U.S. application Ser. No. 11/418,546, filed May 3, 2006, now U.S. Pat. No. 7,188,681, which is a continuation of U.S. patent application Ser. No. 10/759,664, filed Jan. 19, 2004, now U.S. Pat. No. 7,080,700, which is a continuation of U.S. application Ser. No. 10/004,965, filed Dec. 3, 2001, now U.S. Pat. No. 6,679,341, which claims the benefit under 35 U.S.C. §119(e) of U.S. Provisional Patent Application Ser. No. 60/250,847, filed Dec. 1, 2000.

This application is also a continuation-in-part of and claims priority to co-pending U.S. application Ser. No. 12/368,417, filed Feb. 10, 2009, which is a continuation of U.S. application Ser. No. 12/044,502, filed Mar. 7, 2008, now U.S. Pat. No. 7,493,967, which is a continuation of U.S. application Ser. No. 11/417,535, filed May 3, 2006, now U.S. Pat. No. 7,343,982, which is a continuation U.S. patent application Ser. No. 10/745,400, filed Dec. 23, 2003, now U.S. Pat. No. 7,121,364, which claims the benefit under 35 U.S.C. §119(e) of U.S. Provisional Patent Application Ser. No. 60/446,644, filed Feb. 10, 2003; U.S. Provisional Patent Application Ser. No. 60/448,163, filed Feb. 14, 2003; and U.S. Provisional Patent Application Ser. No. 60/525,309, filed Nov. 26, 2003.

INCORPORATION BY REFERENCE

This application incorporates by reference the entire disclosures of (1) U.S. Pat. No. 6,347,674 to Bloom et al.; (2) U.S. Pat. No. 6,241,031 to Beaufort et al.; (3) U.S. Pat. No. 6,003,606 to Moore et al.; (4) U.S. Pat. No. 6,464,003 to Bloom et al.; (5) U.S. Provisional Patent Application Ser. No. 60/250,847, filed Dec. 1, 2000; (6) U.S. Pat. No. 6,715,559 to Bloom et al.; (7) U.S. application Ser. No. 10/004,965, entitled "TRACTOR WITH IMPROVED VALVE SYSTEM," filed on Dec. 3, 2001; (8) U.S. Pat. No. 7,121,364 to Mock et al.; (9) U.S. Provisional Patent Application Ser. No. 60/446,644, filed on Feb. 10, 2003; and (10) U.S. Provisional Patent Application Ser. No. 60/448,163, filed on Feb. 14, 2003; and (11) U.S. Provisional Patent Application Ser. No. 60/525,309, filed Nov. 26, 2003.

BACKGROUND OF THE DISCLOSURE

1. Field of the Disclosure

This invention relates generally to tractors for moving equipment within passages and, in some embodiments, more particularly to a hydraulically powered tractor having an improved valve system.

2. Description of the Related Art

The art of moving equipment through vertical, inclined, and horizontal passages plays an important role in many industries, such as the petroleum, mining, and communications industries. In the petroleum industry, for example, it is often necessary to move drilling, intervention, well completion, and other forms of equipment through boreholes drilled into the earth.

One method for moving equipment through a borehole is to use rotary drilling equipment. In traditional rotary drilling, vertical and inclined boreholes are commonly drilled by the attachment of a rotary drill bit and/or other equipment (collectively, the "Bottom Hole Assembly" or BHA) to the end of a rigid drill string. The drill string is typically constructed of a series of connected links of drill pipe that extend between ground surface equipment and the BHA. A passage is drilled as the drill string and drill bit are together lowered into the earth. A drilling fluid, such as drilling mud, is pumped from the ground surface equipment through an interior flow channel of the drill string to the drill bit. The drilling fluid is used to cool and lubricate the bit, as well as for removing debris and rock chips from the borehole. The drilling fluid returns to the surface, carrying the cuttings and debris, through the annular space between the outer surface of the drill pipe and the inner surface of the borehole. As the drill string is lowered or raised within the borehole, it is necessary to continually add or remove links of drill pipe at the surface, at significant time and cost.

Another method of moving equipment within a borehole involves the use of downhole tools commonly referred to as "tractors." A tractor is capable of gripping onto the borehole and thrusting both itself and other equipment through it. A self-propelled tractor of this type may be used for pushing and pulling adjoining equipment through inclined or horizontal boreholes. Tractors can be attached to rigid drill strings or may be used in conjunction with coiled tubing equipment.

Coiled tubing equipment generally includes a non-rigid, compliant tube, referred to herein simply as "coiled tubing," through which operating fluid is delivered to the tractor. The operating fluid can provide hydraulic power to propel the tractor and the equipment and, in drilling applications, to lubricate the drill bit. In such systems, the operating fluid may also provide the power necessary for enabling the tractor to grip the inner surface of the borehole. In comparison to rotary equipment, the use of coiled tubing in conjunction with a tractor is generally less expensive, easier to use, less time consuming to employ, and provides more control of speed and downhole loads. In addition, due to its greater compliance and flexibility, the coiled tubing permits the tractor to negotiate sharper turns in the borehole than rotary equipment.

Due to their versatility, self-propelled tractors may be used in a wide variety of applications. For example, a tractor may be used for well completion and production work for producing oil from an oil well, pipeline installation and maintenance, laying and movement of communication lines, well logging activities, washing and acidizing of sands and solids, retrieval of tools and debris, and the like. One type of tractor comprises an elongate body securable to the lower end of a drill string. The body may include one or more joined shafts attached to a control assembly housing or valve system.

Tractors generally include at least one anchor or gripper assembly adapted to grip the inner surface of the borehole. When the gripper assembly is actuated, hydraulic power from operating fluid may be used to propel the body axially through the borehole. The gripper assembly is longitudinally movably engaged with the tractor body, so that the body and drill string can move axially through the borehole while the gripper assembly is anchored to the inner surface of the passage. Several embodiments of a fluid-actuated gripper assembly are disclosed in U.S. Pat. No. 6,464,003 to Bloom et al. In one highly effective embodiment, the gripper assembly includes a plurality of flexible toes that expand radially outward by the interaction of ramps and rollers to engage, and thereby grip, the inner surface of the passage.

Tractors are commonly configured with two or more sets of gripper assemblies, which provide the ability to have at least one gripper anchored to the borehole at all times. This configuration permits the tractor to move in a substantially continuous manner within the passage. Forward longitudinal motion (unless otherwise indicated, the terms "longitudinal" and "axial" are herein used interchangeably and refer to the longitudinal axis of the tractor body) is achieved by powering the tractor body forward with respect to an actuated first gripper assembly (a "power stroke" with respect to the first gripper assembly), and simultaneously moving a retracted second gripper assembly forward with respect to the tractor body (a "reset stroke" of the second gripper assembly). At or near the completion of the power stroke with respect to the first gripper assembly, the second gripper assembly is actuated and the first gripper assembly is retracted. Then, the tractor body is powered forward while the second gripper assembly is actuated (a power stroke with respect to the second gripper assembly), and the retracted first gripper assembly executes a reset stroke. At or near the completion of these respective strokes, the first gripper assembly is actuated and the second gripper assembly is retracted. The cycle is then repeated. Thus, each gripper assembly operates in a cycle of actuation, power stroke, retraction, and reset stroke, resulting in longitudinal motion of the tractor.

A number of highly effective tractor designs utilizing this configuration are disclosed in U.S. Pat. No. 6,003,606 to Moore et al., which discloses several embodiments of a tractor known as the "Puller-Thruster Downhole Tool;" U.S. Pat. No. 6,241,031 to Beaufort et al.; and U.S. Pat. No. 6,347,674 to Bloom et al., which discloses an "Electrically Sequenced Tractor" ("EST").

As discussed above, the power required for actuating the gripper assemblies, longitudinally thrusting the tractor body during power strokes, and longitudinally resetting the gripper assemblies during reset strokes may be provided by pressurized operating fluid delivered to the tractor via the drill string. Typically, one or more flow control devices, such as valves, are provided within the tractor body for distributing the operating fluid to the tractor's gripper assemblies, thrust chambers, and reset chambers.

Some types of tractors, including several embodiments of the Puller-Thruster Downhole Tool, are entirely hydraulically powered. Pressure-responsive valves typically shuttle between various positions based upon the pressure of the operating fluid in various locations of the tractor. In one configuration, a pressure-responsive valve may take the form of a spool valve that is exposed on both ends to different fluid chambers or passages. As a result, the valve position depends on the differential pressure between the fluid chambers. Fluid having a higher pressure in a first chamber exerts a greater force on the valve than fluid having a lower pressure in a second chamber, forcing the valve to one extreme position. The valve moves to another extreme position when the pressure in the second chamber is greater than the pressure in the first chamber. Another type of pressure-responsive valve takes the form of a spring-biased spool valve having at least one end exposed to fluid. The fluid pressure force is directed opposite to the spring biasing force, so that the valve is opened or closed only when the fluid pressure exceeds a threshold value.

In other configurations, tractors may be provided with one or more valves that are controlled by electrical signals sent from a control system at the surface or even on the tractor itself. For example, the aforementioned EST includes both electrically controlled valves and pressure-responsive valves. The electrically controlled valves are controlled by electrical control signals sent from a controller housed within the tractor body. For drilling operations, the EST may be preferred over all-hydraulic tractors because electrical control of the valves permits very precise control over important drilling parameters, such as speed, position, and thrust.

In contrast, all-hydraulic tractors, including several embodiments of the Puller-Thruster Downhole Tool, are generally preferred for so-called "intervention" operations. As used herein, the term "intervention" refers to re-entry into a previously drilled well for the purpose of improving well production, to thereby improve fuel production rates. As wells age, the rate at which fuel can be extracted therefrom diminishes for several reasons. This necessitates the "intervention" of many different types of tools. Hydraulic tractors are generally preferred over electrically controlled tractors for intervention operations because hydraulic tractors are less expensive to operate and intervention operations do not require precise control of speed or position.

Tractors used in combination with coiled tubing equipment are particularly useful for intervention operations because, in many cases, the wells were originally drilled with rotary drilling equipment capable of drilling very deep holes. It is more expensive to bring back the rotary equipment than it is to bring in a coiled tubing unit. However, in many situations, the coiled tubing unit may not be capable of reaching extended distances within the borehole without the aid of a tractor. The tractor is particularly useful for reaching locations within inclined or horizontal boreholes.

Those skilled in the art appreciate that tractors of the type generally described above may be exposed to a wide variety of different conditions. For example, depending on the particular application, the pressure, weight, and density of the operating fluid may vary significantly. Furthermore, the shape and angle of the borehole may vary. In addition, the weight of the equipment that the tractor must pull and/or push will differ with the particular application.

SUMMARY OF THE DISCLOSURE

Some disclosed embodiments overcome the aforementioned limitations of the prior art by providing a hydraulically powered and substantially or completely hydraulically controlled tractor to be used preferably with coiled tubing equipment. The disclosed embodiments represent a major advancement in the art of tractors, and particular in the art of well intervention tools. Compared to the prior art, the preferred embodiments of the tractor of the invention operate very effectively within a much larger zone of parameters, such as the pressure, weight, and density of the operating fluid, the geometry of the tractor components, and the total weight of the equipment that the tractor must pull and/or push.

As explained below, the tractor preferably includes a two-position propulsion control valve that directs fluid to and from the tractor's propulsion cylinders. In order for the propulsion control valve spool to shift, two cycle valves are provided for sensing the completion of the strokes of the propulsion cylinders. The cycle valves shift in order to begin a sequence of events that results in a fluid pressure force causing the propulsion control valve spool to shift, so that the propulsion cylinders can switch between their power and reset strokes. However, rather than administering high pressure fluid directly to the propulsion control valve spool, the cycle valves shift to send a pressure force to an additional two-position valve. The additional valve controls the flow of pressurized fluid to control the position of the propulsion control valve spool. Thus, the additional valve isolates the propulsion control valve from direct interaction with the cycle valves.

Advantageously, the shift action of the additional valve creates a longer time lag between the shift action of either cycle valve and the shift action of the propulsion control valve spool. Due to the time lag, the propulsion cylinders are more likely to complete their strokes before the propulsion control valve shifts. In addition, better shifting can be effected by spring-assisted detents on the propulsion control valve spool. In some illustrated embodiments, the additional valve comprises a gripper control valve that controls the distribution of fluid to and from the gripper assemblies.

The preferred embodiments include an inlet control valve having a feature that allows the valve to be hydraulically restrained in a closed position, so that the tractor is assured of being non-operational and in a non-gripping state. This permits the operation of downhole equipment adjoined to the tractor or other portions of the bottom hole assembly, such as perforation guns, substantially without the risk of inadvertent movement of the tractor. It also assures that the gripper assemblies are retracted from the borehole surface during the operation of other downhole equipment, thus reducing the risk of damage to the gripper assemblies.

In addition, some embodiments provide a new method of manufacturing the shafts that form the body of the tractor, which is much less expensive than prior art shaft manufacturing methods. According to this method, shaft portions are silver brazed together to form the shafts. Silver brazing is less expensive than prior art welding methods, such as electron beam welding. Also, the preferred material characteristics and internal fluid passage configuration permits longer gun-drilled holes. Advantageously, fewer shaft portions are necessary.

In one aspect, a tractor assembly is provided comprising a tractor for moving within a borehole. The tractor comprises an elongated body, first and second gripper assemblies, first and second elongated propulsion cylinders, and a valve system. The body has first and second pistons longitudinally fixed with respect to the body. Each piston has aft and forward surfaces configured to receive longitudinal thrust forces from fluid from a pressurized source. The body has a flow passage.

Each gripper assembly is longitudinally movably engaged with the body. Each gripper assembly has an actuated position in which the gripper assembly limits relative movement between the gripper assembly and an inner surface of the borehole, and a retracted position in which the gripper assembly permits substantially free relative movement between the gripper assembly and said inner surface. Each gripper assembly is configured to be actuated by fluid.

The first propulsion cylinder is longitudinally slidably engaged with respect to the body and has an elongated internal propulsion chamber enclosing the first piston. The first piston is slidable within and fluidly divides the internal propulsion chamber of the first cylinder into an aft chamber and a forward chamber. Similarly, the second propulsion cylinder is longitudinally slidably engaged with respect to the body and has an elongated internal propulsion chamber enclosing the second piston. The second piston is slidable within and fluidly divides the internal propulsion chamber of the second cylinder into an aft chamber and a forward chamber.

The valve system comprises a propulsion control valve and a gripper control valve. The propulsion control valve has a first position in which it provides a flow path for the flow of fluid to the aft chamber of the first cylinder. The propulsion control valve also has a second position in which it provides a flow path for the flow of fluid to the aft chamber of the second cylinder. The gripper control valve has a first position in which it provides a flow path for the flow of fluid to the first gripper assembly. The gripper control valve also has a second position in which it provides a flow path for fluid to the second gripper assembly. When the gripper control valve is in its first position and the propulsion control valve is in its first position, the gripper control valve must move from its first position to its second position before the propulsion control valve can move from its first position to its second position.

In another aspect, a method is provided of moving the tractor assembly (described immediately above) within a borehole. The method comprises providing pressurized fluid from a source, directing the pressurized fluid toward the gripper control valve, directing the pressurized fluid toward the propulsion valve, and, when the gripper control valve and propulsion control valves are in their first positions, preventing the propulsion control valve from moving from its first position to its second position until the gripper control valve moves from its first position to its second position.

In another aspect, a tractor assembly is provided comprising a tractor for moving within a borehole. The tractor comprises an elongated body, first and second gripper assemblies, first and second elongated propulsion cylinders, and a valve system. The elongated body has first and second pistons longitudinally fixed with respect to the body. Each of the pistons has aft and forward surfaces configured to receive longitudinal thrust forces from fluid from a pressurized source. The body also has a flow passage. Each of the first and second gripper assemblies is longitudinally movably engaged with the body, and has actuated and retracted positions as described above. The first and second propulsion cylinders are configured as described above.

The valve system comprises a propulsion valve and a control valve. The propulsion valve has a first position in which it provides a flow path for the flow of fluid to the aft chamber of the first cylinder, and a second position in which it provides a flow path for the flow of fluid to the aft chamber of the second cylinder. The control valve has a first position in which it provides a flow path for the flow of fluid to urge the propulsion valve toward the first position of the propulsion valve. The control valve has a second position in which it provides a flow path for the flow of fluid to urge the propulsion valve toward the second position of the propulsion valve. When the control valve and the propulsion valve are in their first positions, the control valve must move from its first position to its second position before the propulsion valve can move from its first position to its second position.

In another aspect, a method is provided of moving the tractor assembly (described immediately above) within a borehole. The method comprises providing pressurized fluid from a source, directing the pressurized fluid toward the gripper control valve, directing the pressurized fluid toward the propulsion valve, and, when the control valve and the propulsion valve are in their first positions, preventing the propulsion valve from moving from its first position to its second position before the control valve moves from its first position to its second position.

In another aspect, a tractor assembly is provided comprising a tractor for moving within a borehole. The tractor is configured to be powered by operating fluid received from a conduit extending from the tractor through the borehole to a source of the operating fluid. The tractor comprises an elongated body, a gripper assembly, a valve system housed within the body, a pressure reduction valve, and first and second gripper fluid passages. The elongated body has a thrust-receiving portion longitudinally fixed with respect to the body. The body also has an internal passage configured to receive the operating fluid from the conduit. The gripper assembly is longitudinally movably engaged with the body and has actuated and retracted positions as described above. The valve system is configured to receive operating fluid from the internal passage of the body and to selectively control the flow of operating fluid to at least one of the gripper assembly and the thrust-receiving portion. The first gripper fluid passage extends from the valve system to the pressure reduction valve, while the second gripper fluid passage extends from the pressure reduction valve to the gripper assembly. The pressure reduction valve is configured to provide a flow path for operating fluid to flow from the first gripper fluid passage to the second gripper fluid passage when the pressure within the first gripper fluid passage is below a threshold. The pressure reduction valve is also configured to prevent fluid from flowing from the first gripper fluid passage to the second gripper fluid passage when the pressure within the first gripper fluid passage is above the threshold.

In another aspect, a method is provided of moving a tractor assembly within a borehole. The tractor assembly includes a tractor having an elongated body, a gripper assembly longitudinally movably engaged with the body, a valve system housed within the body, and first and second gripper fluid passages. The body has a thrust-receiving portion longitudinally fixed with respect to the body. The body also has an internal passage configured to receive the operating fluid from the conduit. The gripper assembly has actuated and retracted positions as described above, and is configured to be actuated by receiving operating fluid from the internal passage of the body. The valve system is configured to receive operating fluid from the internal passage of the body and to selectively control the flow of operating fluid to at least one of the gripper assembly and the thrust-receiving portion. The first gripper fluid passage extends from the valve system, and the second gripper fluid passage extends to the gripper assembly. According to the method of this aspect, pressurized fluid is provided from a source. The pressurized fluid is permitted to flow from the first gripper fluid passage to the second gripper fluid passage when the pressure within the first gripper fluid passage is below a threshold. Fluid is prevented from flowing from the first gripper fluid passage to the second gripper fluid passage when the pressure within the first gripper fluid passage is above the threshold.

In another aspect, a tractor assembly is provided comprising a tractor for moving within a borehole. The tractor is configured to be powered by pressurized operating fluid received from a conduit extending from the tractor through the borehole to a source of the operating fluid. The tractor comprises an elongated body, a gripper assembly longitudinally movably engaged with the body, and a valve system housed within the body. The body has a thrust-receiving portion longitudinally fixed with respect to the body, and an internal passage configured to receive the operating fluid from the conduit. The gripper assembly has actuated and retracted positions as described above.

The valve system is configured to receive fluid from the internal passage of the body and to selectively control the flow of operating fluid to at least one of the gripper assembly and the thrust-receiving portion. The valve system includes an entry control valve controlling the flow of operating fluid from the internal passage of the body into the valve system. The entry control valve comprises a valve passage and a body movably received therein. The valve passage has at least two secondary passages and is configured to conduct the operating fluid between the secondary passages. The entry control valve has first and third position ranges in which it provides a flow path for operating fluid within the valve system to flow through the entry control valve to the exterior of the tractor, and in which the valve body prevents the flow of operating fluid from the internal passage of the tractor body into the valve system. The entry control valve also has a second position range in which it provides a flow path for operating fluid from the internal passage of the tractor body to flow into the valve system, and in which the valve body prevents the flow of operating fluid within the valve system to the exterior of the tractor. The entry control valve is in its first position range when the fluid pressure in the internal passage of the tractor body is below a lower shut-off threshold. The entry control valve is in the second position range when the fluid pressure in the internal passage is above the lower shut-off threshold and below an upper shut-off threshold. The entry control valve is in the third position range when the fluid pressure in the internal passage is above the upper shut-off threshold.

In another aspect, a method is provided of moving a tractor assembly within a borehole, the tractor assembly including a tractor having an elongated body and gripper assembly configured as in the previously described aspect. The tractor also comprises a valve system housed within the body, the valve system including an entry control valve. According to the method, fluid is received from the internal passage of the body, and the flow of operating fluid from the internal passage of the body into the valve system is controlled with the entry control valve. The flow of operating fluid from the internal passage of the body into the valve system is prevented with the entry control valve when the fluid pressure in the internal passage of the body is below a lower shut-off threshold and when the fluid pressure in the internal passage is above an upper shut-off threshold. The flow of operating fluid from the internal passage of the body into the valve system is permitted when the fluid pressure in the internal passage is above the lower shut-off threshold and below the upper shut-off threshold.

In another aspect, a tractor assembly is provided comprising a tractor for moving within a borehole. The tractor is configured to be powered by pressurized operating fluid received from a conduit extending from the tractor through the borehole to a source of the operating fluid. The tractor comprises an elongated body, a gripper assembly longitudinally movably engaged with the body, and a valve system. The elongated body has a thrust-receiving portion longitudinally fixed with respect to the body. The body also has an internal passage configured to receive the operating fluid from the conduit. The gripper assembly has actuated and retracted positions as described above.

The valve system of the tractor is configured to receive fluid from the internal passage of the body and to selectively control the flow of operating fluid to at least one of the gripper assembly and the thrust-receiving portion. The valve system includes an entry control valve controlling the flow of operating fluid from the internal passage of the body into the valve system. The entry control valve comprises a housing defining a valve passage, a body movably received within the passage, and at least one spring. The housing has at least two side passages, the valve passage being configured to conduct the operating fluid between the side passages. The valve body has a first surface configured to be exposed to operating fluid from the internal passage of the tractor body, the first surface being configured to receive a longitudinal pressure force in a first direction. The valve body has first and third position ranges in which the body provides a flow path for operating fluid within the valve system to flow through the entry control valve to the exterior of the tractor, and in which the valve body prevents the flow of operating fluid from the internal passage of the body into the valve system. The valve body has a second position range between the first and third position ranges in which the valve body provides a flow path for operating fluid from the internal passage of the tractor body to flow into the valve system, and in which the valve body prevents the flow of operating fluid within the valve system to the exterior of the tractor.

The at least one spring biases the valve body in a direction opposite to that of the pressure force received by the first surface of the valve body, such that the magnitude of the fluid pressure in the internal passage determines the deflection of the at least one spring and thus the position of the valve body. The at least one spring is configured so that the valve body occupies a position within the first position range when the fluid pressure in the internal passage of the tractor body is below a lower shut-off threshold, so that the valve body occupies a position within the second position range when the fluid pressure in the internal passage is above the lower shut-off threshold and below an upper shut-off threshold, and so that the valve body occupies a position within the third position range when the fluid pressure in the internal passage is above the upper shut-off threshold.

In another aspect, a tractor assembly is provided comprising a tractor for moving within a borehole while connected to an injector by a drill string. The tractor comprises an elongated body, first and second gripper assemblies, elongated first and second propulsion cylinders, and a valve system. The body has first and second pistons longitudinally fixed with respect to the body. Each of the pistons has aft and forward surfaces configured to receive longitudinal thrust forces from fluid from a pressurized source. The body also has a flow passage. The first gripper assembly is longitudinally movably engaged with the body and has actuated and retracted positions as described above. Similarly, the second gripper assembly is longitudinally movably engaged with the body and has actuated and retracted positions as described above. The first propulsion cylinder is longitudinally slidably engaged with respect to the body. The first cylinder has an elongated internal propulsion chamber enclosing the first piston. The first piston is slidable within and fluidly divides the internal propulsion chamber of the first cylinder into an aft chamber and a forward chamber. Similarly, the second propulsion cylinder is longitudinally slidably engaged with respect to the body. The second cylinder has an elongated internal propulsion chamber enclosing the second piston. The second piston is slidable within and fluidly divides the internal propulsion chamber of the second cylinder into an aft chamber and a forward chamber.

The valve system of the tractor comprises a propulsion control valve and a gripper control valve. The propulsion control valve has a first position in which it provides a flow path for the flow of fluid to the aft chamber of the first cylinder, and a second position in which it provides a flow path for the flow of fluid to the aft chamber of the second cylinder. The gripper control valve has a first position in which it provides a flow path for the flow of fluid to the first gripper assembly, and a second position in which it provides a flow path for fluid to the second gripper assembly. The speed of movement of the tractor is controlled by the pressure and flow rate of the operating fluid and the tension exerted on the tractor by the drill string.

In another aspect, a tractor assembly is provided comprising a tractor for moving within a borehole. The tractor comprises an elongated body, a first gripper assembly longitudinally movably engaged with the body, an elongated first propulsion cylinder longitudinally slidably engaged with respect to the body, and a valve system. The body has first and second pistons longitudinally fixed with respect to the body. Each of the pistons has aft and forward surfaces configured to receive longitudinal thrust forces from fluid from a pressurized source. The body also has a flow passage. The first gripper assembly has actuated and retracted positions as described above. The first propulsion cylinder has an elongated internal propulsion chamber enclosing the first piston. The first piston is slidable within and fluidly divides the internal propulsion chamber of the first cylinder into an aft chamber and a forward chamber.

The valve system comprises a propulsion valve and a control valve. The propulsion valve has a first position in which it provides a flow path for the flow of fluid to the aft chamber of the first cylinder, and a second position in which it does not provide a flow path for the flow of fluid to the aft chamber of the first cylinder. The control valve has a first position in which it provides a flow path for the flow of fluid to urge the propulsion valve toward the first position, and a second position in which it provides a flow path for the flow of fluid to urge the propulsion valve toward the second position. When the control valve and the propulsion valve are in their first positions, the control valve must move from its first position to its second position before the propulsion valve can move from its first position to its second position.

Although tractors may be exposed to a wide variety of conditions, the inventors have found that existing tractors, and particularly all-hydraulic tractors, are configured to operate effectively within only a relatively limited range of conditions. This can be a significant shortcoming that increases costs and limits the effectiveness of tractors in the field.

Therefore, an improved valve system is desired for enabling a tractor to operate effectively under a wider variety of conditions. In one embodiment, such a valve system is capable of controlling the tractor operation independently of the tractor's load and speed. It may also be desirable that such a valve system is not susceptible to premature valve shifting when exposed to fluctuations in the pressure of the operating fluid. It may also be desirable that such a valve system protects its internal components from damage. It may also be desirable that such a valve system allows the tractor to be operated relatively inexpensively and simplifies use of the tractor in the field by reducing or eliminating the steps for calibration, operation and downhole trouble-shooting. It may also be desirable that such a valve system be adapted for use under a wide range of flow rates and is compatible with a wide variety of BHA components. It is also desirable that such a valve system provides for highly efficient movement by reducing unnecessary dwell times between steps in the operational sequence.

The pressure of the operating fluid within a tractor may fluctuate substantially as the valve system directs fluid to actuate the grippers and/or power the pistons (or other similar mechanism) during advancement of the tractor through the passage. In certain applications, it is not uncommon for the pressure to fluctuate as much as one thousand psi. During field use, the inventors have found that the pressure fluctuations can render other tools inoperable or incompatible, particularly if the other tools are adapted for use within a limited range of pressure. As a result, the user's ability to use the tractor in combination with other tools may be limited.

Furthermore, the inventors have found that the large pressure cycles add undesirable fatigue cycles to the internal tractor components and/or to the attached tools. This may limit the design life of the tractor and/or other attached tools and can thereby significantly impact the operating cost of using the tractor.

Still further, the inventors have found that pressure-actuated valves may be susceptible to premature shifting due to pressure spikes or other large fluid pressure fluctuations. Similarly, testing has shown that the valves may be particularly susceptible to premature shifting when the tractor system is subjected to heavy loads, and/or large dynamic pressure waves (or "water hammer" effects) caused by the opening and closing of other valves within the control assembly. In certain applications, premature valve shifting may significantly limit the operational range and efficiency of the tractor.

In various embodiments of the present invention, there is provided an improved valve system adapted for use with a tractor that overcomes the above-mentioned problems of the prior art. These embodiments represent a major advancement in the art of tractors, and particular in the art of well intervention tools. Compared to the prior art, certain embodiments of the improved valve system can provide for greater control of tractor movement and operate very effectively within a much larger zone of parameters. In addition, by providing for better control over the fluid pressure, certain embodiments of the improved valve system can extend the useful life of internal components and thereby reduce operating costs.

In one aspect, a tractor for moving a component through a borehole comprises an elongate body with aft and forward gripper assemblies longitudinally movably engaged thereon. The aft and forward gripper assemblies are preferably hydraulically actuated for selectively engaging an inner surface of the borehole. Aft and forward propulsion assemblies are provided for advancing the body through the borehole relative to the aft and forward gripper assemblies, respectively. A gripper control valve is provided for directing pressurized fluid to the aft and forward gripper assemblies. The gripper control valve preferably has a first position for directing pressurized fluid to the aft gripper assembly and a second position for directing pressurized fluid to the forward gripper assembly. In a significant feature, aft and forward mechanically actuated valves disposed along the body for detecting advancement of the body relative to said aft or forward gripper assembly, respectively, thereby providing a mechanism for improving the timing and efficiency of the tractor operation. In particular, the aft and forward mechanically actuated valves are in fluid communication with the gripper control valve for causing the gripper control valve to change positions after the body has completed an advancement stroke through the borehole relative to said aft or forward gripper assembly.

In another aspect, a tractor for moving a component through a borehole comprises an elongate body having an internal passage extending therethrough for providing pressurized fluid to a bottom hole assembly. Aft and forward gripper assemblies longitudinally are slidably coupled to the elongate body. The aft and forward gripper assemblies are preferably hydraulically actuated for selectively engaging an inner surface of the borehole. Aft and forward propulsion assemblies are provided for advancing the body through the borehole relative to the aft and forward gripper assemblies, respectively. A gripper control valve is provided for directing pressurized fluid to the aft and forward gripper assemblies. The gripper control valve preferably has a first position for directing pressurized fluid to the aft gripper assembly and a second position for directing pressurized fluid to the forward gripper assembly. A propulsion control valve is also disposed within the body and has a first position for directing pressurized fluid to the aft propulsion assembly and a second position for directing pressurized fluid to the forward propulsion assembly. A supply line provides pressurized fluid from a supply source at a location on the surface to the gripper control valve and the gripper control valve. A pressure relief valve is disposed within said body of the tractor for regulating fluid pressure in the internal passage. The pressure relief valve also regulates the pressure of the fluid entering through the valve system of the tractor. In one variation, the valve system may include a start-stop valve which prevent fluid from entering the gripper control valve and propulsion control valve. The outlet from the start-stop valve may be used to pilot the pressure relief valve, thereby providing a mechanism for turning off the pressure relief valve when desired.

In yet another aspect, a tractor for moving a component through a borehole comprises an elongate body formed with an internal passage extending longitudinally therethrough. Aft and forward gripper assemblies are slidably coupled to the elongate body. The aft and forward gripper assemblies are preferably hydraulically actuated for selectively engaging an inner surface of the borehole. Aft and forward propulsion assemblies are adapted for advancing said body through the borehole relative to the aft and forward gripper assemblies, respectively. A hydraulic valve system is housed within the elongate body and is configured for receiving a portion of the pressurized fluid from the internal passage and directing the fluid to the aft or forward gripper assembly in a desired sequence for effecting movement of the tractor through the borehole. A pressure relief valve is provided for limiting fluid pressure within the internal passage and the hydraulic valve system, wherein the pressure relief valve is adapted to vent fluid from the internal passage to an annulus when the fluid pressure in the internal passage exceeds a pre-selected threshold. A first fluid path extends from said internal passage to the hydraulic valve system. A second fluid path extends from the internal passage to the pressure relief valve.

In still another aspect, an apparatus for moving through a borehole comprises an elongate body formed with an internal passage extending longitudinally therethrough. Aft and forward gripper assemblies are slidably coupled to the elongate body. The aft and forward gripper assemblies are preferably hydraulically actuated for selectively engaging an inner surface of the borehole. Aft and forward propulsion assemblies are adapted for advancing said body through the borehole relative to the aft and forward gripper assemblies, respectively. A hydraulic valve system is housed within the elongate body and is configured for receiving a portion of the pressurized fluid from the internal passage and directing the fluid to the aft or forward gripper assembly in a desired sequence for effecting movement of the tractor through the borehole. A pressure relief valve is provided for limiting fluid pressure within the internal passage and the hydraulic valve system, wherein the pressure relief valve is adapted to vent fluid from the internal passage to an annulus when the fluid pressure in the internal passage exceeds a pre-selected threshold. A first fluid path extends from said internal passage to the hydraulic valve system. A second fluid path extends from the internal passage to the pressure relief valve.

For purposes of summarizing the disclosure and the advantages achieved over the prior art, certain objects and advantages of certain embodiments have been described above and as further described below. Of course, it is to be understood that not necessarily all such objects or advantages may be achieved in accordance with any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

These and other embodiments are intended to be within the scope of the invention disclosed herein. These and other embodiments will become readily apparent to those skilled in the art from the following detailed description of the preferred embodiments having reference to the attached figures, the invention not being limited to any particular preferred embodiment(s) disclosed.

DETAILED DESCRIPTION OF THE SPECIFIC EMBODIMENTS

Figure 1:
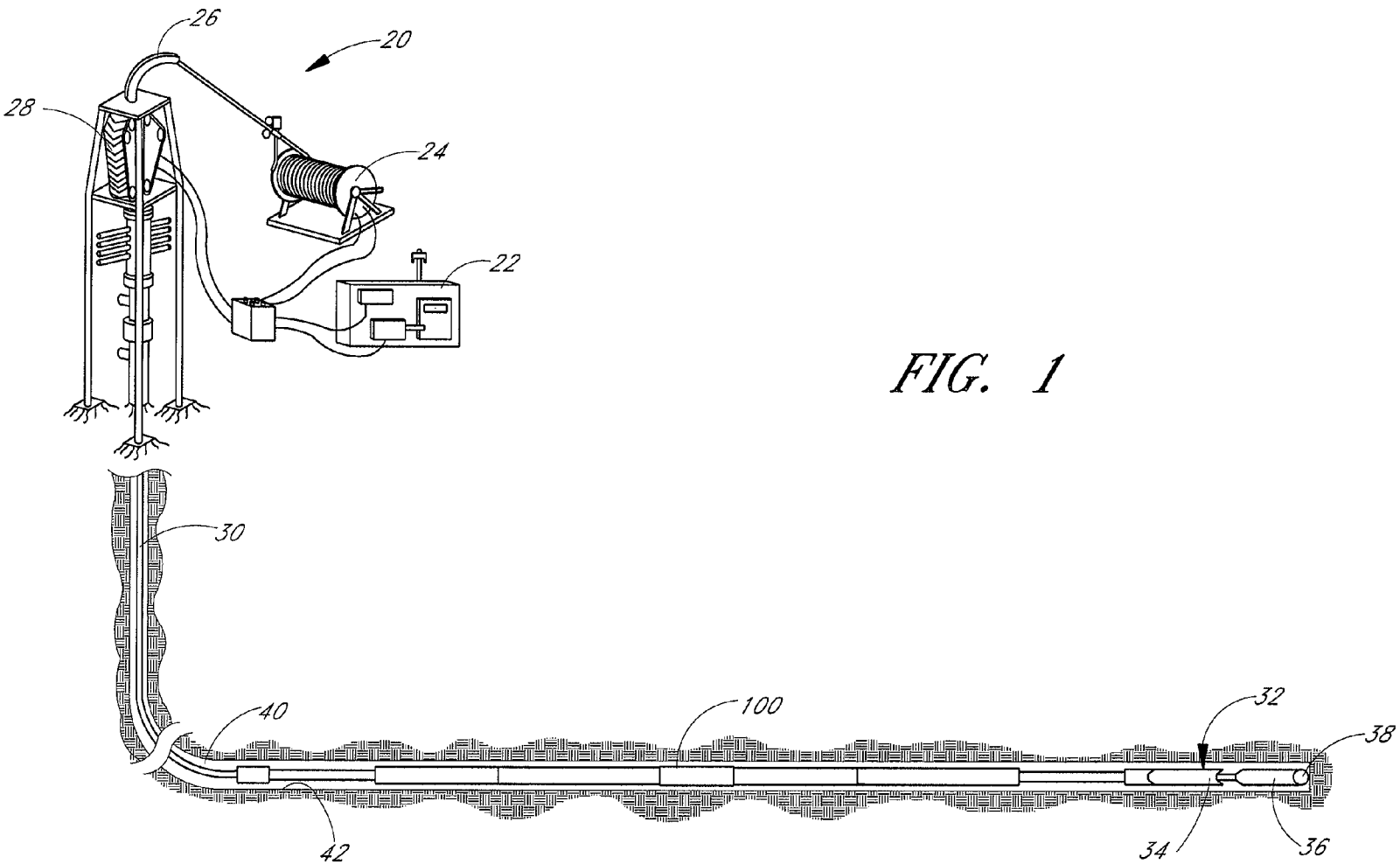
FIG. 1 is a schematic diagram of the major components of one embodiment of a tractor of the present invention, utilized in conjunction with a coiled tubing system.

FIG. 1 shows a hydraulic tractor 100 for moving equipment within a passage, configured in accordance with a preferred embodiment of the present invention. In the embodiments shown in the accompanying figures, the tractor of the present invention may be used in conjunction with a coiled tubing drilling system 20 and adjoining downhole equipment 32. The system 20 may include a power supply 22, tubing reel 24, tubing guide 26, tubing injector 28, and coiled tubing 30, all of which are well known in the art. The tractor 100 is configured to move within a borehole having an inner surface 42. An annulus 40 is defined by the space between the tractor 100 and the inner surface 42 of the borehole.

The downhole equipment 32 may include various types of equipment that the tractor 100 is designed to move within the passage. For example, the equipment 32 may comprise a perforation gun assembly, an acidizing assembly, a sand-washing assembly, a bore plug setting assembly, an E-line, a logging assembly, a bore casing assembly, a measurement while drilling (MWD) assembly, or a fishing tool. Also, the equipment 32 may comprise a combination of these items. If the tractor 100 is used for drilling, the equipment 32 will preferably include an MWD system 34, downhole motor 36, and drill bit 38, all of which are also known in the art. Of course, the downhole equipment 32 may include many other types of equipment for non-drilling applications, such as intervention and completion applications. While the equipment 32 is illustrated on the forward end of the tractor, it will be understood that such downhole equipment can be connected both aftward and forward of the tractor.

It will be appreciated that a hydraulic tractor of a preferred embodiment of the present invention may be used to move a wide variety of tools and equipment within a borehole or other passage. For example, the tractor can be utilized for applications such as well completion and production work for producing oil from an oil well, pipeline installation and maintenance, laying and movement of communication lines, well logging activities, washing and acidizing of sands and solids, retrieval of tools and debris, and the like. Also, while preferred for intervention operations, the tractor can be used for drilling applications, including petroleum drilling and mineral deposit drilling. The tractor can be used in conjunction with different types of drilling equipment, including rotary drilling equipment and coiled tubing equipment.

For example, one of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. These completion activities can be accomplished in inclined and horizontal boreholes using a preferred embodiment of the hydraulic tractor of the invention. For instance, the tractor can deliver these various types of logging sensors to regions of interest. The tractor can either place the sensors in the desired location, or it can idle in a stationary position to allow the measurements to be taken at the desired locations. The tractor can also be used to retrieve the sensors from the well.

Examples of production work that can be performed with a preferred embodiment of the hydraulic tractor of the invention include sands and solids washing and acidizing. It is known that wells sometimes become clogged with sand, hydrocarbon debris, and other solids that prevent the free flow of oil through the borehole 42. To remove this debris, specially designed washing tools known in the industry are delivered to the region, and fluid is injected to wash the region. The fluid and debris then return to the surface. Such tools include acid washing tools. These washing tools can be delivered to the region of interest for performance of washing activity and then returned to the ground surface by a preferred embodiment of the tractor of the invention.

In another example, a preferred embodiment of the tractor of the invention can be used to retrieve objects, such as damaged equipment and debris, from the borehole. For example, equipment may become separated from the drill string, or objects may fall into the borehole. These objects must be retrieved, or the borehole must be abandoned and plugged. Because abandonment and plugging of a borehole is very expensive, retrieval of the object is usually attempted. A variety of retrieval tools known to the industry are available to capture these lost objects. The tractor can be used to transport retrieving tools to the appropriate location, retrieve the object, and return the retrieved object to the surface.

In yet another example, a preferred embodiment of the tractor of the invention can also be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The tractor of the invention can be used in conjunction with the deployment of conventional velocity string and simple primary production tubing installations. The tractor can also be used with the deployment of artificial lift devices such as gas lift and downhole flow control devices.

In a further example, a preferred embodiment of the tractor of the invention can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the tractor so that the cleaning tools can be moved within the pipeline.

In still another example, a preferred embodiment of the tractor of the invention can be used to move communication lines or equipment within a passage. Frequently, it is desirable to run or move various types of cables or communication lines through various types of conduits. The tractor can move these cables to the desired location within a passage.

Overview of Tractor Components

Figure 2:
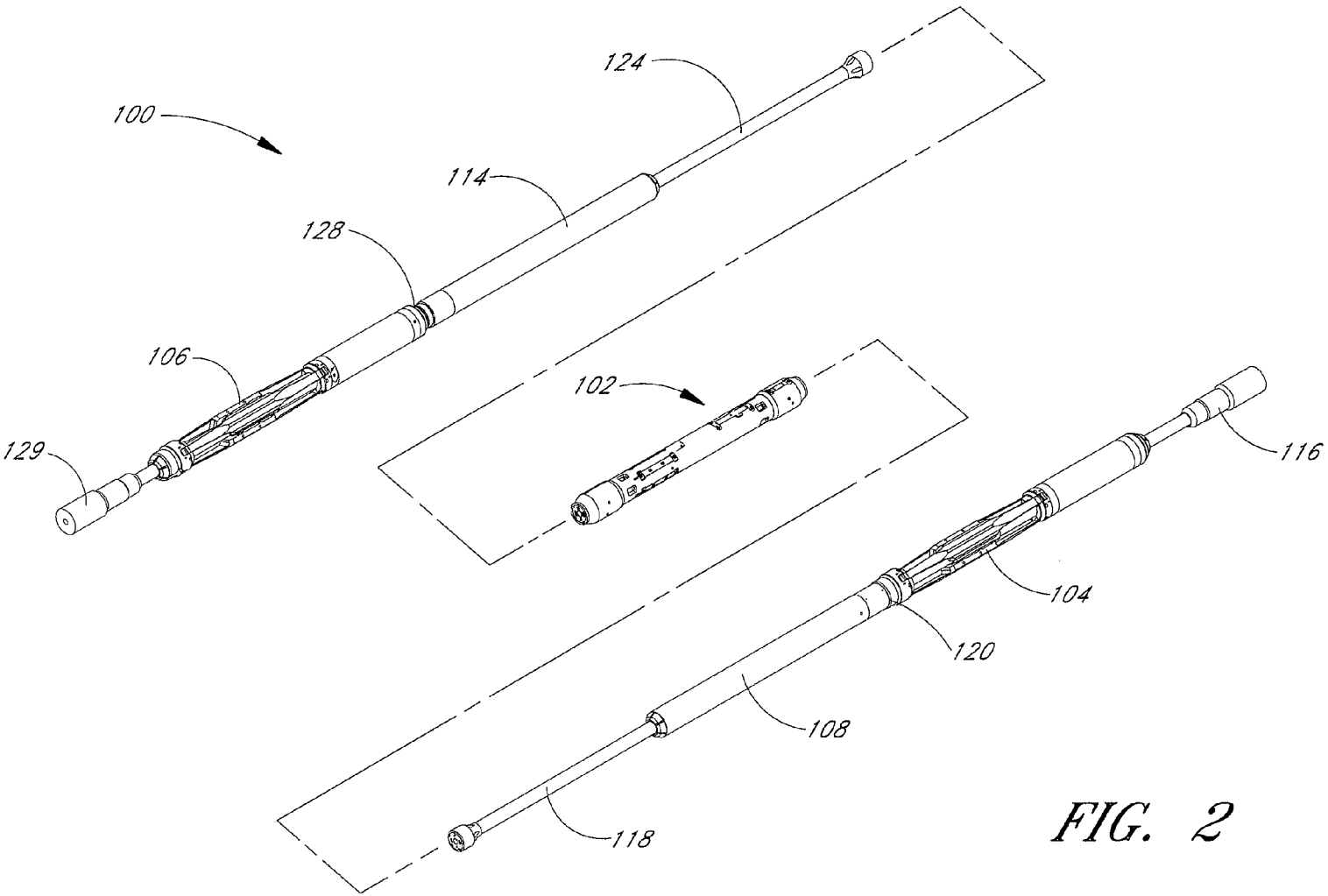
FIG. 2 is a front perspective view of a preferred embodiment of the tractor of the present invention.

FIG. 2 shows a preferred embodiment 100 of a tractor of the present invention, shown with the aft end on the right and the forward end on the left. The tractor 100 comprises a central control assembly 102, an uphole or aft gripper assembly 104, a downhole or forward gripper assembly 106, an aft propulsion cylinder 108, a forward propulsion cylinder 114, tool joint assemblies 116 and 129, shafts 118 and 124, and flex joints or adapters 120 and 128. The tool joint assembly 116 connects a drill string, such as coiled tubing, to the shaft 118. The aft gripper assembly 104, aft propulsion cylinder 108, and flex joint 120 are assembled together end-to-end and are all axially slidably engaged with the shaft 118. Similarly, the forward gripper assembly 106, forward propulsion cylinders 114, and flex joint 128 are assembled together end-to-end and are axially slidably engaged with the shaft 124. The tool joint assembly 129 couples the tractor 100 to downhole equipment 32 (FIG. 1). The shafts 118 and 124 and control assembly 102 are axially fixed with respect to one another and are sometimes referred to herein as the body of the tractor. The body of the tractor is thus axially fixed with respect to the drill string and the downhole tools.

The tractor 100 can be made to have the capability of pulling and/or pushing downhole equipment 32 of various weights. In one embodiment, the tractor 100 is capable of pulling and/or pushing a total weight of 100 lbs, in addition to the weight of the tractor itself. In three other embodiments, the tractor is capable of pulling and/or pushing a total weight of 500, 3000, and 15,000 lbs.

In order to prevent damage to a surrounding formation or casing wall, the tractor can be designed to limit the radial gripping load that it exerts on a surface surrounding the tractor. In one embodiment, the tractor exerts no more than 25 psi on a surface surrounding the tractor. This embodiment is particularly useful in softer formations, such as gumbo. In three other embodiments, the tractor exerts no more than 100, 3000, and 50,000 psi on a surface surrounding the tractor. At radial gripping loads of 50,000 psi or less, the tractor can be used safely in steel tube casing.

The tractor components shown in FIG. 2 are assembled in a manner similar to the components of the aforementioned EST, disclosed and illustrated in U.S. Pat. No. 6,347,674. Two notable differences between the tractor 100 shown in FIG. 2 and the EST are (1) the tractor 100 of the present invention utilizes gripper assemblies of a different type, and (2) the control assembly 102 of the tractor 100 is different than the control assembly of the EST. In the preferred embodiment, the gripper assemblies 104 and 106 of the tractor 100 are preferably of a design similar to a gripper assembly disclosed and illustrated in U.S. Pat. No. 6,464,003, with a number of improvements described below. The control assembly 102 houses a valve system that controls the distribution of operating fluid to and from the gripper assemblies and propulsion cylinders. The control assembly 102 is described below.

The control assembly 102 includes internal fluid passages for flow between the valves and flow to the gripper assemblies, propulsion cylinders, and downhole equipment. In a preferred embodiment, some of the fluid passage sizes are similar to or larger than the fluid passages of the control assembly of the EST. As in the EST design, the fluid passages are sized and located to fit within the available space constraints of the tractor. The sizes of the various components (e.g., the shafts, propulsion cylinders, pistons, control housing, valves, etc.) are generally similar to the sizes of analogous components of the EST. Using principles of design and space management made apparent by U.S. Pat. No. 6,347,674 (which discloses the EST) in combination with the specification and figures of the present application, one of ordinary skill in the art will understand how to build a tractor according to the present invention.

The tractor 100 can be any desirable length, but for typical oilfield applications the length is approximately 25 to 30 feet. The maximum diameter of the tractor will typically vary with the size of the hole, thrust requirements, and the restrictions that the tractor must pass through. The gripper assemblies can be designed to operate within boreholes of various sizes, but typically can expand to a diameter of 3.75 to 7.0 inches.

The flex adapters 120 and 128 are hollow structural members that provide a region of reduced flexural rigidity in the tractor. This region of increased flexibility facilitates the negotiation of sharp turns. The adapters are preferably formed of a relatively low modulus material such as Copper Beryllium (CuBe) and Titanium. Occasionally, there are applications that require the use of non-magnetic materials for the tractor. Otherwise, depending on the required turning capability of the tractor and resultant stresses, it is possible that various stainless steels may be used in many areas of the tractor.

In the preferred embodiment, the tool joint assembly 116 couples the shaft 118 to a coiled tubing drill string, preferably via a threaded connection. However, downhole tools can also be placed aftward of the tractor, connected to the tool joint assembly 116. The tool joint assembly 129 will normally be coupled to downhole tools. The interface threads of the tool joint assemblies are preferably API threads or proprietary threads (such as Hydril casing threads). The tool joint assemblies can be prepared with conventional equipment (tongs) to a specified torque (e.g., 1000-3000 ft-lbs). The tool joint assemblies can be formed from a variety of materials, including CuBe, steel, and other metals.

The shafts 118 and 124 can be formed from any suitable material. In one embodiment, the shafts are formed from a flexible material, such as CuBe, in order to permit the tractor 100 to negotiate sharper turns. In other embodiments CuBe is not used, as it is relatively expensive. Other acceptable materials include Titanium and steel (when low flexibility is sufficient). In a preferred configuration, each shaft includes a central internal bore (forming a portion of the passage 44 discussed below and shown in FIG. 3) for the flow of pressurized operating fluid to the downhole equipment and to the valve system of the tractor. This bore extends the entire length of each shaft. Each shaft also includes numerous other passages for the flow of fluid to the gripper assemblies and propulsion cylinders. These fluid passages range in length and are equal to or less than the overall length of the tractor. Multiple fluid passages can be drilled in the shaft for the same function, such as to feed a single propulsion chamber. Preferably, the bore and the other internal fluid passages are arranged so as to minimize stress and provide sufficient space and strength for other design features, such as the pistons within the cylinders. Each shaft is preferably provided with threads on one end for connection to the tool joint assemblies 116 and 129, and with a flange on the other end to allow bolting to the control assembly 102.

In one embodiment, the tractor 100 is specifically designed for intervention applications. While intervention tractors can be made any size, they are typically operated within 5-inch or 7-inch casing. The inside diameter of a 5-inch casing can range from 4.5 to 4.8 inches. The inside diameter of a 7-inch casing can range from 5.8 to 6.4 inches. The primary structural components of the tractor 100 are the shafts 118 and 124. In a preferred embodiment, the shafts have an outside diameter of 1.75 inches and an inside bore diameter of 0.8 inches. The remaining fluid passages of the shafts are preferably smaller. The pistons can have varying outside diameters.

For intervention applications, the tractor 100 saves time and money. Prior art intervention tools that utilize rotary drill strings are as much as 150% more expensive than the illustrated tractor 100 using coiled tubing equipment. In addition, the tractor 100 is more time-conservative, as the longer rig-up time associated with rotary equipment is avoided. The use of coiled tubing is particularly advantageous when operating perforation guns.

Figure 3:
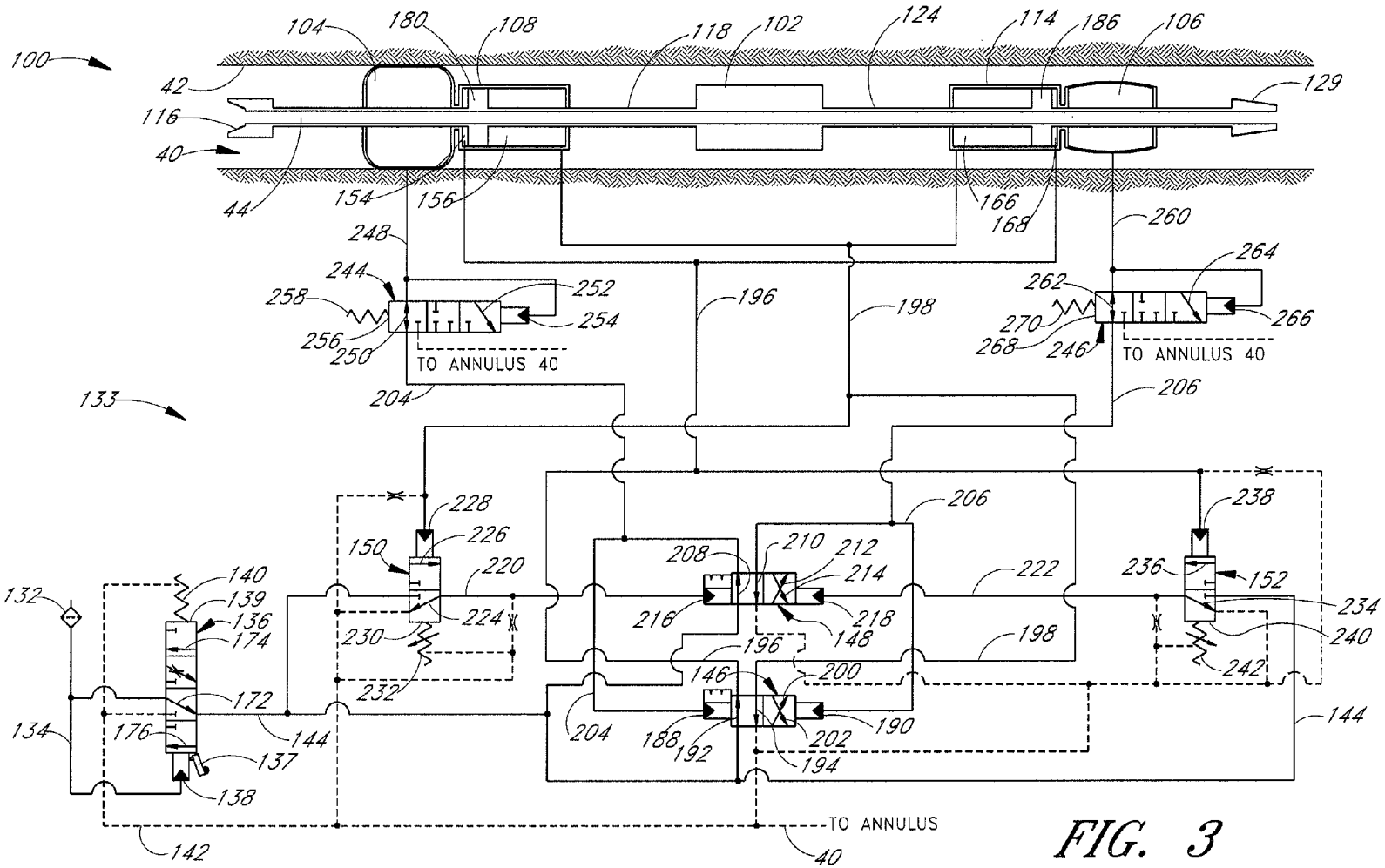
FIG. 3 is a schematic diagram illustrating a preferred configuration of the tractor and the valve system of the present invention.

FIG. 3 schematically illustrates a preferred configuration of the major components of the tractor 100. The tractor 100 includes an internal passage 44 extending from the aft end of the aft shaft 118 through the control assembly 102 to the forward end of the forward shaft 124. In use, pressurized operating fluid is pumped through the drill string into the internal passage 44. The operating fluid can be used for various applications to be undertaken by the downhole equipment, such as for powering perforation guns utilized for cutting holes in a casing wall of an oil well. The valve system 133 is configured to receive a portion of the operating fluid flowing through the internal passage 44.

FIG. 3 also schematically illustrates a preferred configuration of the valve system 133 of the tractor 100. The valve system 133 is housed within the control assembly 102 shown in FIG. 2. The valve system 133 selectively controls the flow of operating fluid to and from the gripper assemblies 104 and 106 and to and from the propulsion cylinders 108 and 114. The operation of the valve system 133 is described in detail below.

In the aft shaft assembly, the aft propulsion cylinder 108 is longitudinally slidably engaged with the aft shaft 118 and forms an internal annular chamber surrounding the shaft. An annular piston 180 resides within the annular chamber formed by the cylinder 108, and is at least longitudinally fixed to the shaft 118. The piston 180 fluidly divides the internal annular chamber formed by the cylinder 108 into an aft chamber 154 and a forward chamber 156. Preferably, the chambers 154 and 156 are fluidly sealed to substantially prevent fluid flow between the chambers or leakage to the annulus 40. The piston 180 is longitudinally slidable within the cylinder 108.

In the forward shaft assembly, the forward propulsion cylinder 114 is configured similarly to the aft propulsion cylinder 108. The cylinder 114 is longitudinally slidably engaged with the forward shaft 124. An annular piston 186 is at least longitudinally fixed to the shaft 124, and is enclosed within the cylinder 114. The piston 186 fluidly divides the internal annular chamber formed by the cylinder 114 into a rear chamber 166 and a front chamber 168. The piston 186 is longitudinally slidable within the cylinder 114.

Thus, the chambers 154, 156, 166, and 168 have varying volumes, depending upon the positions of the pistons 180 and 186 within the cylinders. It will be understood that the cylinders and pistons can have any of a variety of different shapes and sizes (including non-circular cross-sections), preferably keeping in mind the goals of providing an elongated thrust chamber for a suitable power stroke, as well as concerns of simplicity, prevention of leakage, ease of manufacturing, and compatibility with existing downhole tools.

Although one aft propulsion cylinder 108 and one forward propulsion cylinder 114 (along with a corresponding aft piston and forward piston) are shown in the illustrated embodiment, any number of aft cylinders and forward cylinders may be provided. The hydraulic thrust provided by the tractor increases as the number of propulsion cylinders increases. In other words, the hydraulic force provided by the cylinders is additive. Thus, the number of cylinders is selected according to the desired thrust. It will be understood that the number of cylinders may be limited by the capability of the gripper assemblies to transfer radial loads to the borehole wall. In other words, the thrust produced by the cylinders should not be so high as to cause the gripper assemblies to slip in their actuated positions. In a preferred embodiment, the cylinder outside diameter is 3.75 inches. In this embodiment, the gripper assemblies are designed to transmit a radial gripping force of approximately 6,500 pounds, and each piston is designed to produce a stall force of 8,835 pounds at 1500 psi. Thus, in this embodiment, only one aft and one forward cylinder are preferred. The load transmission capability of the gripper assemblies varies by design of the gripper assembly.

The tractor 100 is hydraulically powered by an operating fluid pumped down the drill string, such as brine, sea water, drilling mud, or hydraulic fluid. In a preferred embodiment, the same fluid that may operate downhole equipment 32 (FIG. 1) powers the tractor. This avoids the need to provide additional fluid channels in the tool for the fluid powering the tractor. Preferably, liquid brine or sea water is used in an open system. Alternatively, fluid may be used in a closed system, if desired. Referring to FIG. 1, in operation, operating fluid flows from the drill string 30 through the tractor 100 and down to the downhole equipment 32. Referring again to FIG. 3, a diffuser or filter 132 in the control assembly 102 diverts a portion of the operating fluid into the valve system 133 to power the tractor. Preferably, the diffuser 132 filters out larger fluid particles that can damage internal components of the valve system, such as the valve spools.

Preferred Configuration of Valve System

With reference to FIG. 3, a preferred embodiment of the valve system 133 includes an inlet or entry control valve 136, a propulsion control valve 146, a gripper control valve 148, an aft cycle valve 150, and a forward cycle valve 152. In addition, pressure reduction valves 244 and 246 are preferably provided to limit the fluid pressure in the gripper assemblies, as described in further detail below. The operation of each of these valves is discussed below.

Fluid diverted to the valve system 133 through the diffuser 132 enters an inlet galley 134 upstream of the inlet control valve 136. As used herein, the terms "galley," "chamber," and "passage" refer to regions of the tractor that are configured to contain operating fluid, and are not limited to any particular shape. Some of these regions are illustrated as flow paths or lines in FIG. 3.

The inlet control valve 136 is preferably a spool valve, a preferred embodiment of which is illustrated in FIGS. 4-8. The valve 136 serves as a gateway for fluid to flow into a main galley 144 of the valve system 133. The spool of the valve 136 has first, second, and third position ranges, the second range being interposed between the first and third ranges. In the first and third position ranges, the spool provides a flow path (represented try arrow 174 for the first position range and arrow 176 for the third position range) for fluid within the main galley 144 to flow through the valve 136 to the annulus 40 on the exterior of the tractor. Also, in the first and third position ranges, the spool prevents the flow of fluid from the inlet galley 134 through the valve 136 into the main galley 144. Thus, in the first and third position ranges of the inlet control valve spool, fluid exits the valve system 133 to render the tractor non-operational. In the second position range, the spool provides a flow path (represented by arrow 172) for fluid in the inlet galley 134 to flow into the main galley 144. In the second position range, the spool also prevents the flow of fluid from the main galley 144 through the valve 136 to the annulus 40. Thus, in the second position range of the inlet control valve spool, fluid enters the valve system 133 such that the tractor is operational. In FIG. 3, the spool of valve 136 is shown in its second position range. When shifted vertically downward in FIG. 3, the spool occupies its first position range. When shifted vertically upward in FIG. 3, the spool occupies its third position range.

The spool of the inlet control valve 136 has a first end or surface 139 biased by one or more springs 140 and a second end or surface 138 exposed to fluid in the inlet galley 134. In the illustrated embodiment, the spring 140 is also in fluid communication with the annulus 40, as indicated by the broken lines 142. The spring 140 imparts a spring force on the first end surface 139 that tends to push the spool toward its first position range. In the illustrated embodiment, fluid from the annulus 40 also imparts a pressure force onto the first end surface 139. The fluid in the galley 134 imparts a pressure force on the second surface 138 that tends to push the spool toward its third position range. Thus, the spring force and fluid pressure force on the first end surface 139 act against the fluid pressure force on the second surface 138. The differential fluid pressure in the inlet galley 134 required to move the spool from the first position range to the lower endpoint of the second position range (i.e., the position at which the valve opens a flow path between the galleys 134 and 144) depends upon the effective spring constant of the spring 140 and is defined as the lower shut-off threshold. Likewise, the differential fluid pressure required to move the spool from the second position range to the lower endpoint of the third position range (i.e., the position at which the valve closes the flow path between the galleys 134 and 144) also depends upon the effective spring constant of the spring 140 and is defined as the upper shut-off threshold. Unless otherwise indicated, as used herein, "differential pressure" or "pressure" at a particular location within the tractor refers to the difference between the pressure at that location and the pressure in the annulus 40. Advantageously, the inlet control valve 136 thus permits the fluid pressure within the valve system 133 to be limited to within a specific range. In a preferred embodiment, the lower shut-off threshold is 800 psid and the upper shut-off threshold is 2100 psid.

It will be understood that the spring 140 can bear against any suitable surface of the spool or any component having a fixed relationship with the spool. It will also be understood that the spring 140 can be configured to operate primarily in tension or primarily in compression, keeping in mind the goal of biasing the spool toward its first position.

In the preferred embodiment, discussed in greater detail below, the inlet control valve 136 includes a locking feature to lock the valve spool in its third position range and to thus prevent fluid from entering the valve system 133. The locking feature is schematically represented in FIG. 3 by a latch 137. The purpose and preferred configuration of the locking feature is discussed below.

The main galley 144 fluidly communicates with and provides incoming pressurized operating fluid to the propulsion control valve 146, the gripper control valve 148, the aft cycle valve 150, and the forward cycle valve 152. The propulsion control valve 146 is preferably a two-position spool valve. The spool of the valve 146 has a first position, shown in FIG. 3, in which the valve 146 provides a flow path (represented by arrow 192) for the flow of fluid from the main galley 144 into a chamber or passage 196. The chamber 196 leads from the valve 146 to the aft chamber 154 of the aft cylinder 108, and also to the forward chamber 168 of the forward cylinder 114. When the spool of the valve 146 is in its first position, the valve 146 also provides a flow path (represented by arrow 194) for the flow of fluid within a chamber or passage 198 to the annulus 40. The chamber 198 leads from the valve 146 to the forward chamber 156 of the aft cylinder 108, and also to the aft chamber 166 of the forward cylinder 114.

The spool of the propulsion control valve 146 also has a second position, shifted to the left in FIG. 3. When the spool of the valve 146 is in its second position, the valve 146 provides a flow path (represented by arrow 200) for the flow of fluid from the main galley 144 to the chamber 198. When the spool of the valve 146 is in its second position, the valve 146 also provides a flow path (represented by arrow 202) for the flow of fluid from the chamber 196 to the annulus 40.

With continued reference to FIG. 3, the spool of the propulsion control valve 146 has a first end surface 188 and a second end surface 190. The first end surface 188 is exposed to fluid within a chamber 204 that leads to the aft gripper assembly 104 (or, if present, to an aft pressure reduction valve 244). The second end surface 190 is exposed to fluid within a chamber 206 that leads to the forward gripper assembly 106 (or, if present, to a forward pressure reduction valve 246). The first and second end surfaces 188 and 190 are configured to receive respective fluid pressure forces that act against each other. The first end surface 188 receives a pressure force from the fluid in the chamber 204 that tends to move the spool of the valve 146 toward its first position, as shown in FIG. 3. The second end surface 190 receives a pressure force from the fluid in the chamber 206 that tends to move the spool toward its second position, which would be shifted to the left in FIG. 3. Preferably, the valve 146 includes detents (mechanical catches or restraints) for retaining the spool in its first and second positions until the pressure difference between the chambers 204 and 206 reaches a shifting threshold. In a preferred embodiment, the detents include resilient elements, such as springs, that interact with tapered surfaces of the spool landings, as described in further detail below and illustrated in FIG. 10. Alternatively, the detents may be conventional mechanical detents.

Like the propulsion control valve 146, the gripper control valve 148 is preferably a two-position spool valve. The spool of the valve 148 has a first position, shown in FIG. 3, in which the valve 148 provides a flow path (represented by arrow 208) for the flow of fluid from the main galley 144 into the chamber 204. When the spool of the valve 148 is in its first position, the valve 148 also provides a flow path (represented by arrow 210) for the flow of fluid within the chamber 206 to the annulus 40. The spool of the gripper control valve 148 also has a second position, not shown in FIG. 3. The second position is that which the spool would be in if it is shifted to the left in FIG. 3. When the spool of the valve 148 is in its second position, the valve 148 provides a flow path (represented by arrow 212) for the flow of fluid from the main galley 144 to the chamber 206. When the spool of the valve 148 is in its second position, the valve 148 also provides a flow path (represented by arrow 214) for the flow of fluid from the chamber 204 to the annulus 40.

The spool of the gripper control valve 148 has a first end surface 216 and a second end surface 218. The first end surface 216 is exposed to fluid within a chamber or passage 220 that leads to the aft cycle valve 150. The second end surface 218 is exposed to fluid within a chamber or passage 222 that leads to the forward cycle valve 152. The first and second end surfaces 216 and 218 are configured to receive respective fluid pressure forces that act against each other. The first end surface 216 receives a pressure force from the fluid in the chamber 220 that tends to move the spool of the valve 148 toward its first position, as shown in FIG. 3. The second end surface 218 receives a pressure force from the fluid in the chamber 222 that tends to move the spool toward its second position, which would be shifted to the left in FIG. 3. Preferably, the valve 148 includes detents for retaining the spool in its first and second positions until the pressure difference between the chambers 220 and 222 reaches a shifting threshold. In a preferred embodiment, the detents include resilient elements, such as springs, that interact with tapered surfaces of the spool landings. Alternatively, the detents may be conventional mechanical detents.

The aft cycle valve 150 is preferably a two-position spring-biased spool valve. The spool of the cycle valve 150 has a first position, shown in FIG. 3, in which the valve 150 provides a flow path (represented by arrow 224) for the flow of fluid from the chamber 220 to the annulus 40. The spool also has a second position, not shown in FIG. 3. The second position is that which the spool would be in if it is shifted vertically downward in FIG. 3. When the spool of the cycle valve 150 is in its second position, the valve 150 provides a flow path (represented by arrow 226) for the flow of fluid from the main galley 144 to the chamber 220.

The spool of the cycle valve 150 has an end surface 228 exposed to fluid in the chamber 198. The fluid in the chamber 198 imparts a pressure force onto the end surface 228, which tends to move the spool toward its second position. An opposite end surface 230 of the spool is biased by one or more springs 232. In the illustrated embodiment, the end surface 230 is also in fluid communication with fluid in the annulus 40. The spring 232 imparts a spring force onto the spool, which tends to move the spool to its first position. Thus, the fluid pressure force on the end surface 228 and the spring force on the end surface 230 act against each other. When the differential fluid pressure in the chamber 198 is below a threshold, the fluid pressure force is less than the spring force and the spool occupies its first position. When the differential fluid pressure in the chamber 198 exceeds the threshold, the fluid pressure force exceeds the spring force and the spool moves to its second position. Any desired threshold can be achieved by careful selection of the spring 232. It will be understood that the spring 232 can bear against any suitable surface of the spool or any component having a fixed relationship with the spool. It will also be understood that the spring 232 can be configured to operate primarily in tension or primarily in compression, keeping in mind the goal of biasing the spool toward its first position.

The forward cycle valve 152 is preferably configured similarly to the aft cycle valve 150. The valve 152 is preferably a two-position spring-biased spool valve. The spool of the cycle valve 152 has a first position, shown in FIG. 3, in which the valve 152 provides a flow path (represented by arrow 234) for the flow of fluid from the chamber 222 to the annulus 40. The spool also has a second position, not shown in FIG. 3. The second position is that which the spool would be in if it is shifted vertically downward in FIG. 3. When the spool of the cycle valve 152 is in its second position, the valve 152 provides a flow path (represented by arrow 236) for the flow of fluid from the main galley 144 to the chamber 222.

The spool of the cycle valve 152 has an end surface 238 exposed to fluid in the chamber 196. The fluid in the chamber 196 imparts a pressure force onto the end surface 238, which tends to move the spool toward its second position. An opposite end surface 240 of the spool is biased by one or more springs 242. In the illustrated embodiment, the end surface 240 is also in fluid communication with fluid in the annulus 40. The spring 242 imparts a spring force onto the end surface 240, which tends to move the spool to its first position. Thus, the fluid pressure force on the end surface 238 and the spring force on the end surface 240 act against each other. When the differential fluid pressure in the chamber 196 is below a threshold, the fluid pressure force is less than the spring force and the spool occupies its first position. When the differential fluid pressure in the chamber 196 exceeds the threshold, the fluid pressure force exceeds the spring force and the spool moves to its second position. Any desired threshold can be achieved by careful selection of the spring 242. It will be understood that the spring 242 can bear against any suitable surface of the spool or any component having a fixed relationship with the spool. It will also be understood that the spring 242 can be configured to operate primarily in tension or primarily in compression, keeping in mind the goal of biasing the spool toward its first position.

The gripper control valve 148 acts as a pilot for the propulsion control valve 146, which would stall without this pilot. The pilot action of valve 148 improves the operation of valve 146 since the operation of valve 146 controls the pressure signal to the cycle valves 150 and 152. Without the gripper control valve 148 to isolate the valve 146 from the cycle valves 150 and 152, the valve 146 would stall or oscillate. For example, consider a configuration in which the valve 146 controls fluid flow to the passages 196, 198, 204, and 206 (which is not the case in the illustrated embodiment), and in which the valve 148 is eliminated. In a worst-case scenario, the system would operate as follows. When the piston 180 reaches the end of its stroke, rising pressure in the passage 196 would "open" the valve 152 (i.e., would cause the valve 152 to shift to its second position, downward in FIG. 3). This would cause a pressure rise in the passage 222, causing the spool of valve 146 to shift toward the left position (in FIG. 3). As the flow path 192 begins to close, the pressure in passage 196 would decrease, causing the cycle valve 152 to close. The high pressure force on the end surface 190 of the spool of the valve 146 would be lost. Without a pressure force on the surface 190, the spool of the valve 146 would not be able to finish the shift and would either stall in a partially shifted position or return to the first position (i.e., to the right in FIG. 3). If the spool of the valve 146 returns to its first position, the pressure signal would be restored to the cycle valve 152, which would again shift to provide a pressure signal to the spool of the valve 146. The spool would again start to shift. This cycle would continue without the spool of the valve 146 ever completing a full shift. In the illustrated embodiment of the valve system 133, the gripper control valve 148 ensures that the spool of the propulsion control valve 146 completes each of its shifts. A complete sequence of operation is described below.

As shown in FIG. 3, the valve system 133 preferably includes two pressure reduction valves 244 and 246. The pressure reduction valves limit the pressure of the fluid in the gripper assemblies, and thus provide a means for preventing possible failure of the gripper assembly components.

The aft pressure reduction valve 244 preferably comprises a spool valve. In a first position of the spool, shown in FIG. 3, the valve 244 provides a flow path (represented by arrow 250) for the flow of fluid within the chamber 204 to a chamber or passage 248 that leads to the aft gripper assembly 104. The valve spool is designed to be in its first position when the gripper assembly 104 is being purposefully actuated or retracted according to the operational cycle of the valve system 133. A second position of the spool is that in which the spool is shifted partially to the left in FIG. 3. In the second position of the spool, the valve 244 blocks communication between the chambers 204 and 248. The valve spool is designed to be in its second position when the gripper assembly 104 is actuated during the normal operational cycle of the valve system 133. The second position of the spool prevents fluid from exiting the gripper assembly 104.

A third position of the spool of the pressure reduction valve 244 is that in which the spool is shifted further to the left. In the third position, the valve 244 provides a flow path (represented by arrow 252) for the flow of fluid within the chamber 248 to the annulus 40. In the preferred embodiment, the valve spool is designed to shift to the third position when the toes 612 (see FIG. 21) of the preferred gripper assembly experience external forces, such as sliding friction between the toes and the borehole surface. These external forces can cause over-pressurization of the fluid in the gripper assembly 104.

The third position of the spool of the valve 244 allows the excess pressure to bleed to the annulus 40. The spool has a surface 254 exposed to fluid within the chamber 248, and an opposing surface 256 biased by one or more springs 258. Fluid within the chamber 248 imparts a fluid pressure force onto the surface 254, which tends to move the spool toward its third position. The spring 258 exerts a spring force that counteracts the fluid pressure force and tends to move the spool toward its first position. When the pressure in the chamber 248 exceeds a threshold determined by the spring 258, the spool shifts to its third position. Thus, the valve 244 imposes an upper limit on the pressure in the passage 248 and thereby prevents over-pressurization of the aft gripper assembly 104 by bleeding excess pressure to the annulus 40.

It will be understood that the spring 258 can bear against any suitable surface of the spool or any component having a fixed relationship with the spool. It will also be understood that the spring 258 can be configured to operate primarily in tension or primarily in compression, keeping in mind the goal of biasing the spool toward its first position.

The forward pressure reduction valve 246 is preferably configured similarly to the aft pressure reduction valve 244. The forward pressure reduction valve 246 preferably comprises a spool valve. In a first position of the spool, shown in FIG. 3, the valve 246 provides a flow path (represented by arrow 262) for the flow of fluid within the chamber 206 to a chamber or passage 260 that leads to the forward gripper assembly 106. The valve spool is designed to be in its first position when the gripper assembly 106 is being purposefully actuated or retracted according to the operational cycle of the valve system 133. A second position of the spool is that in which the spool is shifted partially to the left in FIG. 3. In the second position of the spool, the valve 246 blocks communication between the chambers 206 and 260. The valve spool is designed to be in its second position when the gripper assembly 106 is actuated during the normal operational cycle of the valve system 133. The second position of the spool prevents fluid from exiting the gripper assembly 106.

A third position of the spool of the pressure reduction valve 246 is that in which the spool is shifted further to the left. In the third position, the valve 246 provides a flow path (represented by arrow 264) for the flow of fluid within the chamber 260 to the annulus 40. In the preferred embodiment, the valve spool is designed to shift to the third position when the toes 612 (see FIG. 21) of the preferred gripper assembly experience external forces, such as sliding friction between the toes and the borehole surface. These external forces can cause over-pressurization of the fluid in the gripper assembly 106. The third position of the spool of the valve 246 allows the excess pressure to bleed to the annulus 40. The spool has a surface 266 exposed to fluid within the chamber 206, and an opposing surface 268 biased by one or more springs 270. Fluid within the chamber 260 imparts a fluid pressure force onto the surface 266, which tends to move the spool toward its third position. The spring 270 exerts a spring force that counteracts the fluid pressure force and tends to move the spool toward its first position. When the pressure in the chamber 260 exceeds a threshold determined by the spring 270, the spool shifts to its third position. Thus, the valve 246 imposes an upper limit on the pressure in the passage 260 and thereby prevents over-pressurization of the forward gripper assembly 106 by bleeding excess pressure to the annulus 40.

It will be understood that the spring 270 can bear against any suitable surface of the spool or any component having a fixed relationship with the spool. It will also be understood that the spring 270 can be configured to operate primarily in tension or primarily in compression, keeping in mind the goal of biasing the spool toward its first position.

It will also be understood that some of the illustrated valves of the valve system 133 can be combined to provide a more condensed configuration of the valve system. The valves can be formed from various different materials, but are preferably made of a hard erosion-resistant material such as Tungsten Carbide, Ferrotic (a proprietary metal formulation), or possibly a ceramic blend.

Valve System Operation

With reference to FIG. 3, when the inlet control valve 136 is open, i.e., in its second position range, pressurized operating fluid flows from the inlet galley 134 to the main galley 144 of the valve system 133. With the valves in the positions shown in FIG. 3, the pressurized operating fluid in the main galley 144 flows through the gripper control valve 148, the chamber 204, the aft pressure reduction valve 244, the chamber 248 (which extends through the aft shaft 118), and into the aft gripper assembly 104. Thus, the aft gripper assembly 104 becomes actuated and grips onto the borehole surface 42. At the same time, fluid within the forward gripper assembly 106 flows through the chamber 260 (which extends through the forward shaft 124), the forward pressure reduction valve, the chamber 206, the gripper control valve, and into the annulus 40. Thus, the forward gripper assembly 106 becomes retracted from the borehole surface 42.

With the aft gripper assembly 104 actuated and the forward gripper assembly 106 retracted, pressurized fluid within the main galley 144 flows through the propulsion control valve 146, the chamber 196 (which extends through both shafts), and into the aft chamber 154 of the aft cylinders 108, as well as into the forward chamber 168 of the forward cylinder 114. Simultaneously, fluid within the forward chamber 156 of the aft cylinder 108, as well as fluid within the aft chambers 166 of the forward cylinder 114, flows through the chamber 198 (which extends through both shafts) and the propulsion control valve 146 into the annulus 40. This causes the aft piston 180, and thus the entire tractor body, to be thrust forward (to the right in FIG. 3) with respect to the actuated aft gripper assembly 104. In other words, the aft cylinder 108 performs a power stroke. Simultaneously, the forward cylinder 114 is thrust forward with respect to the piston 186 and the tractor body. In other words, the forward cylinder 114 performs a reset stroke.

During the above strokes of the cylinders, note that the fluid within the chamber 204 is pressurized and the fluid within the chamber 206 is depressurized. Thus, the fluid pressure force acting on the first end surface 188 of the spool of the propulsion control valve 146 is significantly larger than the fluid pressure force acting on the second end surface 190 of the spool. As a result, the spool of the valve 146 is maintained in its first position (the position shown in FIG. 3).

Also, during the above strokes of the cylinders, the cycle valves 150 and 152 remain in their first positions (the positions shown in FIG. 3). Since there is flow into the valve system 133 filling the cylinders, there is a pressure drop from the full system pressure available in the central passage 44. This decrease in pressure maintains the cycle valves in their first positions. Thus, the chambers 220 and 222 remain in fluid communication with the annulus 40. In this state, the fluid pressure forces on the end surfaces 216 and 218 of the spool of the gripper control valve 148 are approximately equal (the pressure within the annulus 40 may vary depending upon position). Hence, the gripper control valve 148 will remain in the position shown in FIG. 3, particularly since the detents (described below) require a threshold force to shift the valve spool.

When the cylinders complete their respective strokes, the fluid pressure in the chamber 196 will begin to rise. In contrast to when the cylinders are still stroking, the incoming flow of fluid into the system is halted. As a result, the pressure in the tractor valve system 133 will rise to the full pressure available in the center passage 44. When the pressure in the chamber 196 exceeds a threshold associated with the spring(s) 242 of the forward cycle valve 152, the spool of the valve 152 will shift to its second position (downward in FIG. 3), permitting pressurized fluid from the main galley 144 to enter the chamber 222. At this point, the spool of the aft cycle valve 150 is still in its first position, due to the low pressure in chamber 198. Due to the pressure imbalance on the end surfaces 216 and 218, the spool of the gripper control valve 148 overcomes the retaining forces of the detents and shifts to its second position (to the left in FIG. 3). As a result, pressurized fluid within the galley 144 flows through the gripper control valve 148, the chamber 206, the forward pressure reduction valve 246, the chamber 260, into the forward gripper assembly 106. This causes the forward gripper assembly to actuate and grip onto the borehole surface 42. Simultaneously, fluid within the aft gripper assembly 104 flows through the chamber 248, the aft pressure reduction valve 244, the chamber 204, the gripper control valve 148, into the annulus 40. This causes the aft gripper assembly to retract from the borehole surface 42. Thus, when the gripper control valve 148 switches positions, both gripper assemblies switch between their actuated and retracted positions.

After the gripper control valve 148 switches its position, the fluid within the chamber 204 becomes depressurized and the fluid within the chamber 206 becomes pressurized. The resulting pressure imbalance on the end surfaces 188 and 190 causes the spool of the propulsion control valve 146 to overcome the retaining forces of its detents and shift to its second position (to the left in FIG. 3). This happens when the flow of fluid into the valve system 133 stops, which occurs when the gripper assembly has come into contact with the borehole wall. When the flow stops, there is no longer a pressure drop (due to flow), and the pressure will rise to full system pressure. As a result of the shifting of the spool of the valve 146, pressurized fluid within the main galley 144 flows through the propulsion control valve 146, the chamber 198, and into the forward chamber 156 of the aft cylinder 108 and the aft chamber 166 of the forward cylinder 114. Simultaneously, fluid within the aft chamber 154 of the aft cylinder 108, as well as fluid within the forward chamber 168 of the forward cylinder 114, flows through the chamber 196 and the propulsion control valve 146 into the annulus 40. This causes the forward piston 186, and thus the entire tractor body, to be thrust forward (to the right in FIG. 3) with respect to the actuated forward gripper assembly 106. In other words, the forward cylinder 114 performs a power stroke. Simultaneously, the aft cylinder 108 is thrust forward with respect to the piston 180 and the tractor body. In other words, the aft cylinder 108 performs a reset stroke. The depressurization of the chamber 196 causes the spool of the forward cycle valve 152 to shift back to its first position (the position shown in FIG. 3).

During the above strokes of the cylinders, the fluid within the chamber 206 is pressurized and the fluid within the chamber 204 is depressurized. Thus, the fluid pressure force acting on the second end surface 190 of the spool of the propulsion control valve 146 is significantly larger than the fluid pressure force acting on the first end surface 188 of the spool. As a result, the spool of the valve 146 is maintained in its second position (shifted to the left in FIG. 3).

Also, during the above strokes of the cylinders, with the cycle valves 150 and 152 in their first positions (the positions shown in FIG. 3), the chambers 220 and 222 are in fluid communication with the annulus 40. In this state, the fluid pressure forces on the end surfaces 216 and 218 of the spool of the gripper control valve 148 are again equal. Hence, the gripper control valve 148 will remain in its position, particularly since the detents (described below) require a threshold force to shift the valve spool.

When the cylinders complete their respective strokes, the fluid pressure in the chamber 198 will begin to rise. When the pressure in the chamber 198 exceeds a threshold associated with the spring(s) 232 of the aft cycle valve 150, the spool of the valve 150 will shift to its second position (downward in FIG. 3), permitting pressurized fluid from the main galley 144 to enter the chamber 220. At this point, the spool of the forward cycle valve 152 is still in its first position, due to the low pressure in chamber 196. Due to the pressure imbalance on the end surfaces 216 and 218, the spool of the gripper control valve 148 overcomes the retaining forces of the detents and shifts back to its first position (the position shown in FIG. 3). As a result, pressurized fluid flows from the galley 144 through the gripper control valve 148, the chamber 204, the aft pressure reduction valve 244, the chamber 248, into the aft gripper assembly 104. This causes the aft gripper assembly to actuate. Simultaneously, fluid within the forward gripper assembly 106 flows through the chamber 260, the forward pressure reduction valve 246, the chamber 206, the gripper control valve 148, into the annulus 40. This causes the forward gripper assembly 106 to retract.

After the gripper control valve 148 switches its position, the fluid within the chamber 204 again becomes pressurized and the fluid within the chamber 206 again becomes depressurized. The resulting pressure imbalance on the end surfaces 188 and 190 causes the spool of the propulsion control valve 146 to overcome the retaining forces of its detents and shift back to its first position (the position shown in FIG. 3). With the valve 146 back in its first position, pressurized fluid again flows into the aft chamber 154 of the aft cylinder 108, and into the forward chamber 168 of the forward cylinder 114. Simultaneously, fluid within the forward chamber 156 of the aft cylinder 108, as well as fluid within the aft chamber 166 of the forward cylinder 114, flows into the annulus 40. This causes the aft cylinder 108 to perform a new power stroke. Simultaneously, the forward cylinder 110 performs a new reset stroke. The depressurization of the chamber 198 causes the spool of the aft cycle valve 150 to shift back to its first position (the position shown in FIG. 3).

At this point, all of the valves have returned back to their original positions (the positions shown in FIG. 3). Thus, the above describes a complete cycle of operation of the valve system during forward motion. Note that during forward (or backward) motion, the gripper assemblies shuttle between two extreme positions: First, the gripper assemblies move as far apart as possible toward opposite ends of the tractor. Second, the gripper assemblies move as close together as possible (with the propulsion cylinders and control assembly between them). During most of the operation of the tractor, one gripper assembly is in a power stroke while the other is in a reset stroke. When they switch directions they also switch gripper action. Hence, the tractor continually moves in one longitudinal direction.

A significant advantage of the preferred configuration of the valve system 133 is that the cylinders are assured of completing their respective strokes before the gripper assemblies are switched between their actuated and retracted positions. This result is achieved by (1) the provision of separate valves for controlling the flow of fluid to the gripper assemblies and to the propulsion cylinders (in the illustrated embodiment, these are the propulsion control valve 146 and the gripper control valve 148), and (2) piloting the gripper control valve by cycle valves that are themselves piloted by the pressure in the cylinders. This ensures that the cycle valves will open only when the pressure in the cylinders increases significantly, which in turn will occur only when the cylinders complete their strokes or when the tractor is stalled by an overload.

In a preferred embodiment, the valve system 133 requires an incoming flow of operating fluid of about 16 gallons per minute. Typically, large positive displacement pumps are utilized at the ground surface to pump fluid down the coiled tubing and through the internal passage 44 of the tractor. Such pumps usually supply a flow rate of about 80 to 120 gpm. Thus, since the valve system only requires a relatively small portion of the flow, the operation of the tractor has little effect on the pressure in the passage 44. This makes the system more stable. Preferably, an orifice is provided downstream of the tractor. The orifice is designed to provide the desired back pressure (which the tractor utilizes to push/pull a specified load) at a predetermined flow rate within the passage 44.

The speed of the tractor is determined by the pressure and flow rate of fluid pumped through the coiled tubing, as well as the loads experienced by the tractor. The pressure and flow rate of the fluid in the coiled tubing, which are substantially controlled by the actions of surface equipment operators, together determine the amount of hydraulic energy available in the tractor. The loads experienced by the tractor include the weight of equipment (such as the equipment 32 shown in FIG. 1) pushed and pulled by the tractor, tension in the coiled tubing from the surface, frictional drag forces between the coiled tubing and the borehole, etc. The surface operators also control the injector and coiled tubing reel and thus the feed rate of the coiled tubing into the borehole.

Because the valve system 133 is all-hydraulic, its maximum speed is greater than an electrically controlled tractor. The valve system does not include electrical conductors and other electrical elements, which allows for larger internal fluid passages, greater flow rates, and improved power density. The faster maximum speed of the tractor results in lower operational costs, especially for intervention applications. In a preferred embodiment of the invention, the tractor is capable of moving at speeds greater than or equal to 1350 feet per hour.

Control Assembly

According to the preferred embodiment, the tractor 100 includes a control assembly 102 which houses the valve system 133 described above. One embodiment of the control assembly 102 is shown partially disassembled in FIG. 4. The illustrated control assembly includes a control housing 280, an aft transition housing 282, and a forward transition housing 284.

Figure 4:
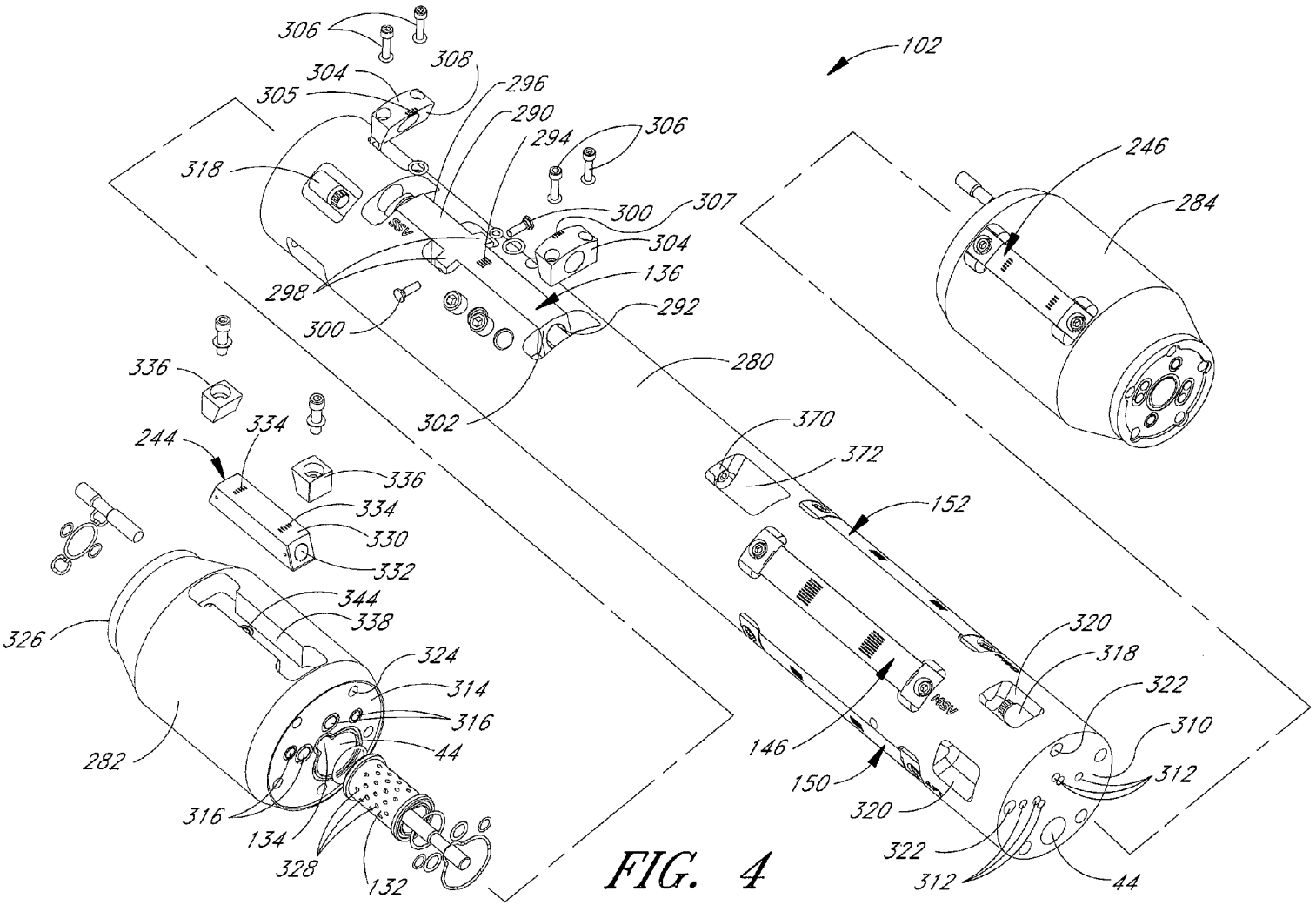
FIG. 4 is a front perspective view of the control assembly of the tractor of FIG. 2, shown partially disassembled.

The control housing 280 houses the inlet control valve 136, the propulsion control valve 146, the gripper control valve 148 (not visible, as it is located on the backside of the view of FIG. 4), and the cycle valves 150 and 152. Each valve includes an elongated valve housing defining a spool passage, and a spool. The valves are positioned within recesses in the outer surface of the control housing 280.

For example, the inlet control valve 136 includes a housing 290 having a spool passage 292 sized to receive a spool. The valve housing 290 also has an external vent 294 configured to vent operating fluid into the annulus 40 between the tractor and the borehole surface. The housing 290 is positioned within a recess 296 in the outer surface of the control housing 280. In contrast to the housings of the other valves, the inlet control valve housing 290 includes two pin receiving side portions 298 configured to receive pins or slot engagement portions 300, for purposes described below. The ends of the housing 290 are slightly inclined from the radial direction, such that the housing has a trapezoidal axial cross-section. Two valve housing clamp elements 304 are secured into the recess 296 at each end of the valve housing 290 by bolts 306. The clamp elements have surfaces 308 that mate closely with the inclined surfaces 302 of the valve housing 290, thus securing the valve housing rigidly onto the control housing 280. The aft clamp element has a vent 305, and the forward clamp element has a vent 307. The inner configuration of the valve housing 290 and the spool of the inlet control valve 136 are described below.

The propulsion control valve 146, gripper control valve 148, and cycle valves 150 and 152 are configured somewhat similarly to the inlet control valve 136. Specifically, the valve housings of the valves 146, 148, 150, and 152 are include similarly configured spool passages and vents and are secured to the control housing 280 in similar fashion. In the illustrated embodiment, the housings of the valves 146, 148, 150, and 152 include two vents as opposed to one. Also, each of the clamp elements for the valves 146, 148, 150, and 152 receives a single bolt as opposed to two bolts.

The control housing 280 includes numerous internal fluid passages for the controlled flow of operating fluid to the downhole equipment 32 (FIG. 1), between the valves, to the gripper assemblies, and to the propulsion cylinders. The fluid passages are configured to effect the hydraulic circuit shown in FIG. 3. Some of the fluid passages extend to openings 312 in the end surfaces 310 of the control housing 280, where they connect to openings of corresponding fluid passages in the end surfaces 316 of the transition housings 282 and 284. Some of these fluid passages extend through the shafts 118 and 124 (FIG. 2) to the gripper assemblies, the propulsion cylinders, or to downhole equipment connected to the tractor. As in the EST, within the housing 280 the internal passage 44 is shifted to one side (i.e., it is not in the center of the housing), to maximize available space for the various valves and internal fluid passages. Also, if liquid brine is used as the operating fluid, the passage 44 is not required to be as large as in the EST design, further maximizing the available space.

The control housing 280 is bolted to the transition housings 282 and 284 by a plurality of studs 318 and nuts 319. The studs extend though holes 322 in the end surfaces 310 of the housing 280 into holes 324 in the end surfaces 314 of the transition housings. Recesses 320 are provided in the outer surfaces of the housing 280, which facilitate access to the studs 318. In the illustrated embodiment, five studs 318 are provided in the end surfaces of the housing 280 and the transition housings.

The aft transition housing 282 houses the diffuser 132 and the aft pressure reduction valve 244. The aft end 326 of the housing 282 receives the internal passage 44 from the aft shaft 118 at the center axis of the tractor. Within the housing 282, the passage 44 transitions toward one side of the housing. Thus, the housing 282 moves the passage 44 to one side to maximize space for the valves and various fluid passages within the control housing 280. The diffuser 132 is positioned on the forward end 314 of the housing 282. As in the EST, the diffuser 132 is generally cylindrical and has a plurality of side holes 328 for directing the flow from the passage 44 into the inlet galley 134 of the inlet control valve 136. In one embodiment, the side holes 328 are angled so that the fluid passing forward through the diffuser must turn somewhat aftward to enter the inlet galley 134. This prevents larger particles within the operating fluid from entering the valve system 133, as it is more difficult for the larger particles to overcome forward momentum and flow through the side holes 328. Those of ordinary skill in the art will understand that any of a variety of different types of filters can be used instead of the illustrated diffuser 132.

The aft pressure reduction valve 244 includes a valve housing 330. The valve housing 330 is configured similarly to the housings of the valves within the control housing 280. Specifically, the valve housing 330 includes a similarly configured spool passage 332 and vents 334. In the illustrated embodiment, the valve housing 330 includes two vents 334. Also, the valve housing 330 is secured into a recess 338 of the aft transition housing 282 by the use of clamp elements 336, in similar fashion as the aforementioned valve housings are secured to the control housing 280. The recess 338 includes several openings 344. The openings 344 comprise ends of fluid passages that conduct fluid to and from corresponding side passages in the valve housing 330 of the valve 244 (such as the side passages 477 and 479 shown in FIG. 13), as described in further detail below. It will be understood that the corresponding recesses for all of the valve housings of the housings 280 and 284 (such as the recess 296 of the inlet control valve 136) have openings of fluid passages that communicate flow through the valves.

The forward transition housing 284 is configured generally similarly to the aft transition housing 282. One difference is that the aft housing 282 is configured to accommodate the diffuser 132 and has a fluid passage for the inlet galley 134, whereas the forward housing 284 does not require these features. Also, the forward housing 284 transitions the internal passage 44 back to the center axis of the tractor.

Figure 5:
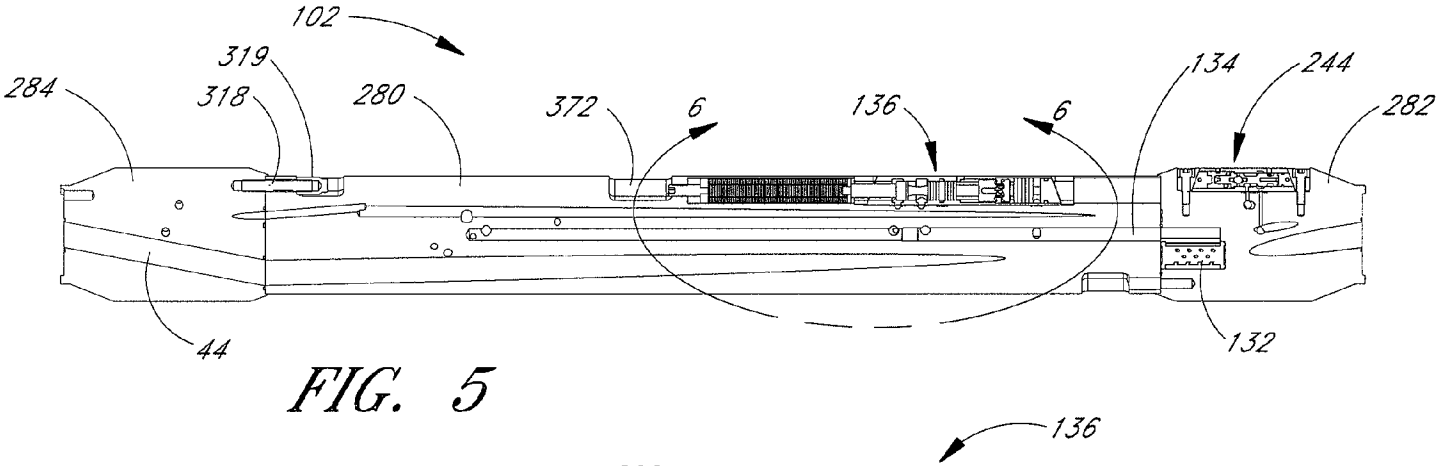
FIG. 5 is a longitudinal sectional view of the control assembly of FIG. 4, illustrating the inlet control valve of the tractor.

FIG. 5 shows a longitudinal cross-section of the assembled control assembly 102 of FIG. 4, with the aft end on the right and the forward end on the left. This particular section shows the configuration of the inlet control valve 136. Also shown in FIG. 5 are several internal fluid passages, which comprise some of the flow lines, chambers, passages, and galleys schematically illustrated in FIG. 3. One of skill in the art will understand that the internal fluid passages can have any of a large variety of configurations.

Inlet Control Valve

Figure 6:
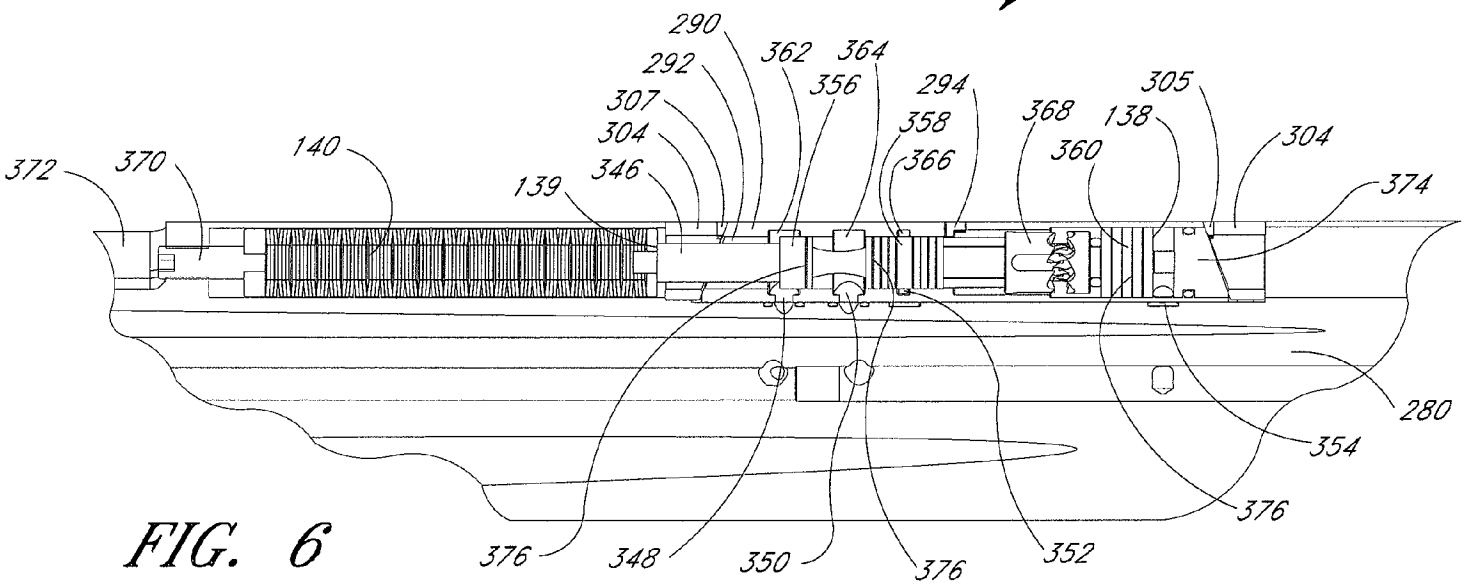
FIG. 6 is an exploded view of the inlet control valve shown in FIG. 5.

FIG. 6 is an exploded view of the inlet control valve 136 shown in FIG. 5, which includes the valve housing 290, an elongated spool 346, and a set of springs 140 biasing the spool to the right of the figure. The valve housing 290 defines an elongated generally cylindrical spool passage 292 that receives the spool 346. The inner surface of the passage 292 has annular recesses 362, 364, and 366 (commonly referred to as "galleys"), in which the passage has a slightly enlarged inner diameter. The valve housing 290 also includes side passages or fluid ports 348, 350, 352, and 354 that are open to the spool passage 292. When the valve housing 290 is secured onto the control housing 280, these ports align with openings of fluid passages in the housing 280. The ports 348 and 352 are in fluid communication with the main galley 144 of the valve system 133. The ports 350 and 354 are in fluid communication with the inlet control galley 134. The ports 348, 350, and 352 are located within the annular recesses 362, 364, and 366, respectively. The port 354 is located aftward of the second end surface 138 of the spool 346. The port 354 permits fluid within the inlet galley 134 to impart a pressure force against the end surface 138, which tends to move the spool 346 toward its second and third position ranges (to the left in FIG. 6). The housing 290 further includes the aforementioned vents 294, 305, and 307. The port 305 is non-functional in this configuration. It exists only because it is desirable to have identical designs for the clamp elements 304, and because a vent is desired within the forward clamp element. On the aft end of the valve housing 290, a plug 374 and an O-ring seal are provided to prevent fluid on the second end surface 138 of the spool 346 from flowing out to the annulus 40 through the vent 305.

As described above, the first end surface 139 of the spool 346 is in contact with a set of springs 140 that bias the spool 346 aftward, or to the right in FIG. 6. In a preferred embodiment, Belleville springs are stacked in 30 sets in series, each set containing three springs in parallel. This configuration provides a desired spring rate and resultant deflection. The spool 346 has three "landings" 356, 358, and 360. These landings comprise larger diameter portions that effect a fluid seal of the spool passage 292, as known in the art. In other words, each landing slides within the passage and prevents fluid on one side of the landing from flowing to the other side of the landing. The spool 346 also includes a locking feature to lock the spool in its third position range, in which the inlet control valve 136 is closed at high pressure. In the illustrated embodiment, the locking feature comprises a deactivation cam 368, described in further detail below.

As explained above, the spool 346 has first, second, and third position ranges. In the first and third ranges, the inlet control valve 136 provides a flow path for fluid from the main galley 144 of the valve system to vent into the annulus 40, and prevents fluid within the inlet galley 134 from flowing through the valve 136 into the main galley 144. In the second range, the valve 136 provides a flow path for fluid within the inlet galley 134 to flow into the main galley 144, and prevents fluid within the main galley 144 from flowing through the valve 136 into the annulus 40.

In FIG. 6, the spool 346 is shown in its first position range, shifted to the right. In this position, fluid from the main galley 144 flows through the fluid port 348, past the forward end of the landing 356, through the spool passage 292, and out to the annulus 40 through the vent 307. The spool 346 occupies this position when the pressure in the inlet galley 134 is below a lower shut-off threshold (e.g., 800 psid). As the pressure in the galley 134 rises, the fluid pressure force acting on the second end surface 138 of the spool 346 increases and pushes the spool to the left in FIG. 6, until the fluid pressure force is equalized by the spring force from the springs 140. When the pressure in the inlet galley 134 exceeds the lower shut-off threshold, the spool 346 moves to the left in FIG. 6 until it occupies a position within its second range. In this position, the landing 356 blocks flow between the port 348 and the vent 307, and permits flow between the ports 348 and 350. Fluid now flows from the inlet control galley 134 through the port 350, the spool passage 292, the port 348, and into the main galley 144. Fluid within the galley 144 is prevented from flowing through the valve 136 into the annulus 40. When the pressure in the inlet galley 134 exceeds an upper shut-off threshold (e.g., 2100 psid), the spool 346 moves further left in FIG. 6 until it occupies a position within its third range. In this position, the landing 358 blocks flow through the port 350 but permits flow between the port 352 and the vent 294. Fluid flows from the main galley 144 through the port 352, the spool passage 292, the vent 294, into the annulus 40.

A spring adjustment screw 370 is preferably provided to adjust the compression of the springs 140. In the illustrated embodiment, the screw 370 is accessible via a recess 372 in the control housing 280, which is also shown in FIG. 4. Adjustment of the screw 370 permits the shut-off threshold pressures of the inlet control valve 136 to be adjusted.

As shown in FIG. 6, the landings 356, 358, and 360 include "centering grooves" 376. The grooves 376 comprise circumferential grooves oriented generally perpendicular to the spool passage 292. The grooves 376 reduce leakage across the landings by providing a series of expansions and contractions in the leak path. Also, the grooves effectively equalize pressure around the circumference of the landing. During operation, fluid within the valve tends to push the spool against the side of the spool passage. By equalizing the pressure around the landings, the centering grooves cause the spool to remain more accurately centered within the spool passage. As a result, less energy is required to move the spool, and the valve operates more efficiently and reliably. Further, the centering function reduces leakage. The concentric relationship between the landings and the spool passage minimizes the largest width of the leak path. The grooves 376 also provide a region for small particles to deposit, which further prevents jamming of the spool within the spool passage. Any number of centering grooves can be provided on each of the landings of the spool 346. In the preferred embodiment, the grooves have a depth between 0.010 and 0.030 inches, and a width between 0.010 and 0.020 inches.

Figure 7:
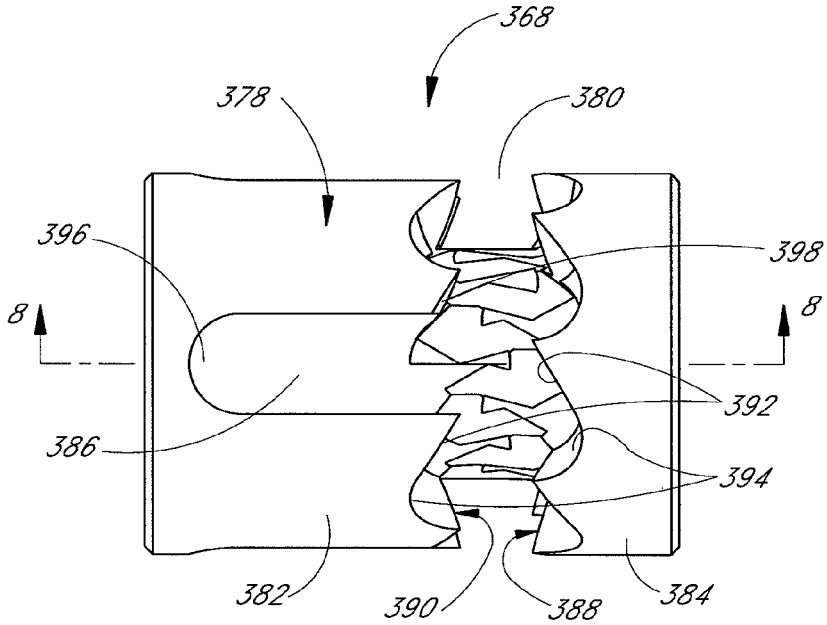
FIG. 7 is an exploded view of the deactivation cam shown in FIG. 6.
Figure 8:
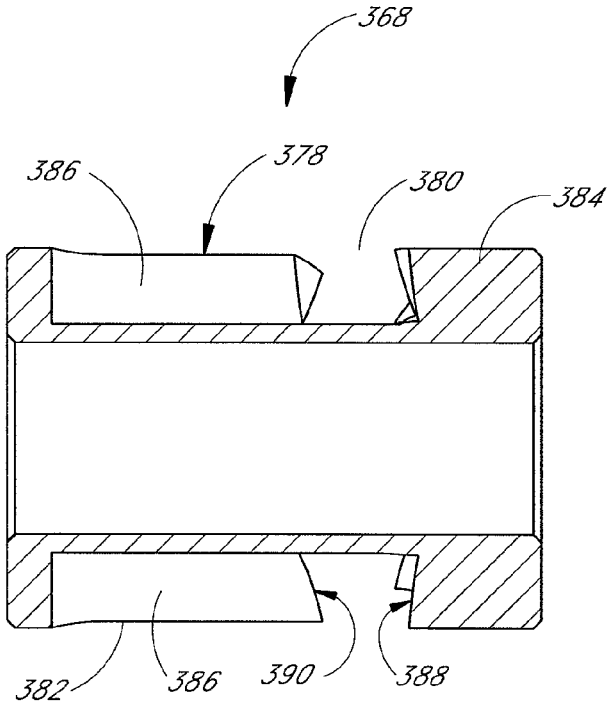
FIG. 8 is a longitudinal sectional view of the deactivation cam of FIG. 7.

FIGS. 7 and 8 further illustrate the deactivation cam 368 of the spool 346 of the inlet control valve 136. The cam 368 forms a portion of the spool 346 and is preferably axially fixed, but rotationally free, with respect to the remainder of the spool. The cam 368 comprises a large diameter portion 378 having a first portion 382 and a second portion 384 separated by an annular cam path recess 380. The peripheral surface of the first portion 382 includes at least one slot 386 oriented parallel to the spool passage 292 and extending into the recess 380. In the preferred embodiment, four slots 386 are provided in the peripheral surface of the first portion 382 and are spaced at 90° intervals (with respect to the longitudinal axis of the spool 346) around the circumference of the cam 368. Each slot 386 is sized and configured to receive a slot engagement portion of the valve housing 290. At least one slot engagement portion is provided within the spool passage 292. The slot engagement portion extends radially inward from an inner surface of the spool passage 292. Preferably, there are two slot engagement portions, on opposite sides of the spool passage separated by 180°. In the preferred embodiment, the slot engagement portions comprise pins 300 (FIG. 4) received within side walls of the valve housing 290.

The cam path recess 380 of the deactivation cam 368 is defined partially by a first annular sidewall 388 and a second annular sidewall 390. The sidewalls 388 and 390 include a plurality of cam surfaces 392 and valleys 394. As used herein, a "valley" refers to a region of the sidewall in which one of the slot engagement portions can become restrained within when the slot engagement portion bears against the sidewall 388 or 390. The cam surfaces 392 are angled with respect to the axis of the spool 346. In the preferred embodiment, the cam surfaces 392 are oriented at angles of about 60° with respect to the axis of the spool 346. The valleys 394 are configured to receive the slot engagement portions, such as the pins 300. When the pins 300 are not received within the slots 386, the cam 368 can freely rotate about the longitudinal axis of the spool passage 292. In a less preferred embodiment, the spool 346, including the deactivation cam 368, is rotatable about its longitudinal axis within the spool passage 292.

When the spool 346 is in its first position range, as defined above, the pins 300 are received within the slots 386 of the deactivation cam 368, preventing the cam from rotating. In the first position range, the pins 300 are positioned near the first ends 396 of the slots 386. As the spool 346 moves to its second position range, the cam 368 moves toward the springs 140 (FIG. 6) and the cam path recess 380 moves closer to the pins. However, the pins 300 remain within the slots 386. When the spool 346 moves to the lower endpoint of its third position range (i.e., when the pressure in the inlet galley 134 reaches the lower shut-off threshold pressure, as explained above), the pins 300 are still within the slots 386. As the pressure within the inlet galley 134 continues to rise, the pins 300 eventually enter the cam path recess 380, at which point the cam 386 becomes free to rotate. When the pressure in the inlet galley 134 reaches an upper cam activation pressure (e.g., 2500 psid), which is above the upper shut-off threshold pressure (e.g., 2100 psid), cam surfaces 392 of the first sidewall 388 bear against the pins 300. This causes the cam 368 to rotate in a first direction (so that the labeled slot 396 moves upward in FIG. 7) until each pin 300 is nestled in a valley 394 of the first sidewall 388. In a preferred embodiment, the cam surfaces 392 are configured similarly, such that the spool 346 rotates 22.5°. If the pressure in the inlet galley 134 increases beyond the upper cam activation pressure, the pins 300 nestled within the valleys 394 of the first sidewall 388 prevent the spool 346 from moving further toward the springs 140.

With the cam 368 in this rotated position, the pins 300 are no longer aligned with the slots 386. If the fluid within the inlet galley 134 (or in the passage 44—it will be understood that the pressure within the passage 44 is very closely equal to the pressure in the galley 134) is depressurized only once, the pins 300 will not re-enter the slots 386. Rather, the pins 300 are now restrained within the cam path recess 380. In this locked position of the valve 136, the spool 346 is in its third position range, such that the fluid within the valve system 133 is free to vent to the annulus 40. In this position, the tractor is in a failsafe mode, i.e., a mode in which the gripper assemblies are depressurized and retracted from the borehole surface 42. A significant advantage of this failsafe mode is that equipment connected to the tractor can undertake activities without risking damage to the gripper assemblies. For example, perforation guns can be operated with the gripper assemblies assured of being retracted, thus preventing or minimizing any possible damage to the gripper assemblies. Also, with the gripper assemblies assured of being retracted, they cannot cause the perforation guns to be erroneously moved. The failsafe mode also makes it possible to pull the tractor out of the borehole in case of an emergency.

After the cam surfaces 392 of the first sidewall 388 bear against the pins 300 for the first time and cause the cam 368 to initially rotate in the first direction, a subsequent first depressurization of the fluid within the inlet galley 134 below a lower cam-activation pressure (which is above the upper shut-off threshold) causes the deactivation cam 368 to move to the right in FIG. 7, so that cam surfaces 392 of the second sidewall 390 bear against the pins 300. This causes the cam 368 to rotate further in the first direction, until each pin 300 is nestled within a valley 394 of the second sidewall 390. In the preferred embodiment, the cam surfaces 392 of the second sidewall 390 are configured so that the cam rotates another 22.5°. At this point, the cam has rotated a total of 45° from the time the spool 346 was last in its first or second position ranges. The spool 346 is still restrained within its third position range. If the fluid in the inlet galley 134 is further depressurized, the pins 300 nestled within the valleys 394 of the second sidewall 390 will prevent the spool 346 from moving into its second (or "operating") position range.

Thus, as described above, a single pressure spike of the fluid in the inlet galley 134 to the upper cam activation pressure causes the entry control valve 136 to move to its locked position, in which the gripper assemblies are assured of being retracted.

The deactivation cam 368 is preferably configured so that, in order to move the spool 346 back into its second or first position ranges, it is necessary to again pressurize the fluid within the inlet galley 134. In the illustrated embodiment, this repressurization must occur after the pressure was first lowered from the upper cam activation threshold to the lower cam activation threshold. With the pins 300 restrained within the cam path recess 380 and nestled within valleys 394 of the second sidewall 390, a repressurization of the fluid within the inlet galley 134 to the upper cam activation pressure causes the spool 346 to move to the left in FIG. 7, so that the pins 300 again bear against cam surfaces 392 of the first sidewall 388. The cam 368 again rotates in the first direction (again, preferably 22.5°, such that the cam will have rotated a total of 67.5° since the spool 346 was last in its first or second position ranges) until each pin is again nestled within a valley 394 of the first sidewall 388. Then, a subsequent second depressurization of the fluid within the inlet galley 134 causes the spool 346 to move to the right in FIG. 7. When the pressure decreases to the lower cam activation level, each pin 300 bears against a partial cam surface 398 just "above" (see FIG. 7) one of the slots 386. As the pressure in the galley 134 continues to drop, the pins 300 slide along the cam surfaces 398 such that the cam rotates another 22.5° in the first direction. At this point, the cam 368 will have rotated a total of 90° since the spool 346 was last in its first or second position ranges. This causes the pins 300 to reenter the slots 386, although each pin is now in a different slot than before. The reengagement of the pins 300 within the slots 386 prevents the cam 368 from rotating further and permits the spool 346 to move into its second and first position ranges.

The spool 346 of the inlet control valve 136 can have variable diameter sections to allow some degree of throttling of the fluid into the tractor. This configuration provides some control over the pressure drop and speed of the tractor. In one embodiment, the landings of the spool 346 include notches, such as the notches 438 shown in FIG. 11 and described below. Thus, it will be understood that, in industry parlance, the valve 136 is commonly referred to as a "four-way valve," as it has a throttling position.

If desired, the cam 368 could be made to be completely rigid with respect to the remainder of the spool. However, such a configuration would require more force to rotate the cam and is thus less desirable than the preferred configuration described above.

Propulsion Control and Gripper Control Valves

The propulsion control valve 146 and the gripper control valve 148 function similarly. They are both piloted by fluid pressure on both sides. In a preferred embodiment, the valves 146 and 148 are configured substantially identically. Thus, only the propulsion control valve 146 is herein described.

Preferably, the propulsion control valve 146 almost has a "critically lapped spool design." A critically lapped valve has no "center" position (or third position), which would allow the valve to be closed. In this case, a closed propulsion control valve would render the tractor non-operational. Instead, the valve 146 is preferably "overlapped," which assures that fluid flows to only one of the chambers 196 and 198 (FIG. 3). An overlapped design also keeps leakage to a minimum. In contrast, an "under lapped" design would allow fluid to simultaneously flow to both of the chambers 196 and 198. Preferably, the valve 146 is not under lapped.

Figure 9:
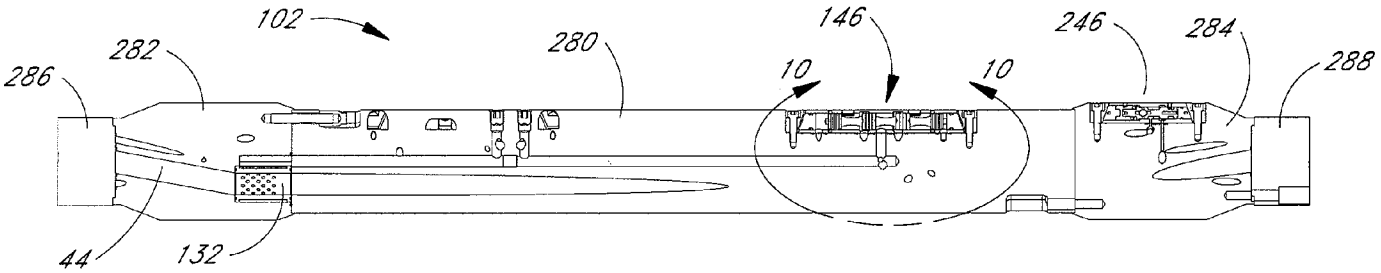
FIG. 9 is a longitudinal sectional view of the control assembly of FIG. 4, illustrating the propulsion control valve of the tractor.

FIG. 9 is a longitudinal sectional view of the preferred embodiment of the control assembly 102, with the aft end shown on the left and the forward end on the right.

Figure 10:
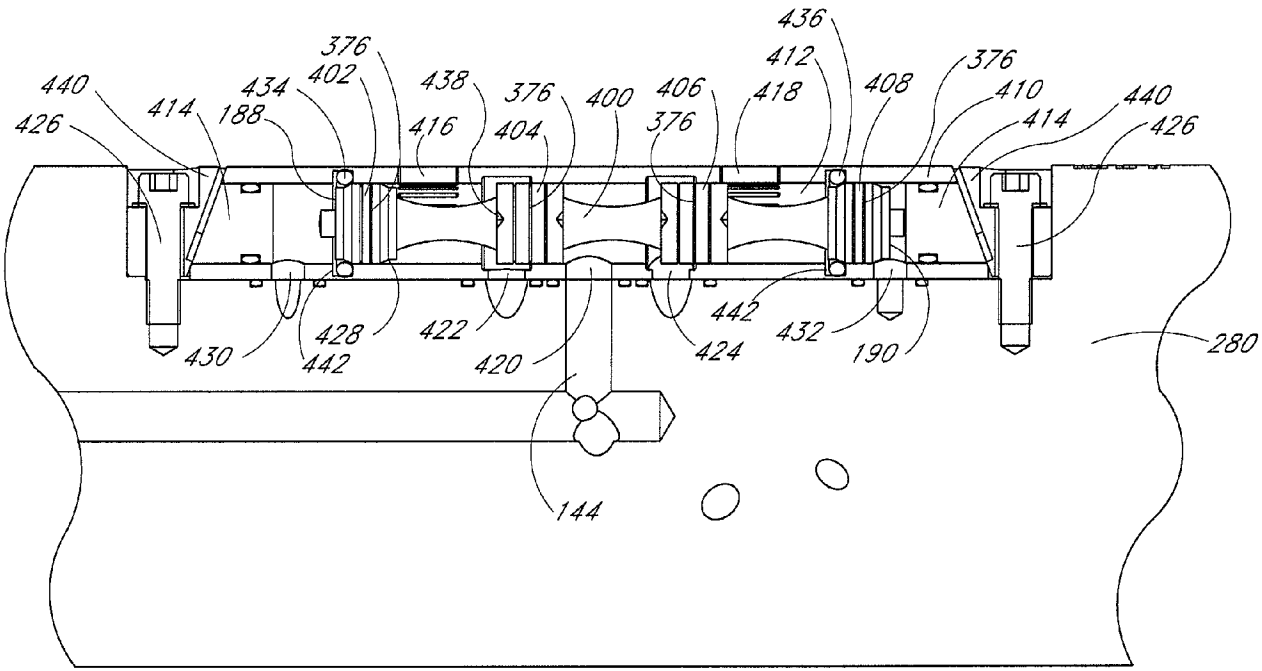
FIG. 10 is an exploded view of the propulsion control valve shown in FIG. 9.

FIG. 9 shows the propulsion control valve 146 in cross-section. The valve 146 is located toward the forward end of the control housing 280. FIG. 10 is an exploded view of the valve 146 as depicted in FIG. 9. In the preferred embodiment, the valve 146 functions as a two-position spool valve with detents that tend to retain the spool within one of its two main positions. In reality, it is a three-position valve with a center (blocked) position. However, the spool resides within its center position for only about 0.005 inches of a total spool stroke of 0.35 inches, which makes the center position relatively insignificant. In the illustrated embodiment, the valve 146 includes a valve housing 410 having an internal cylindrical spool passage 412. Plugs 414 with O-rings seal the ends of the spool passage 412. The valve housing 410 includes two vents 416 and 418. Two clamp elements 440 secure the ends of the valve housing 410 to the control housing 280 via bolts 426.

In the illustrated embodiment, the valve housing 410 includes fluid ports 430, 422, 420, 424, and 432, which align with openings of fluid passages within the control housing 280. The ports 430 and 432 provide pilot pressures that control the position of the spool 400. The ports 430 and 432 fluidly communicate with chambers 204 and 206, respectively. Fluid from the chamber 204 flows through the port 430 into the spool passage 412 and imparts a pressure force against the end surface 188 of the spool 400. Fluid from the chamber 206 flows through the port 432 into the spool passage 412 and imparts a pressure force against the end surface 190 of the spool 400. The ports 422, 420, and 424 fluidly communicate with the chamber 198, the main galley 144, and the chamber 196, respectively.

Near the ends of the valve housing 410, the inner surface of the spool passage 412 includes two grooves 442. Each groove 442 is preferably circular and sized to receive a resilient stop 434, 436. The stops 434 and 436 perform a detent function; they tend to retain the spool 400 in one of its two main positions. Each stop 434, 436 preferably defines an inner diameter and is positioned at least partially within the groove 442. Each stop 434, 436 has a relaxed position in which it has a first inner diameter and in which at least an inner radial portion of the stop is positioned outside of the groove 442. Each stop 434, 436 also has a deflected position in which it has a second inner diameter larger than the first inner diameter. Preferably, in its deflected position, substantially all of the stop is in the groove 442. In a preferred embodiment, each stop 434, 436 comprises an expandable ring-shaped spring. However, various other configurations are possible. For example, each stop could alternatively comprise a plurality of (e.g., three) circumferentially separated stop portions that extend radially inward from the inner surface of the spool passage 412.

The valve 146 includes a spool 400 having four landings 402, 404, 406, and 408. In the preferred embodiment, each of the two ends of each of the outer landings 402 and 408 have a radially tapered section followed by a generally constant diameter section that intersects the bottom of the taper. The tapered section has a tapered peripheral or radial surface 428. The tapered or conical surfaces 428 operate in conjunction with the stops 434, 436 to provide the detent function. The tapered surfaces 428 also function to prevent the stops 434, 436 from falling out or being washed out of the grooves 442. In their relaxed positions, each stop 434, 436 is configured to bear against or be in very close proximity to one of the tapered peripheral surfaces 428 of the landings 402 and 408, while being immediately radially outside of the reduced constant diameter section that intersects the bottom of the taper. It is this reduced diameter section that retains the stop from inadvertently being removed from the groove 442. The resilient stops are configured so that the landings 402 and 408 cannot move across the stops until the net longitudinal movement force on the spool 400 (from the fluid pressure on the end surfaces 188 and 190) reaches a threshold at which the tapered surfaces 428 of the landings cause the stops to move to their deflected positions. In their deflected positions, the stops 434, 436 permit the landings 402 and 408 to move across the stops. As used in this context, the terms "longitudinal" and "axial" refer to the longitudinal axis of the spool 400. Preferably, the shifting threshold of the valve 146 is relatively low, preferably between 250 and 800 psid.

As described above, the spool 400 of the propulsion control valve 146 has two main positions. The position shown in FIG. 10 corresponds to the above-described first position (shown in FIG. 3). In this position, fluid flows from the main galley 144 through the port 420, the spool passage 412, the port 424, and into the chamber 196. Simultaneously, fluid in the chamber 198 flows through the port 422, the spool passage 412, the vent 416, and into the annulus 40. As the fluid pressure forces against the end surfaces 188 and 190 fluctuate, the stops 434 and 436 bear against tapered surfaces 428 of the landings 402 and 408, respectively, to maintain the spool 400 in the position shown in FIG. 10. When the pressure differential acting on the end surfaces 188 and 190 (the force acting on end surface 190 being larger) reaches a threshold, the pressure force on the spool 400 exceeds the retaining forces of the stops 434, 436. The tapered surfaces 428 force the stops to move to their deflected positions, such that the spool 400 is permitted to shift to its second main position (to the left in FIGS. 3 and 10). After the spool 400 shifts, the stops 434, 436 move back to their relaxed positions and bear against or come in close proximity to the tapered surfaces 428 on the opposite sides of the landings 402 and 408. The spool 400 is thus maintained in its second position by the stops' contact with or close proximity to the tapered surface. The spool is prevented from moving away from the stop by the spool ends bearing against or being in close proximity to the end plugs 414. In the second position of the spool, fluid flows from the main galley 144 through the port 420, the spool passage 412, the port 422, and into the chamber 198. Simultaneously, fluid in the chamber 196 flows through the port 424, the spool passage 412, the vent 418, and into the annulus 40. The spool 400 will not shift back to its first position until the pressure differential acting on the end surfaces 188 and 190 (the force acting on end surface 188 being larger) reaches the aforementioned threshold necessary to again overcome the retaining forces of the stops 434, 436.

The landings of the spool 400 preferably include centering grooves 326, similar to those of the inlet control valve spool 346 described above. In the illustrated embodiment, the center landings 404 and 406 each include three centering grooves, and the outer landings 402 and 408 each include two centering grooves. Any number of centering grooves can be provided on each landing.

Figure 11:
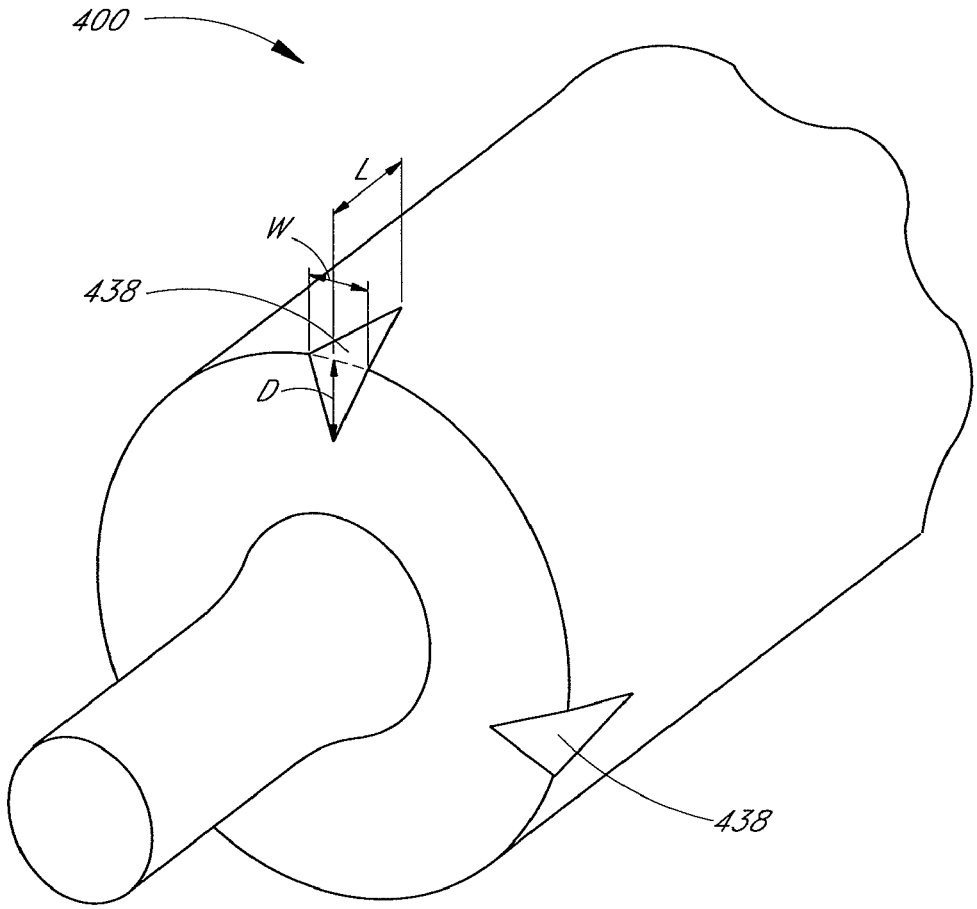
FIG. 11 is a perspective view of a portion of the propulsion control valve spool.

The center landings 404 and 406 preferably include a plurality of notches 438 (preferably between 3 and 8) at each end. The notches 438 permit a small amount of fluid flow past the landings when the landings are almost in a completely closed position with respect to a fluid port. The notches 438 help to reduce hydraulic shock caused by the sudden flow of fluid into a valve (commonly referred to as "hammer"). Thus, the notches help decrease wear on the valves. The skilled artisan will understand that notches can be included on some or all of the landings of the valves of the tractor 100. The notches 438 are preferably V-shaped. FIG. 11 shows an exemplary notch 438, having an axial length L extending inward from the edge of the landing, a width W at the edge of the landing, and a depth D. In one embodiment, L is about 0.055-0.070 inches, W is about 0.115-0.150 inches, and D is about 0.058-0.070 inches. Preferably, the positions of the notches 438 are carefully controlled, as the notches provide the lapping function of the valve 146.

As mentioned above, the gripper control valve 148 is preferably configured substantially identically to the propulsion control valve 146. One difference is that, in the valve 148, the fluid ports analogous to the fluid ports 430, 422, 424, and 432 of the valve 146 are in fluid communication with the chambers 220, 206, 204, and 222, respectively. Also, the gripper control valve 148 can be significantly smaller than the propulsion control valve 146, because the flow through the valve 148 can be significantly less.

In a preferred embodiment, the stops 434, 436 of the propulsion control valve 146 have about twice the detent force of analogous stops within the gripper control valve 148. In one embodiment, only one stop is provided within the valve 148, as opposed to two in the valve 146. Also, it is possible to use stops of differing stiffness or grooves 442 of differing diameter to adjust the detent force, keeping in mind the goal of ensuring that upon the completion of the strokes of the propulsion cylinders the gripper assemblies switch between their actuated and retracted positions before the valve 146 switches positions. It will also be understood that the detent force can be modified by adjusting the angles of the tapered sections 428 of the spools.

Cycle Valves

In the preferred embodiment, the cycle valves 150 and 152 are configured substantially identically. Thus, only the aft cycle valve 150 is herein described.

Figure 12:
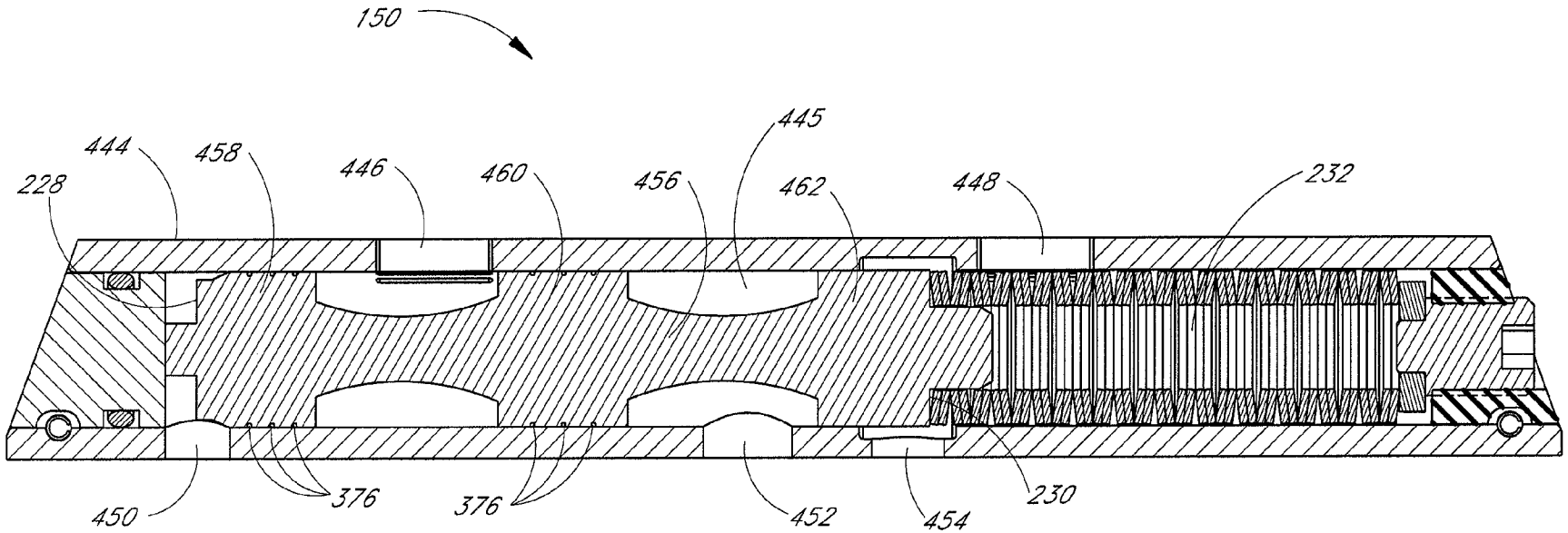
FIG. 12 is a longitudinal sectional view of the aft cycle valve shown in FIG. 4.

FIG. 12 shows a longitudinal sectional view of the aft cycle valve 150, according to a preferred embodiment, with the aft end shown on the left and the forward end shown on the right. With reference to the inlet control valve 136 and the propulsion control valve 146 described above, the cycle valve 150 includes a generally similarly configured valve housing 444. The housing 444 has an internal cylindrical spool passage 445 and includes vents 446 and 448. The housing 444 also includes fluid ports 450, 452, and 454 that fluidly communicate with the chamber 198, the main galley 144, and the chamber 220, respectively. The valve 150 includes a spool 456 with landings 458, 460, and 462 as shown. One or more of the landings preferably include centering grooves 376 as described above. The spool 456 has end surfaces 228 and 230. The end surface 228 is in fluid communication with the fluid in the chamber 198, via the port 450. A spring, and more preferably a set of springs 232 (preferably Belleville springs), bears against the end surface 230, such that the springs bias the spool 456 to the left in FIG. 12.

As explained above, the spool 456 of the valve 150 has a first position and a second position. The spool 456 is shown in its first position in FIG. 12. In this position, fluid within the chamber 220 flows through the port 454 and the spool passage 445, within the springs 232, through the vent 448, and out into the annulus 40. The fluid from the chamber 198 imparts a pressure force against the end surface 228, which tends to push the spool 456 to its second position (to the right in FIG. 12). When the fluid pressure force on the end surface 228 exceeds an actuation threshold, the spool 456 moves such that the landing 462 blocks the flow of fluid between the port 454 and the vent 448, and permits flow between the ports 452 and 454. When the spool 456 is in its second position, fluid within the main galley 144 flows through the port 452, the spool passage 445, the port 454, and into the chamber 220. Preferably, the actuation threshold of the valve 150 is between 800 and 1500 psid, or possibly even as high as 2000 psid. The vent 446 is non-operational. It exists only because of a preference that all of the valve housings have the same configuration, to keep manufacturing costs down.

As mentioned above, the forward cycle valve 152 is preferably configured substantially identically to the aft cycle valve 150. One difference is that, in the valve 152, the fluid ports analogous to the fluid ports 450 and 454 of the valve 150 are in fluid communication with the chambers 196 and 222, respectively. If desired, the valves 150 and 152 can be provided with screws to permit adjustment of the spring forces of the springs. Such screws can compensate for variance in manufacturing tolerances.

Pressure Reduction Valves

In a preferred embodiment, the pressure reduction valves 244 and 246 are configured substantially identically. Thus, only the aft pressure reduction valve 244 is herein described.

Figure 13:
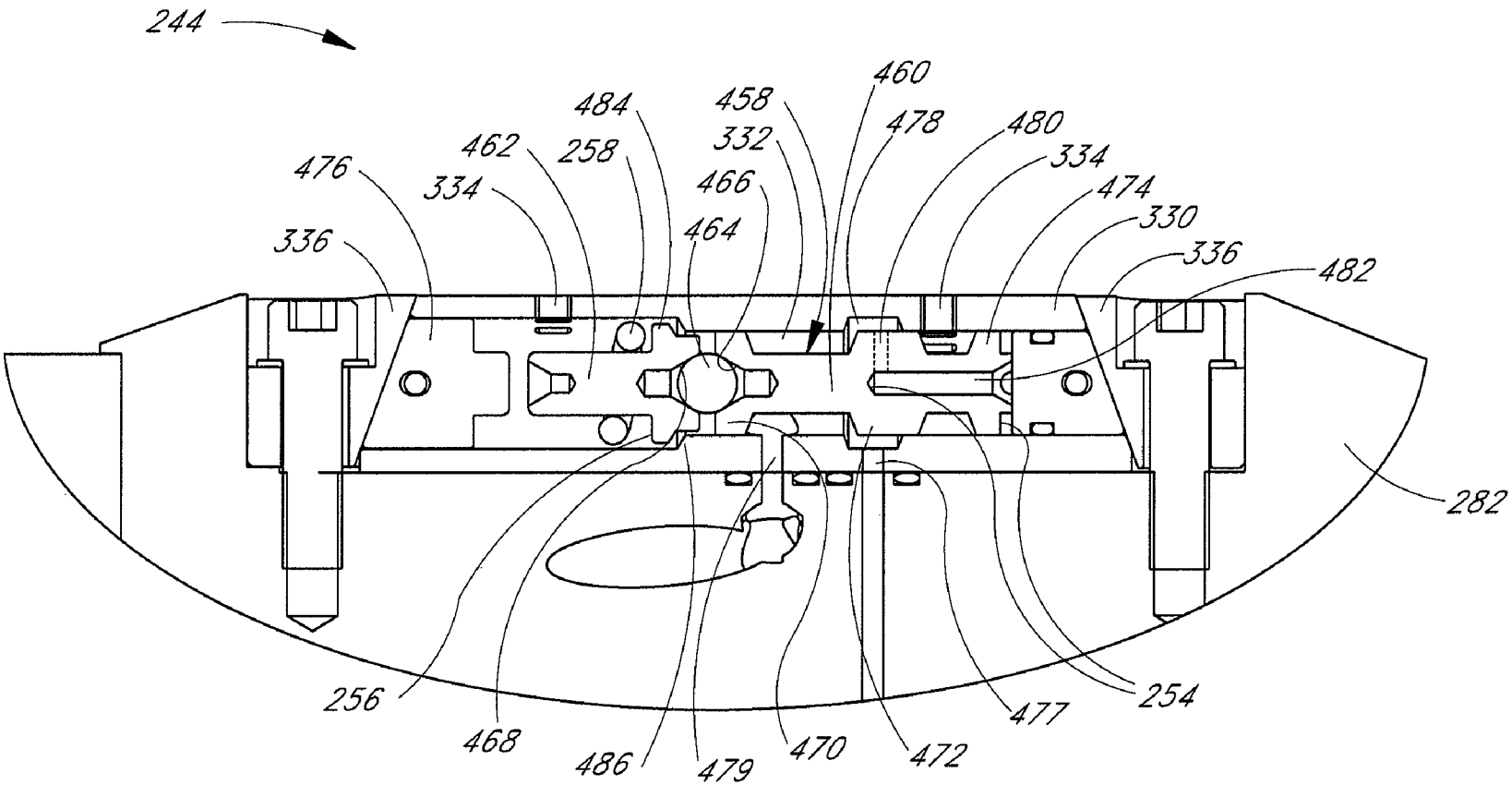
FIG. 13 is a longitudinal sectional view of the aft pressure reduction valve of the control assembly shown in FIG. 4.

FIG. 13 shows a longitudinal sectional view of the aft pressure reduction valve 244, according to a preferred embodiment, with the aft end shown on the right and the forward end shown on the left. The valve 244 includes a valve housing 330 configured generally similarly to those of the valves described above. The housing 330 has an inner cylindrical spool passage 332 with an annular recess 478. The housing 330 also includes two vents 334, as well as fluid ports 477 and 479 that fluidly communicate with the chambers 248 and 204, respectively. Each of the ports 477 and 479 is aligned with a fluid passage opening 344 in the aft transition housing 282 (FIG. 4). The port 477 is open to the annular recess 478 of the valve 244. The valve housing 330 is secured via clamp elements 336 and bolts to the aft transition housing 282.

The valve 244 includes a spool 458 comprising a first spool portion 460 and a second spool portion 462. The second spool portion 462 is preferably a spring guide. The spool portion 460 includes landings 470, 472, and 474 as shown. In some embodiments, one or more of the landings include centering grooves as described above. The spool portion 460 also includes a center-drilled passage 482 and a side passage 480. The passage 482 extends from the aft end of the spool portion 460 to the longitudinal position (in this context, the term "longitudinal" refers to the axis of the spool passage) of the side passage 480. The spool portion 460 is configured so that in normal operation the side passage 480 is positioned within the annular recess 478 of the spool passage 332. The side passage 480 is fluidly open to the center-drilled passage 482 so that fluid within the chamber 248 can flow into the passage 482. The fluid within the center-drilled passage 482 imparts a pressure force against the surface 254, which tends to push the spool 458 to the left in FIG. 13. As referred to herein, the surface 254 can include the aft end surface of the spool portion 460, outside of the passage 482.

The spool portion 462 has a flange 484 that defines an annular surface 256. A spring 258 is positioned between the surface 256 and an end plug 476. The spring 258 biases the spool portion 462 to the right in FIG. 13. In the illustrated embodiment, the spring 258 comprises a coil spring (only one coil is shown in FIG. 13) coiled around an elongated portion of the spool portion 462. In the preferred embodiment, there is always a clearance between a flange 484 of the spool portion 462 and an annular step 486 formed within the spool passage 332.

The spool portions 460 and 462 have opposing end surfaces with partially tapered and preferably partially conical ball-receiving recesses 466 and 468, respectively. A ball 464 is interposed between the spool portions 460 and 462, partially within the ball-receiving recesses 466 and 468. Preferably, the recesses 466 and 468 are configured to only partially receive the ball 464, so that the ball makes contact with both spool portions. The presence of the ball 464 and the ball-receiving recesses 466 and 468 results in improved alignment of the spool 458 within the spool passage 332, which in turn results in reduced leakage and more efficient operation.

As explained above, the spool 458 of the valve 244 has first, second, and third positions. The spool 458 is shown in its first position in FIG. 13. In this position, fluid within the chamber 204 flows through the port 479 across the forward end of the landing 472, and through the spool passage 332, the port 477, and into the chamber 248. When the fluid pressure force on the surface 254 exceeds an actuation threshold, the spool 458 moves to its second position (shifted partially to the left in FIG. 13). In this position, the landing 472 blocks fluid flow between the ports 477 and 479, which stops the flow into the aft gripper assembly 104 (FIG. 3). This spool will normally be in the second position when the gripper assembly is actuated. If the pressure in the chamber 248 is further increased, such as by an external friction force on the gripper assembly, the spool shifts further left to its third position. In the third position, excess pressure in the chamber 248 bleeds past the aft end of the landing 472 through the aft vent 334 into the annulus 40. The forward vent 334 accommodates volume changes on the left side of the landing 470 as the spool moves to the left.

As mentioned above, the forward pressure reduction valve 246 is preferably configured substantially identically to the aft pressure reduction valve 244. One difference is that, in the valve 246, the fluid ports analogous to the fluid ports 477 and 479 of the valve 244 are in fluid communication with the chambers 260 and 206, respectively.

Shaft Configuration and Manufacturing Process

With reference to FIG. 2, a process for manufacturing the shafts 118 and 124 of the tractor 100 is herein described.

As explained above in the Background section, prior art shafts designed for downhole tools used in drilling and intervention applications have been formed from more flexible materials, such as copper beryllium (CuBe), in order to facilitate turning at sharper angles in the bore of a well. Due to the various constraints of CuBe and other materials, prior art individually gun-drilled shaft portions have been attached to one another by electron beam welding, a very expensive process. The geometry of prior art shafts (e.g., larger internal passages necessitated by drilling mud) and the constraints of softer materials like CuBe have limited the possible length of gun-drilled passages and required a relatively large number of gun-drilled shaft portions.

In one aspect, the present invention provides a shaft design and manufacturing method for a tractor to be used primarily for intervention. In contrast to drilling, intervention applications are typically undertaken in cased boreholes and do not require the ability to negotiate sharp turns. In contrast to drilling tools, which typically use drilling mud having larger solid particles, an intervention tractor can use an operating fluid such as clean brine, and thus does not require as large an internal flow passage for fluid to the downhole equipment and valve system. Accordingly, a preferred embodiment of a tractor of the present invention includes a shaft with a relatively smaller internal flow passage for fluid to the downhole equipment and valve system. Also, the shaft is preferably formed from a stronger, more rigid material. The combination of a smaller diameter flow passage, which leaves more space for gun-drilled passages, and a stronger material of the shaft makes it possible to gun-drill longer passages. This in turn allows for fewer shaft portions. In a preferred embodiment of the invention, each shaft 118 and 124 (FIG. 2) includes only two shaft portions and an end flange.

Figure 14:
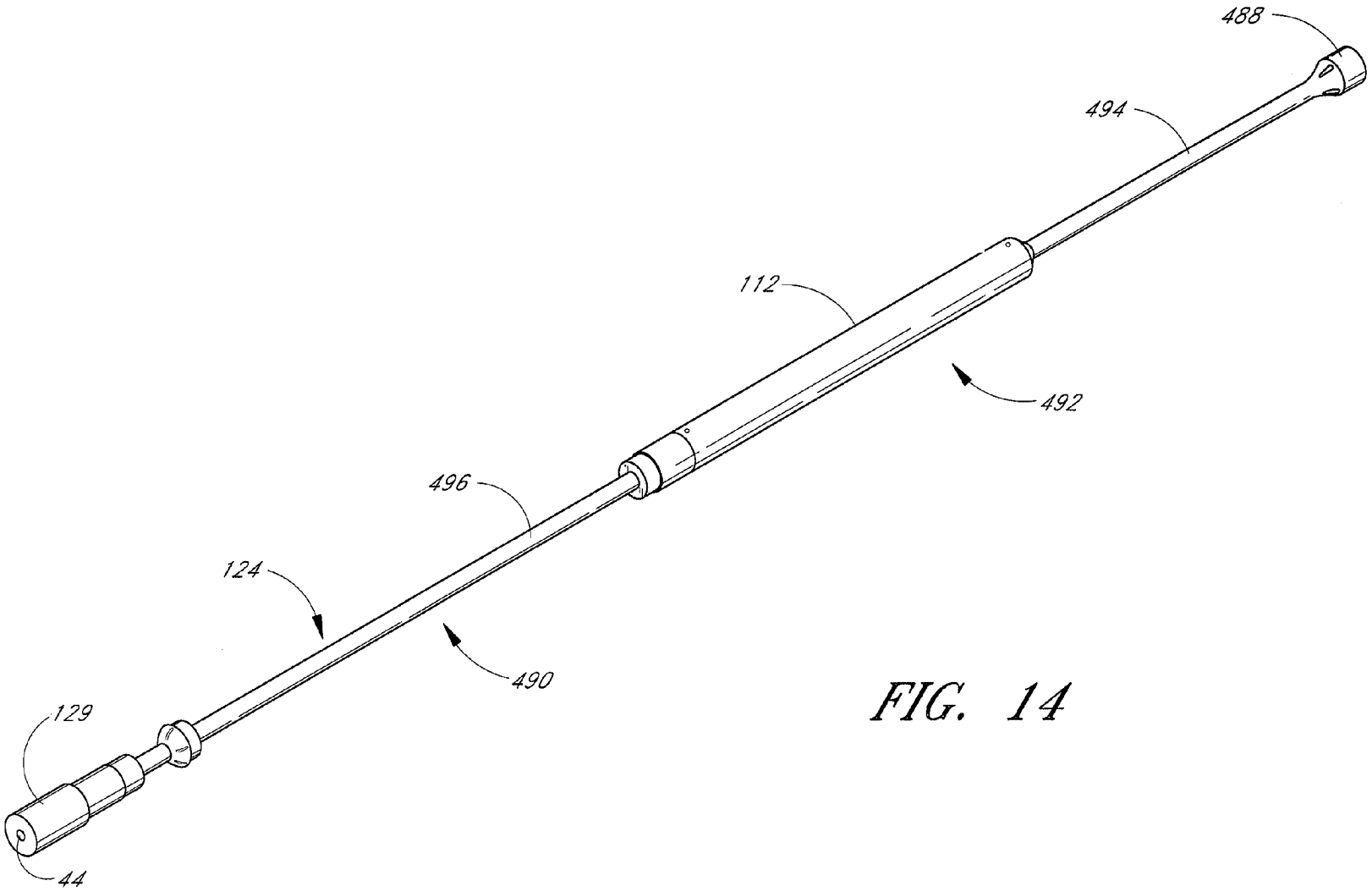
FIG. 14 is a perspective view of a forward shaft assembly a tractor according to one embodiment of the invention, with the gripper assembly not shown for clarity.

FIG. 14 shows a preferred embodiment of the forward shaft 124 of the tractor of the invention. In this embodiment, the tractor includes only a single forward propulsion cylinder 112 enclosing a single piston. The forward gripper assembly is not shown for clarity, but would typically be located generally at position 490. Attached to the forward end of the shaft 124 is a tool joint assembly 129 for attachment to downhole equipment. The assembly 129 includes an internal bore for the passage 44 for operating fluid to the downhole equipment. The aft end of the shaft 124 is welded to a flange 488 for connection to the forward end of the control assembly 102 (FIG. 2). The shaft 124 preferably includes a first shaft portion 494 and a second shaft portion 496. The shaft portions are preferably brazed together, as described below. The braze joint is located, for example, at about the position 492. The braze joint is enclosed by the cylinder 112.

Figure 15:
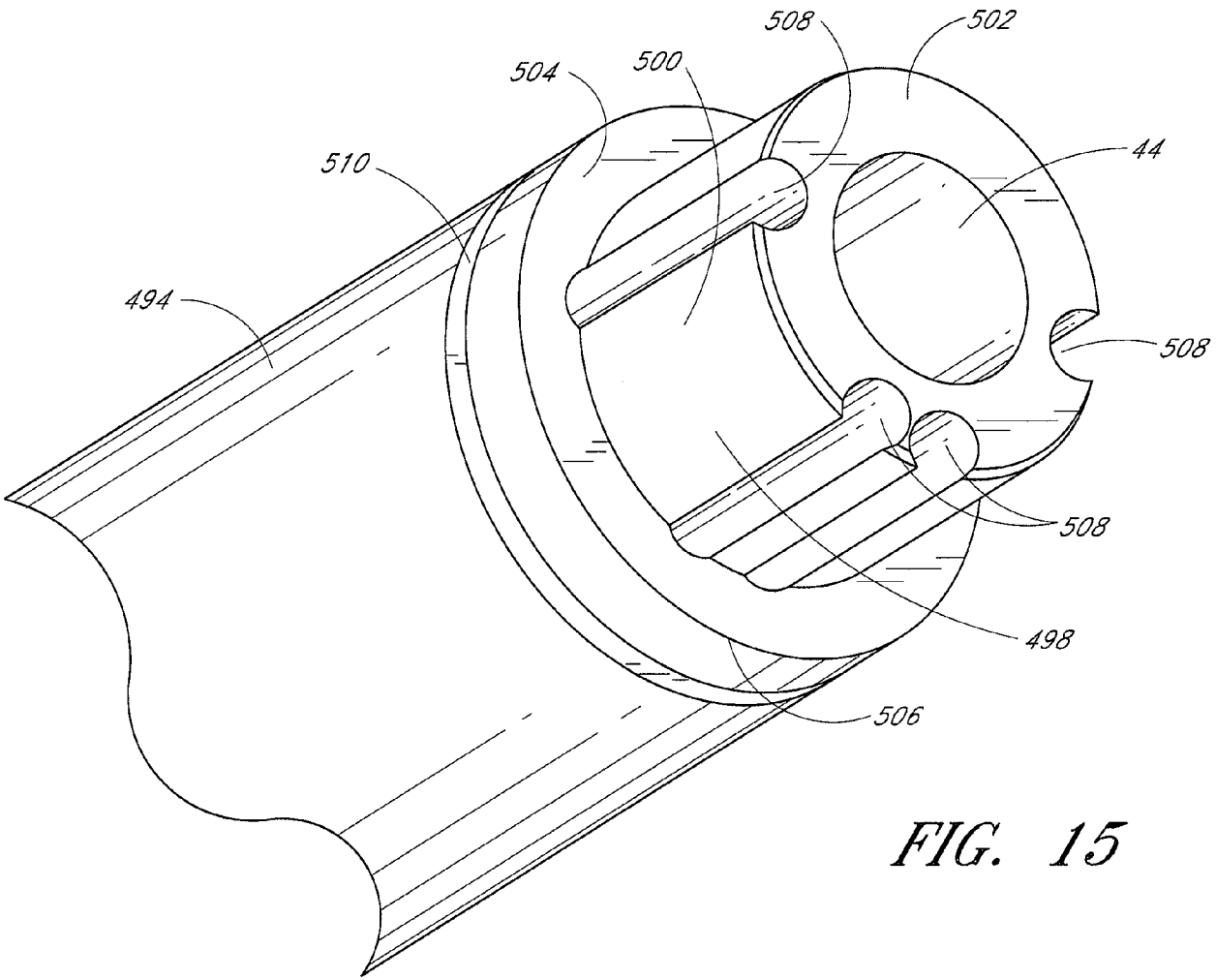
FIG. 15 is a perspective view of a male braze joint of a shaft portion of the shaft of FIG. 14.

FIG. 15 shows the forward end of a preferred embodiment of the first shaft portion 494 of FIG. 14. Preferably, the end surfaces of the first shaft portion 494 and the second shaft portion 496 are configured to mate with each other. The illustrated forward end of the first shaft portion 494 comprises a male connection, while a conforming aft end of the second shaft portion 496 is female. The shaft portion 494 includes an elongated end portion 498 having a reduced width (which may include non-circular configurations) or diameter (for circular configurations). The portion 498 has a peripheral surface 500 and an end surface 502, and is preferably about one inch long. A connecting annular surface 504 is formed between the end portion 498 and the remainder of the shaft portion 494. In the illustrated embodiment, the end surface 502 and the connecting surface 504 are generally flat and perpendicular to the longitudinal axis of the first shaft portion 494. However, other configurations are possible, such as tapered surfaces.

A "mating surface" of the first shaft portion 494 comprises the surfaces 502, 500, and 504. The second shaft portion 494 preferably has a "mating surface" that mates with that of the first shaft portion 494. Other mating surface configurations are possible, giving due consideration to the goal of forming a strong joint that is capable of withstanding combined tensile, shear, and bending loads experienced downhole. At the outside diameter of the shaft portion 494, an edge 506 is formed between the connecting surface 504 and the remainder of the shaft portion 494. The illustrated edge 506 is circular and forms an outer interface between the first and second shaft portions when they are attached together. Bores 508 form fluid passages within the shaft portion 494 (for the flow to the gripper assemblies and propulsion chambers), while a larger center bore forms the main passage 44 (FIG. 3). In the illustrated embodiment, the outside diameter of the end portion 498 interrupts the passages.

Preferably, a stress-relief groove 510 is formed proximate the mating surface of the first shaft portion 494. The groove 510 provides a stress concentration point to reduce the stresses felt at the outside diameter of the joint between the first and second shaft portions. Thus, the groove 510 further reduces the risk of failure at the joint by taking the stress away from the outside diameter of the shaft, where stresses are typically at a maximum. Preferably, the groove 510 extends along the entire or substantially the entire circumference of the outer diameter of the shaft portion 494. The groove 510 is preferably circular. The longitudinal position, as well as the width and depth, of the groove 510 can vary, keeping in mind the goal of pulling stress away from the outermost edge of the brazed connection. The groove 510 is desirably positioned within 0.060 inches of the edge 506. Preferably, the groove 510 has a width between 0.080 and 0.120 inches, and a depth between 0.050 and 0.060 inches.

In the preferred embodiment, the mating surfaces of the first and second shaft portions are silver brazed together. The silver braze connection is formed by placing a brazing shim on the end surface 502 and then mating together the mating surfaces of the first and second shaft portions. The connected shafts are then heated to melt the brazing shim. The brazing shim contains silver alloy which, when melted, flows along the mating surfaces of the shaft portions by capillary action. Advantageously, the silver generally does not flow into the bores 508 or the passage 44—it remains substantially along the mating surfaces. Since the heat will normally be applied from the exterior surfaces of the shaft portions, the surface 502 will be heated last. Thus, the surfaces 500 and 504 will be slightly hotter than the surface 502. This ensures that when the brazing shim melts at the surface 502 it will flow to the warmer surfaces 500 and 504 and remain in liquid form to effect a better connection. The emergence of excess silver at the external interface 506 signals that the silver has fused completely through the mating surfaces. Preferably, the shaft portions 494 and 496 are formed from stainless steel, such as 17-4PH steel, a high-strength corrosion-resistant steel that is readily brazed. Furthermore, in the H-1150 condition, the strength is sufficient and is not significantly affected by the silver braze process. In experimental testing, silver braze joints of the illustrated configuration have withstood multiply administered tension loads greater than 100,000 pounds.

Figure 16:
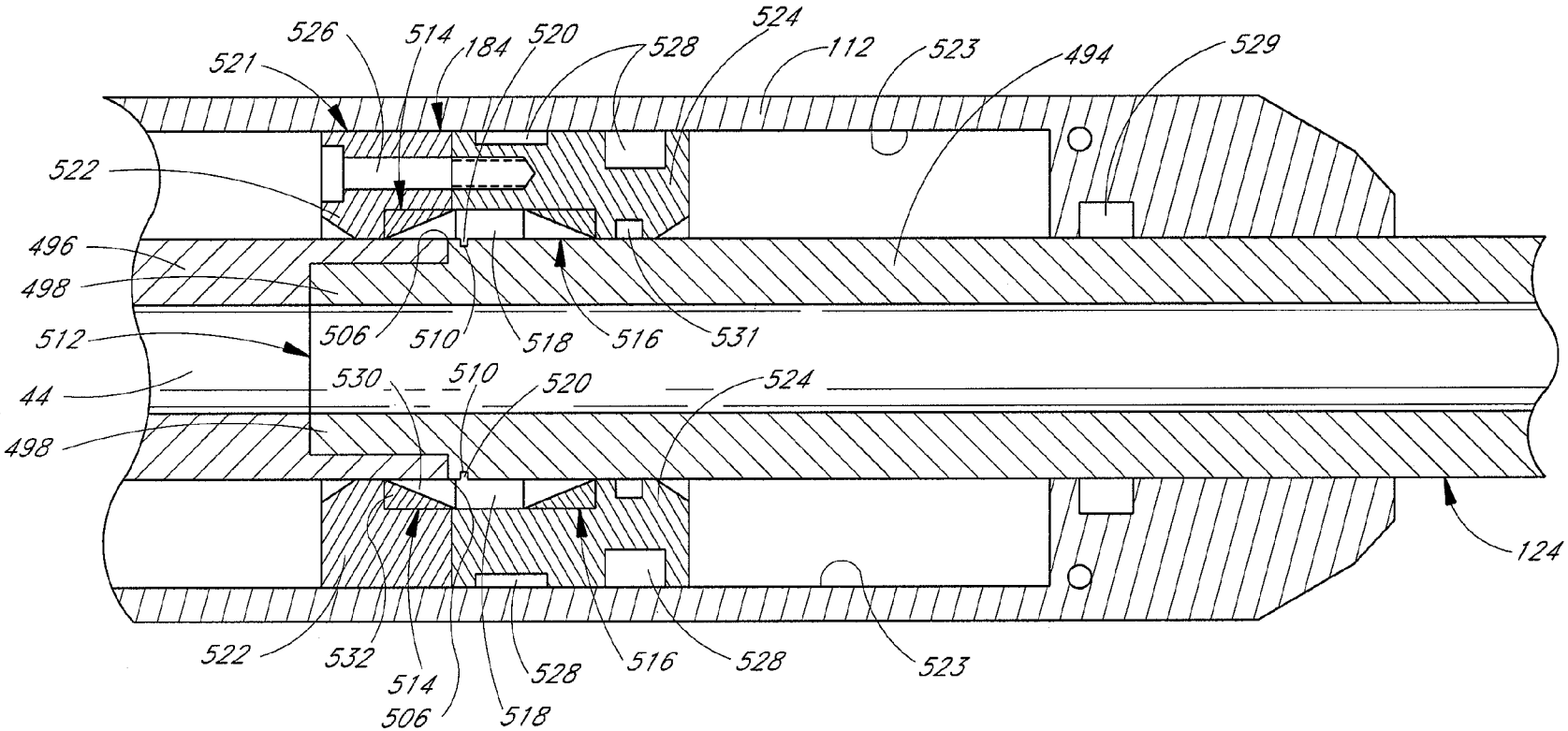
FIG. 16 is a longitudinal sectional view of a braze joint of the shaft of FIG. 14, as well as a connection of a preferred embodiment of a piston to the shaft.

FIG. 16 is a longitudinal sectional view of the braze joint of the shaft 124 of FIG. 14. Preferably, the piston 184 is fitted over the interface 506 between the first and second shaft portions 494 and 496. Advantageously, the piston 184 provides additional strength to the joint, reducing the risk of failure. FIG. 16 also illustrates a preferred embodiment of a piston 184, which comprises two ring-shaped compression clamps 514 and 516, a spacer ring 518, and a locking assembly 521. The compression clamps 514 and 516 each apply a radial inward compression force onto the shaft 124. The compression clamps rigidly lock onto the shaft and, along with the spacer ring 518 described below, provide the majority of the piston's resistance to moving with respect to the shaft 124. In the illustrated embodiment, each compression clamp comprises a pair of ring-shaped clamp members with tapered annular surfaces that interact with one another to produce the compression force. For example, the clamp 514 includes an inner clamp member 530 and an outer clamp member 532. The members 530 and 532 have inclined annular surfaces that mate with one another. As the members 530 and 532 are forced axially together with respect to the shaft axis, the axial force is converted into a radial inward compression force that locks the compression clamp 514 onto the shaft. The compression clamp 516 is preferably configured substantially similarly to the compression clamp 514. In a preferred embodiment, the clamps 514 and 516 comprise Ringfeder® clamps, available from Ringfeder Corporation of Westwood, N.J., U.S.A.

The spacer ring 518 is not a necessary element of the illustrated piston 184. However, the spacer ring advantageously provides additional resistance to axial movement or sliding of the compression clamps 514 and 516 with respect to the shaft 124. The spacer ring, preferably a two-piece part to facilitate installation, includes an annular lip 520 on its inner surface. The lip 520 is sized and adapted to fit within the stress-relief groove 510 of the first shaft portion 494 of the shaft. The reception of the lip 520 within the groove 510 resists axial sliding of the spacer ring 518, and thus of the entire piston 184, with respect to the shaft 124. Another advantage of the groove 510 and the spacer ring 518 is that the groove provides a convenient method for locating and properly positioning the piston 184 during assembly of the shaft 124.

The locking assembly 521 imparts an axial compression force onto each pair of clamp members of the compression clamps 514 and 516. The clamps 514 and 516 convert the axial compression force of the locking assembly 521 into the aforementioned radial inward compression force onto the shaft 124. In the illustrated embodiment, the locking assembly 521 comprises a pair of ring-shaped locking members 522 and 524, which are clamped axially together by one or more bolts 526 extending through holes in the member 522 and into threaded holes in the member 524. As the locking members 522 and 524 are clamped together, they increase the radial compression force of the compression clamps 514 and 516. The locking assembly 521 also comprises a majority of the volume of the piston 184. Preferably, the locking assembly 521 extends radially to the inner surface 523 of the propulsion cylinder 112. Seals 528 are provided within recesses in the peripheral surface of the locking member 524. The seals 528 effect a fluid seal between the piston 184 and the inner surface 523 of the cylinder 112. Also, at least one seal 531 is provided between the piston 184 and the shaft 124. The seals 528 and 531 may comprise O-ring type or lip type seals. It will be understood that seals can alternatively or additionally be positioned within recesses in the peripheral surface of the locking member 522. Seals 529 are also provided within recesses at the ends of the cylinder 112 adjacent the shaft 124 to prevent leakage of fluid from within the cylinder to the annulus 40. The aforementioned Ringfeder Corporation sells locking assemblies. However, in the preferred embodiment, the locking assembly 521 is custom sized and shaped.

It will be understood that each of the shafts 118 and 124 (FIG. 2) may comprise any number of shaft portions silver brazed together, preferably configured as shown in FIGS. 15 and 16. Also, some or all of the joints can be strengthened by positioning the pistons so as to enclose the interfaces of the joints, as shown in FIG. 16. Also, some or all of the pistons of the shafts can comprise compression clamps (preferably with spacer rings) and locking assemblies, as shown in FIG. 16.

Hydraulically Controlled Reverser Valve

Figure 17:
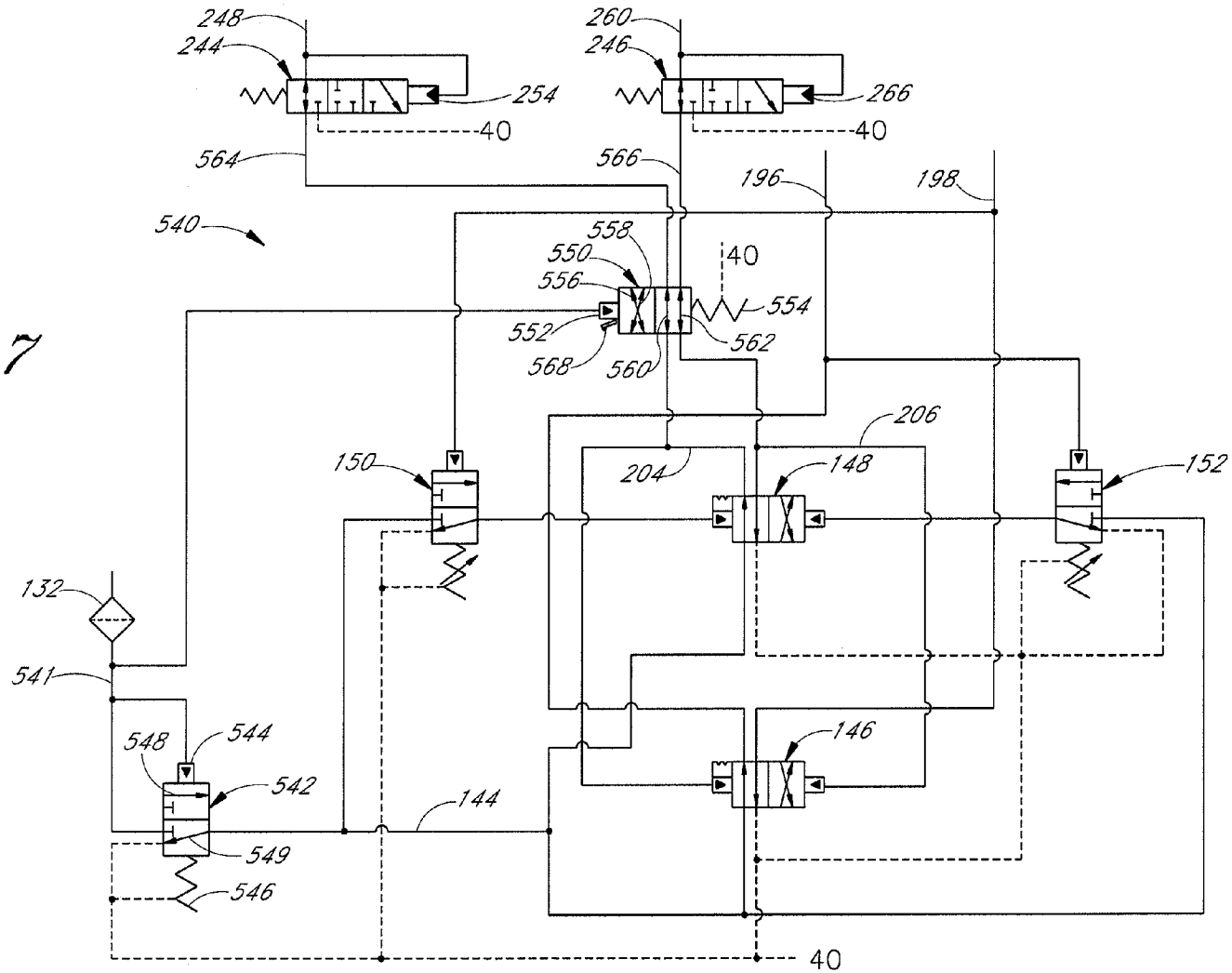
FIG. 17 is a schematic diagram illustrating a valve system according to an alternative embodiment of a tractor of the invention, which includes a hydraulically controlled reverser valve that toggles in response to a pressure spike to permit the tractor to power out of a borehole.

FIG. 17 illustrates a valve system 540 for a tractor according to an alternative embodiment of the invention. As explained below, the valve system 540 permits the direction of travel of the tractor to be controlled. With the exception of a number of modifications discussed below, the valve system 540 is configured substantially similarly to the valve system 133 shown in FIG. 3. Elements of the valve system 540 are labeled with the reference numbers of analogous elements of the valve system 133. The valve system 540 includes a propulsion control valve 146, gripper control valve 148, aft cycle valve 150, forward cycle valve 152, aft pressure reduction valve 244, and forward pressure reduction valve 246, all configured similarly to corresponding elements of the valve system 133. However, the inlet galley 541 and the inlet control valve 542 of the valve system 540 are configured differently than the inlet galley 134 and inlet control valve 136 of the valve system 133. The valve system 540 also includes a hydraulically controlled reverser valve 550, as well as fluid chambers 564 and 566, described below.

The inlet galley 541 of the valve system 540 extends to the inlet control valve 542 and the reverser valve 550. The inlet control valve 542 preferably comprises a spool valve. The valve spool has a first position (shown in FIG. 17) in which fluid is prevented from entering the remainder of the valve system 540, and a second position (shifted vertically downward in FIG. 17) in which fluid does enter the remainder of the valve system. In the first position of the spool, the valve 542 provides a flow path (represented by arrow 549) for fluid within the main galley 144 to flow into the annulus 40. In the first position of the spool, fluid within the inlet galley 541 is prevented from flowing through the valve 542 into the main galley 144. In the second position of the spool, the valve 542 provides a flow path (represented by arrow 548) for fluid within the inlet galley 541 to flow into the main galley 144. In the second position of the spool, fluid within the main galley 144 is prevented from flowing through the valve 542 into the annulus 40.

The inlet control valve 542 is piloted by the fluid pressure within the inlet galley 541. The spool has a surface 544 exposed to fluid within the inlet galley 541. At least one spring 546 biases the spool in a direction opposite to the fluid pressure force received by the surface 544. In this respect, the operation of the valve 542 is effectively similar to that of the cycle valves 150 and 152 and the pressure reduction valves 244 and 246. The valve spool of the valve 542 moves to its second position when the pressure in the inlet galley 541 exceeds a threshold determined by the characteristics of the at least one spring 546. Thus, the valve 542 effectively has an "off" position (as shown in FIG. 17) and an "on" position (shifted vertically downward in FIG. 17).

The reverser valve 550 controls the direction that the tractor travels within the passage or borehole. The valve 550 permits the sequence of operations for forward motion of the tractor (to the right in FIG. 13) to be modified so that the actuation and retraction of the gripper assemblies are reversed. During the operational cycle of the valves associated with forward motion of the tractor (described above), fluid is distributed to and from the gripper assemblies and to and from the chambers of the propulsion cylinders according to a specific sequence. At certain stages of the sequence, the aft gripper assembly is actuated and the forward gripper assembly is retracted. At other stages of the sequence, the aft gripper assembly is retracted and the forward gripper assembly is actuated. If this operational sequence is modified so that each gripper assembly is actuated during stages when it was previously retracted, and so that each gripper assembly is retracted during stages when it was previously actuated, the tractor will travel backward (to the left in FIG. 13). The reverser valve 550 accomplishes this task.

In the illustrated embodiment, the reverser valve 550 communicates with the chambers 204 and 206. Unlike in the valve system 133, the chambers 204 and 206 do not extend to the pressure reduction valves. The reverser valve 550 also communicates with the chambers 564 and 566. The chamber 564 extends from the valve 550 to the aft pressure reduction valve 244. The chamber 566 extends from the valve 550 to the forward pressure reduction valve 246. The valves 244 and 246 communicate with the chambers 564 and 566, respectively, in the same manner that the valves 244 and 246 communicate with the chambers 204 and 206 in the valve system 133 (FIG. 13).

In the preferred embodiment, the reverser valve 550 comprises a two-position spool valve. The valve spool has a first position (shown in FIG. 17) in which the tractor travels forward, and a second position (shifted to the right in FIG. 17) in which the tractor travels backward. In the first position of the spool, the valve 550 provides a flow path (represented by arrow 560) for fluid within the chamber 206 to flow into the chamber 564. In the first position of the spool, the valve 550 also provides a flow path (represented by arrow 562) for fluid within the chamber 566 to flow into the chamber 206. In the second position of the spool, the valve 550 provides a flow path (represented by arrow 558) for fluid within the chamber 204 to flow into the chamber 566. In the second position of the spool, the valve 550 also provides a flow path (represented by arrow 556) for fluid within the chamber 564 to flow into the chamber 206.

In the illustrated embodiment, the fluid pressure in the inlet galley 541 controls the position of the spool of the reverser valve 550. The spool has a surface 552 exposed to the fluid from the inlet galley 541. The surface 552 receives a pressure force that tends to move the spool to its second position. At least one spring 554 biases the spool toward its first position and opposes the pressure force on the surface 552. Thus, the spool shifts to its second position, to effect backward travel of the tractor, when the fluid within the inlet galley 541 exceeds a shifting threshold pressure determined by the characteristics of the at least one spring 554. Preferably, the shifting threshold pressure (e.g., 2000 psid) required to move the spool of the reverser valve 550 to its second position is greater than the threshold pressure (e.g., 800 psid) required to move the spool of the inlet control valve 542 to its second position. The skilled artisan will understand that the greater the variance between these threshold pressures, the easier it will be to open the inlet control valve 542 (i.e., to move the spool to its second position) without inadvertently reversing the direction of tractor motion.

In the preferred embodiment, the reverser valve 550 includes a locking feature, schematically represented by a latch 568, which locks the spool in its second (or first) position. Preferably, the locking feature comprises a cam such as the deactivation cam 368 (FIGS. 5-8) described above. In this embodiment, in order to shift and lock the spool within its second (or first) position, it is necessary to increase the pressure in the inlet galley 541 above the upper cam-activation threshold of the cam (e.g., 2000 psid). In order to unlock the spool, it is necessary to (1) reduce the pressure below the lower cam-activation threshold of the cam (e.g., 1000 psid), (2) increase the pressure back above the upper cam-activation threshold, and (3) reduce the pressure below the shifting threshold of the valve 550. Refer to the discussion of the deactivation cam 368 above.

Thus, the illustrated reverser valve 550 provides a convenient means for reversing the direction of the tractor, while preserving an all-hydraulic design for the valve system of the tractor.

An alternative embodiment of a tractor of the invention includes a hydraulically controlled reverser valve configured to be actuated only once. When the reverser valve is actuated, the tractor will walk backward out of the passage or borehole. A preferred configuration of the valve system of this embodiment is herein described with reference to FIG. 17. The valve system is substantially identical to that shown in FIG. 17, with the following exceptions. First, the reverser valve 550 is modified so that the toggle feature 568 and the spring 554 are removed. Second, a burst disc or rupture disc device is provided in the pilot line that extends from the inlet galley 541 to the end surface 552 of the spool of the reverser valve 550. The burst disc is configured to burst or open when the pressure in the inlet galley 541 reaches a burst pressure of the disc.

It will be understood that this configuration is useful if the tractor gets stuck in the borehole or if any downhole equipment of the BHA needs assistance in being removed, the reverser valve can be actuated. In this configuration, the tractor will normally be inserted into a borehole with the reverser valve 550 in its first position (the position shown in FIG. 17). The burst disc prevents fluid within the inlet galley 541 from exerting a pressure force on the spool of the valve 550. When it is desirable to reverse the direction of tractor motion, the pressure in the inlet galley 541 can be increased to the burst pressure of the burst disc. The burst disc will then burst or open to allow the fluid pressure within the inlet galley to move the spool of the valve 550 to its second position (shifted to the right in FIG. 17). Since the spring 554 is removed from this design, the valve 550 will not change its position. Optionally, stops or detents can be provided to prevent inadvertent shifting of the spool, such as the stops 434, 436 illustrated in FIG. 10. The burst pressure of the burst disc is preferably between 2500 and 7000 psid, and more preferably about 3200 psid. Preferably, the burst pressure of the disc is greater than the shifting threshold of the inlet control valve 542.

Electrically Controlled Reverser Valve

Figure 18:
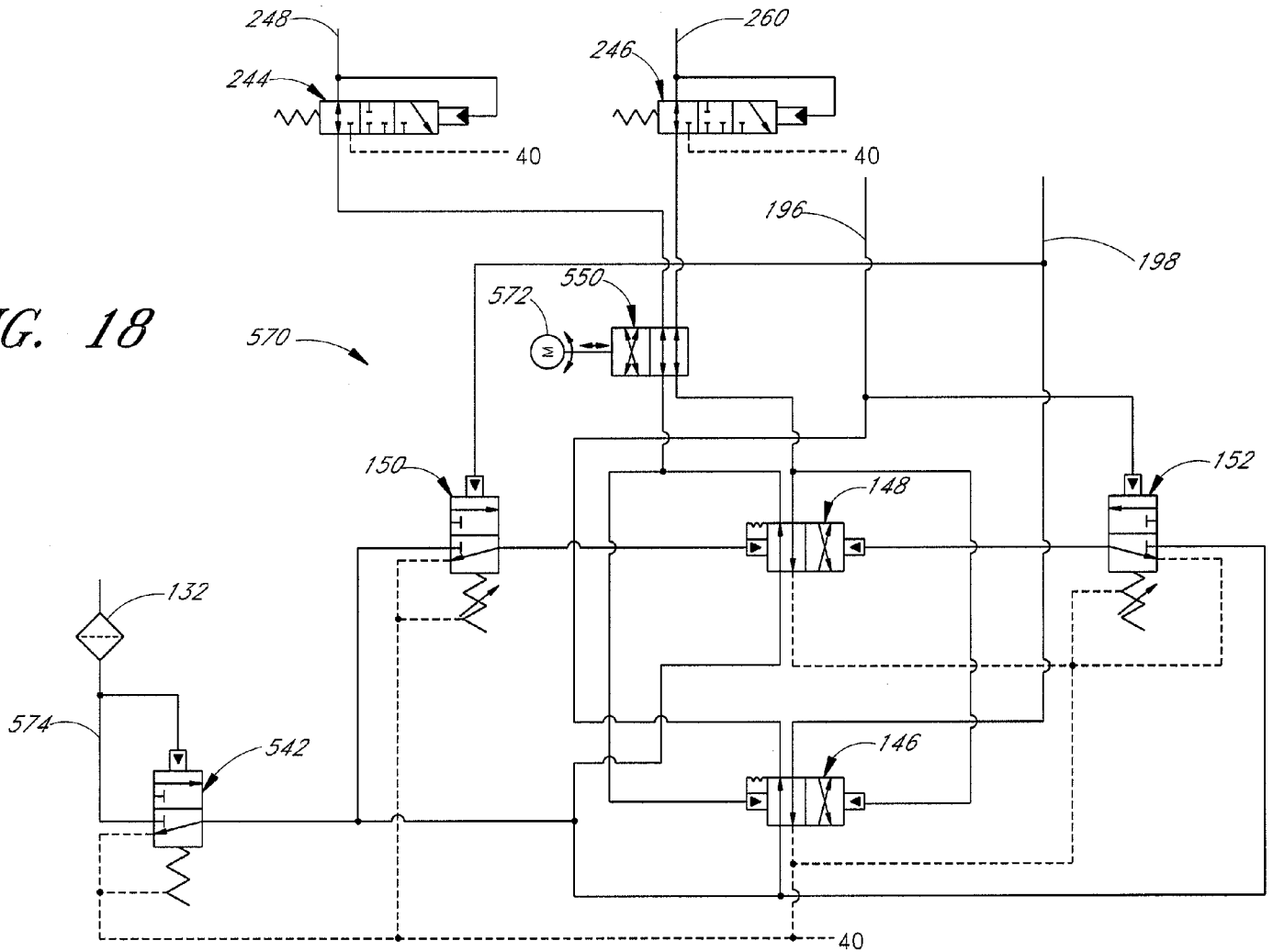
FIG. 18 is a schematic diagram illustrating a valve system according to another alternative embodiment of a tractor of the invention, which includes an electrically controlled reverser valve.

FIG. 18 illustrates a valve system 570 for a tractor according to another alternative embodiment of the invention. Like the valve system 540 of FIG. 17, the valve system 570 permits the direction of travel of the tractor to be controlled. With the exception of a number of modifications discussed below, the valve system 570 is configured substantially similarly to the valve system 540. Elements of the valve system 570 are labeled with the reference numbers of analogous elements of the valve system 540. However, the inlet galley 574 of the valve system 570 is different than the inlet galley 541 of the valve system 540. Also, the reverser valve 550 is controlled differently.

The inlet galley 574 of the valve system 570 does not extend to the reverser valve, as in the valve system 540. This is because the reverser valve 550 of the system 570 is not piloted by fluid pressure. Instead, a motor 572 controls the position of the spool of the reverser valve. In a preferred configuration, the output shaft of the motor 572 is coupled to a leadscrew, and a traversing nut is threadingly engaged with the leadscrew. The nut is coupled to the spool of the reverser valve 550, preferably via a flexible stem. As the leadscrew rotates with the motor output, the nut traverses the leadscrew and thereby moves the spool. The position of the spool can be controlled by controlling the amount of rotation of the motor output shaft. An assembly for controlling the position of a valve spool with a motor, within a tractor, is illustrated and described in U.S. Pat. No. 6,347,674.

Preferably, the motor 572 is controlled by electronic signals sent from a remote location (such as from ground surface equipment) or even from a programmable logic controller on the tractor itself.

It will be understood that the position of the spool of the reverser valve 550 can alternatively be controlled via solenoids or other electronic means.

Electrical Control of Fluid Entry

Figure 19:
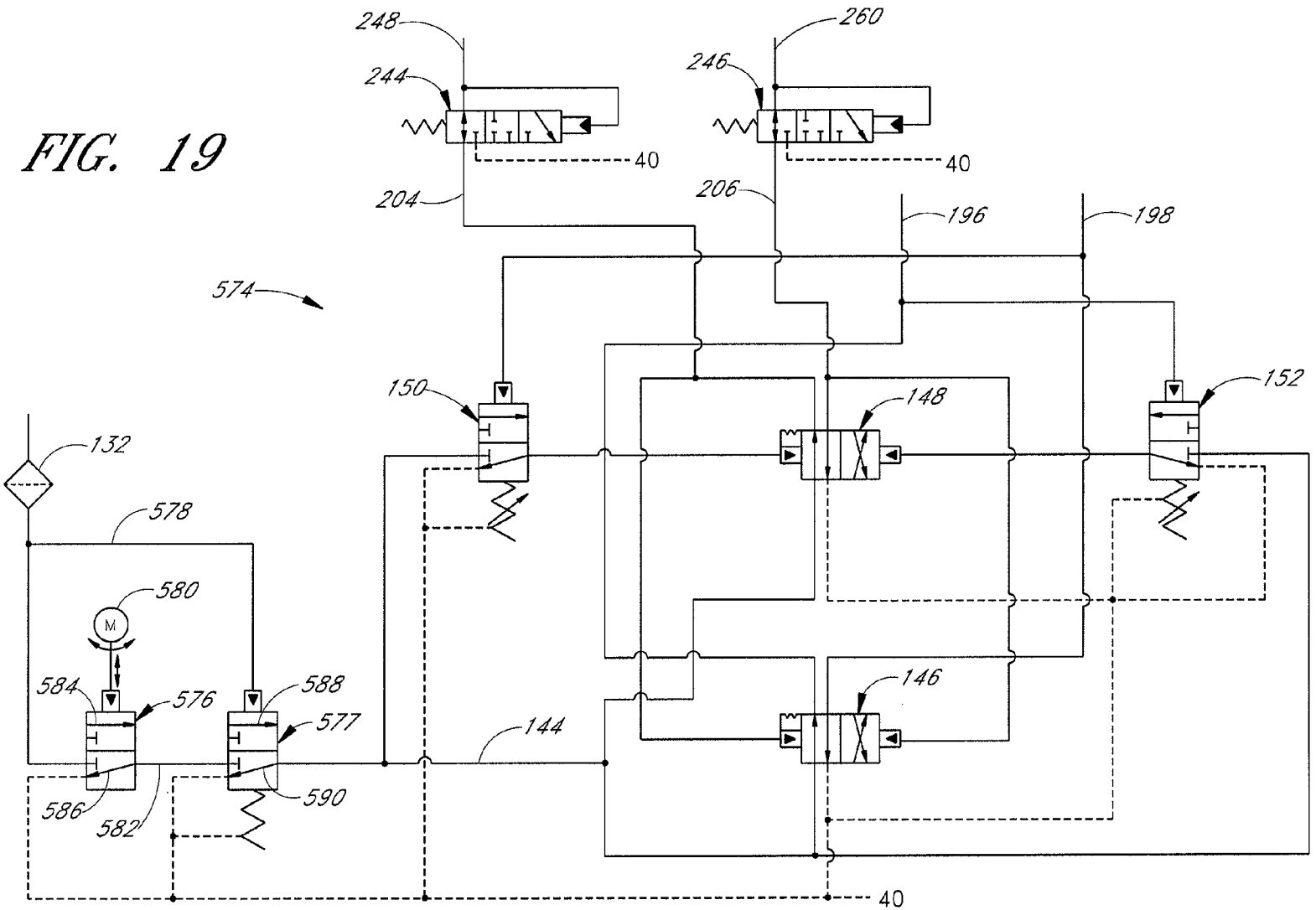
FIG. 19 is a schematic diagram illustrating a valve system according to yet another alternative embodiment of a tractor of the invention, which includes a pair of inlet control valves, one hydraulically controlled and the other electrically controlled to provide electric starting or stopping of the tractor.

FIG. 19 illustrates a valve system 574 for a tractor according to yet another alternative embodiment of the invention. As explained below, the valve system 574 provides electronic control of whether the tractor is "on" or "off." With the exception of a number of modifications discussed below, the valve system 574 is configured substantially similarly to the valve system 133 shown in FIG. 3. Elements of the valve system 574 are labeled with the reference numbers of analogous elements of the valve system 133.

The valve system 574 includes an inlet galley 578, a pair of inlet control valves 576 and 577, and a fluid chamber 582. The inlet galley 578 extends to both of the valves 576 and 577. The chamber 582 extends between the valves 576 and 577. Preferably, the valve 576 comprises a spool valve. The valve 576 is controlled by a motor 580, and can be configured similarly to the reverser valve 550 of the valve system 570 (FIG. 18). It will be understood that the position of the spool can alternatively be controlled via solenoids or other electronic means. The spool of the valve 576 has a first "closed" position (shown in FIG. 19) in which the valve 576 provides a flow path (represented by arrow 586) for fluid within the chamber 582 to flow into the annulus 40, and in which fluid within the inlet galley 578 is prevented from flowing through the valve 576 into the chamber 582. The spool of the valve 576 also has a second "open" position (shifted vertically downward in FIG. 19) in which the valve 576 provides a flow path (represented by arrow 584) for fluid within the inlet galley 578 to flow into the chamber 582, and in which fluid within the chamber 582 is prevented from flowing through the valve 576 into the annulus 40.

The valve 577 preferably comprises a spool valve and is preferably configured substantially similarly to the valves 542 of FIGS. 17 and 18. The spool of the valve 577 has a first "closed" position (shown in FIG. 19) in which the valve 577 provides a flow path (represented by arrow 590) for fluid within the main galley 144 to flow into the annulus 40, and in which fluid within the chamber 582 is prevented from flowing into the main galley 144. The spool of the valve 577 also has a second "open" position (shifted vertically downward in FIG. 19) in which the valve 577 provides a flow path (represented by arrow 588) for fluid within the chamber 582 to flow into the main galley 144, and in which fluid within the main galley 144 is prevented from flowing through the valve 577 into the annulus 40.

The pair of inlet control valves 576 and 577 operate to control the flow of fluid into the remainder of the valve system 574. The hydraulically controlled valve 577 shifts to its "open" position only when the fluid in the inlet galley 578 exceeds the threshold pressure associated with the valve 577. Regardless of the position of the valve 576, when the valve 577 is closed the fluid within the main galley 144 flows through the valve 577 into the annulus 40. Thus, when the pressure in the inlet galley 578 is below the threshold associated with the valve 577, the tractor is "off." In other words, the valve 577 is a failsafe valve to deactivate the tractor in case of control system failure. The electrically controlled valve 576 provides additional control. When the valve 576 is closed, the tractor is "off," regardless of the position of the valve 577. Even if the valve 577 is open when the valve 576 is closed, fluid within the main galley 144 flows through the valve 577, the chamber 582, the valve 576, and into the annulus 40. The tractor is "on" only when both the valves 576 and 577 are open. In such a condition, fluid within the inlet galley 578 flows through the valve 576, the chamber 58, the valve 577, and into the main galley 144. Thus, fluid flows into the remainder of the valve system 574 only when (1) the pressure in the inlet galley 578 exceeds the threshold associated with the valve 577 and (2) the valve 576 is shuttled to its "open" position.

Electrical Control of Fluid Entry and Reverse Motion

Figure 20:
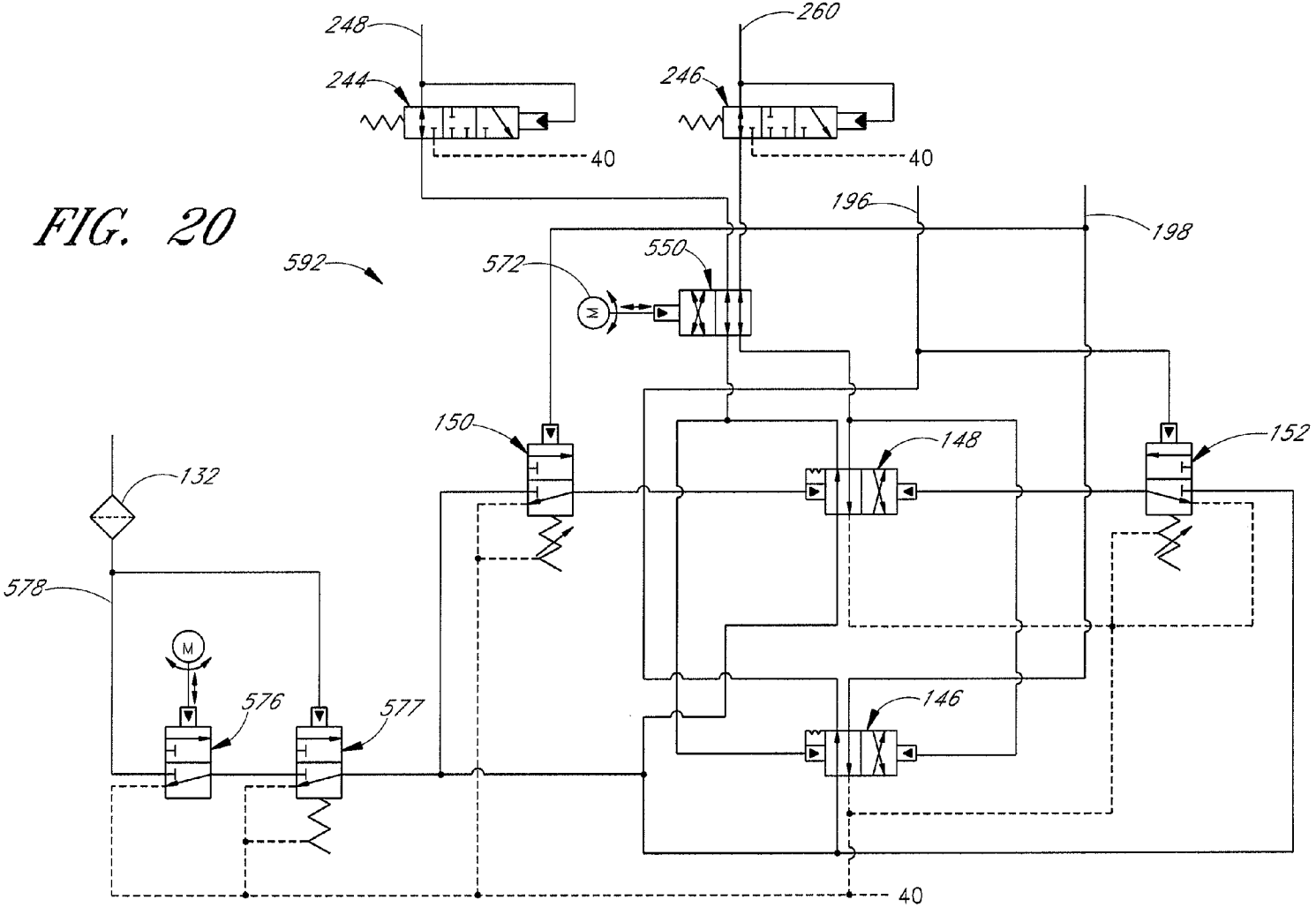
FIG. 20 is a schematic diagram illustrating a valve system according to yet another alternative embodiment of a tractor of the invention, which includes both the pair of inlet control valves of the valve system of FIG. 19 and the electrically controlled reverser valve of the valve system of FIG. 18.

FIG. 20 illustrates a valve system 592 for a tractor according to yet another alternative embodiment of the invention. The valve system 592 comprises a combination of the valve systems 570 (FIG. 18) and 574 (FIG. 19). The valve system 592 includes a pair of inlet control valves 576 and 577, configured similarly to analogous valves of the valve system 570. In particular, the valve 576 is electrically controlled and the valve 577 is hydraulically controlled. The valve system 592 also includes an electrically controlled reverser valve 550, configured similarly to the analogous valve of the valve system 574. Thus, the valve system 592 permits electrical control of (1) the on/off state of the tractor and (2) the direction of tractor motion.

Gripper Assemblies

As mentioned above, the gripper assemblies 104 and 106 are preferably configured in accordance with a design illustrated and described in a U.S. patent application Ser. No. 10/004,963, entitled "GRIPPER ASSEMBLY FOR DOWNHOLE TRACTORS," filed on Dec. 3, 2001, now U.S. Pat. No. 6,715,559. FIGS. 21-34 illustrate a preferred configuration of such a gripper assembly. Below is a brief description of the configuration and operation of the illustrated gripper assembly. For a more detailed description, please refer to the above-referenced application.

Figure 21:
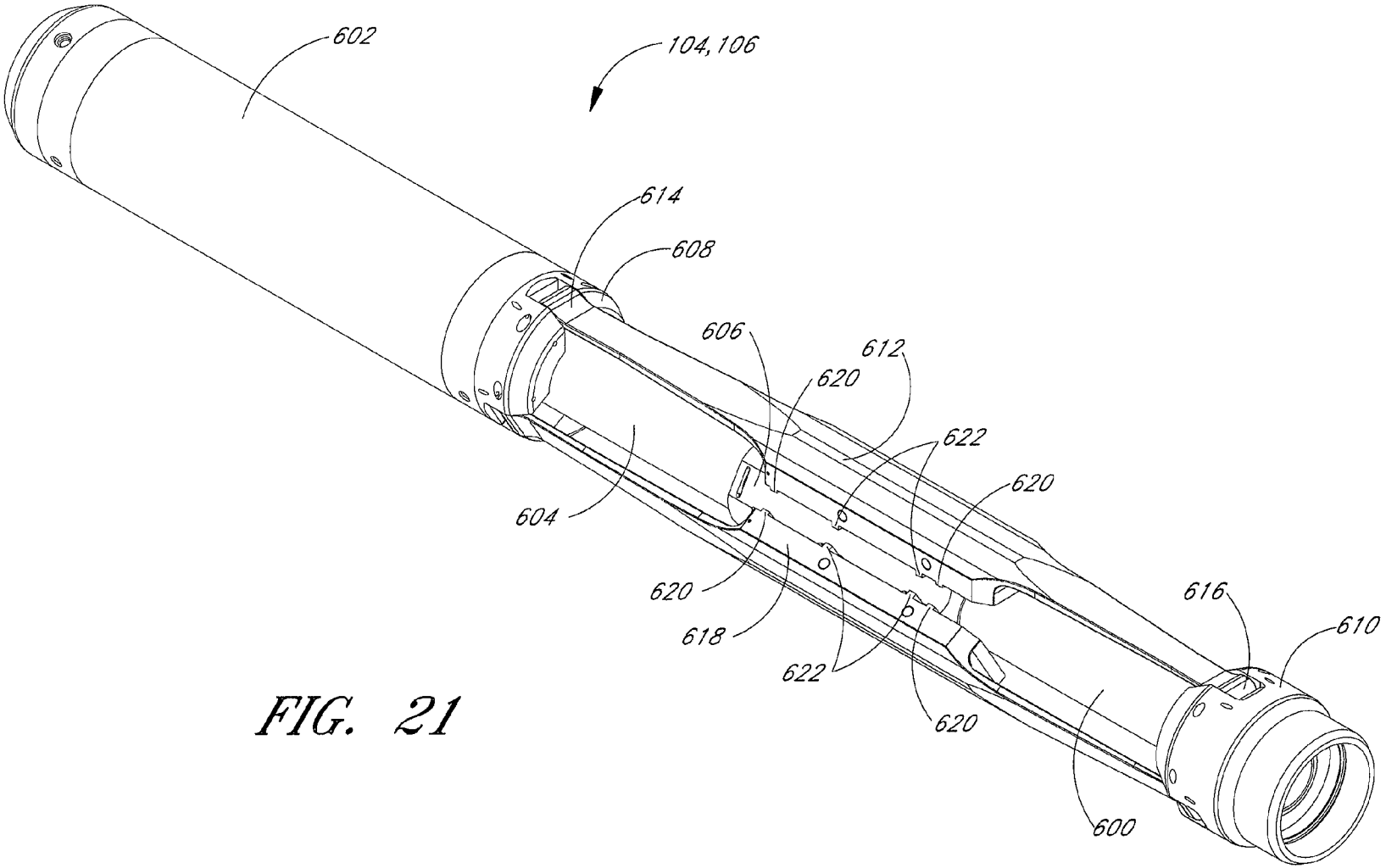
FIG. 21 is a perspective view of a preferred embodiment of a gripper assembly having flexible toes with rollers.
Figure 25:
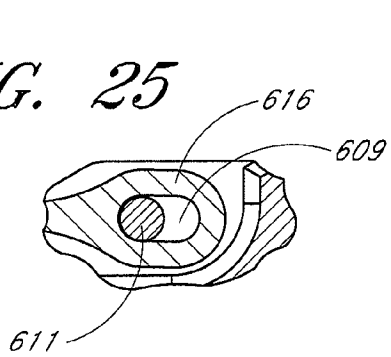
FIG. 25 is an exploded view of the forward end of the toe shown in FIG. 22.

In a preferred embodiment, the gripper assemblies 104 and 106 are substantially identical. Thus, the gripper assembly configuration shown in FIGS. 21-34 describes both assemblies 104 and 106. In FIG. 21, the gripper assembly is shown with its aft end on the left and its forward end on the right. The gripper assembly includes an elongated mandrel 600, a cylinder 602 engaged on the mandrel, toe supports 608 and 610, a tubular piston rod 604, a slider element 606, and three flexible toes or beams 612. The mandrel 600 surrounds and is free to slide longitudinally with respect to the shafts 118 and 124 (FIG. 2) of the tractor. When used for non-drilling applications, the mandrel 600 is preferably also free to rotate with respect to the shafts (i.e., there are no splines that prevent rotation). This is because it is generally not necessary to transmit torque to the borehole wall for non-drilling applications. The ends 614 and 616 of the toes 612 are pivotally secured to the toe supports 608 and 610, respectively. The cylinder 602 and the toe support 608 are fixed with respect to the mandrel 600, while the toe support 610 is free to slide longitudinally along the mandrel. The piston rod 604 and the slider element 606 are fixed with respect to each other and are together slidably engaged on the mandrel 600. The cylinder 602 encloses an annular piston (not shown) that is fixed with respect to the piston rod 604 and slider element 606 and also slidably engaged on the mandrel 600. The piston is biased in the aft direction by a return spring (not shown) that is also enclosed within the cylinder 602.

With reference to FIGS. 21-25, the central region of each toe 612 has a recess 624 (FIG. 24) formed in the inner radial surface of the toe. The recess 624 is formed between two axial sidewalls 618 of the toe 612. The recess 624 includes two rollers 626 on axles 628 secured within the sidewalls 618. The slider element 606 includes three pairs of ramps 630, each pair aligned with one of the toes 612. The ramps 630 are radially interior of the toes 612. As the slider element 606 slides forward, each roller 626 rolls up one of the ramps 630, causing the central regions of the toes 612 to bend radially outward to grip onto a borehole surface. As the slider element 606 slides aftward, the rollers 626 roll down the ramps 630, causing the toes 612 to relax back to the position shown in FIGS. 21 and 22.

The gripper assembly is actuated by pressurized operating fluid supplied to the cylinder 602, on the aft side of the enclosed piston. The pressurized fluid causes the piston, piston rod 604, and the slider element 606 to slide forward against the force of the return spring. As explained above, this causes the rollers 626 to roll up the ramps 630 and deflect the toes 612 radially outward. The toe support 610 freely slides aftward to accommodate the deflection of the toes 612. The gripper assembly is retracted by reducing the pressure aft of the piston, which causes the return spring to push the piston, piston rod 604, and slider element 606 aftward. The rollers 626 roll down the ramps 630, allowing the toes 612 to relax.

Figure 24:
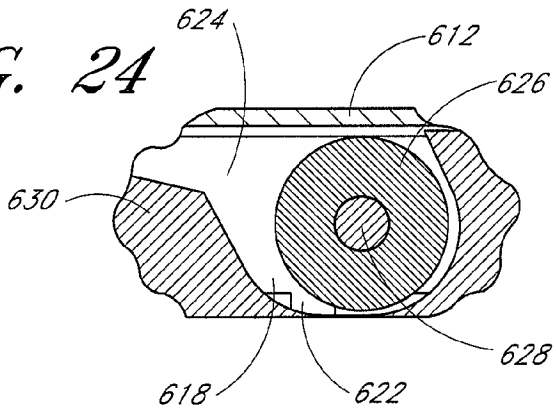
FIG. 24 is an exploded view of one of the rollers of the toe shown in FIG. 22.
Figure 23:
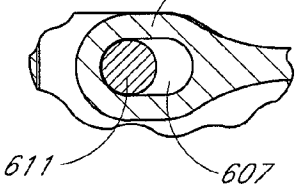
FIG. 23 is an exploded view of the aft end of the toe shown in FIG. 22.
Figure 22:
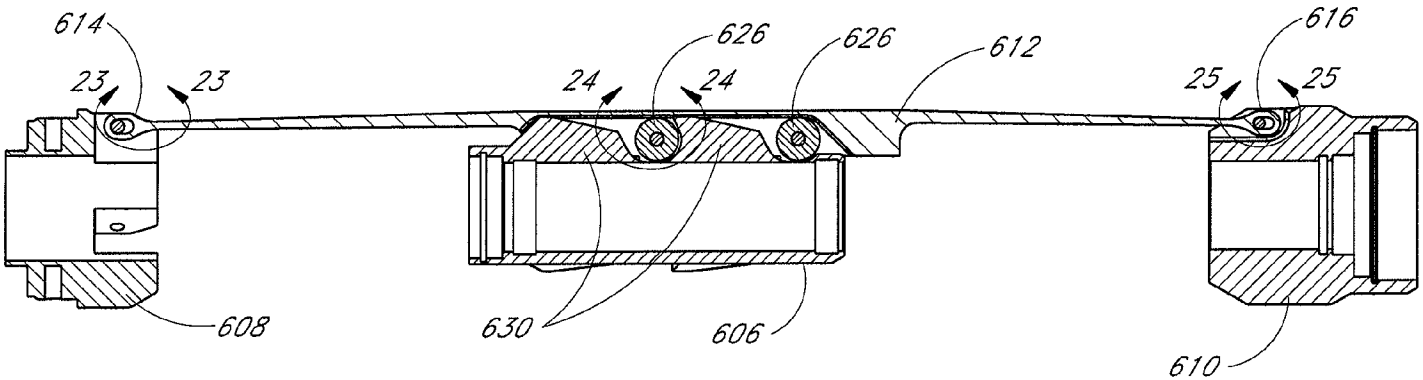
FIG. 22 is a longitudinal sectional view of the toe supports, slider element, and a single toe of the gripper assembly of FIG. 21, shown at a moment when there is substantially no external load applied to the toe.
Figure 29:
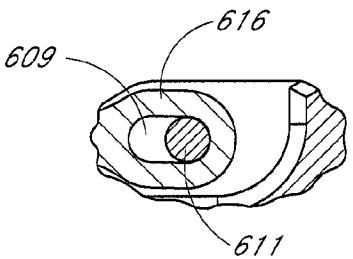
FIG. 29 is an exploded view of the forward end of the toe shown in FIG. 26.
Figure 28:
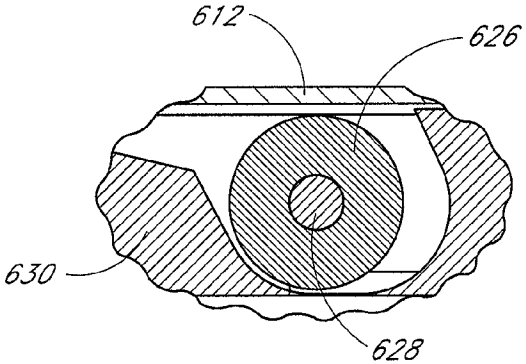
FIG. 28 is an exploded view of one of the rollers of the toe shown in FIG. 26.
Figure 27:
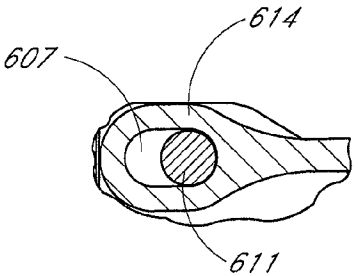
FIG. 27 is an exploded view of the aft end of the toe shown in FIG. 26.
Figure 26:
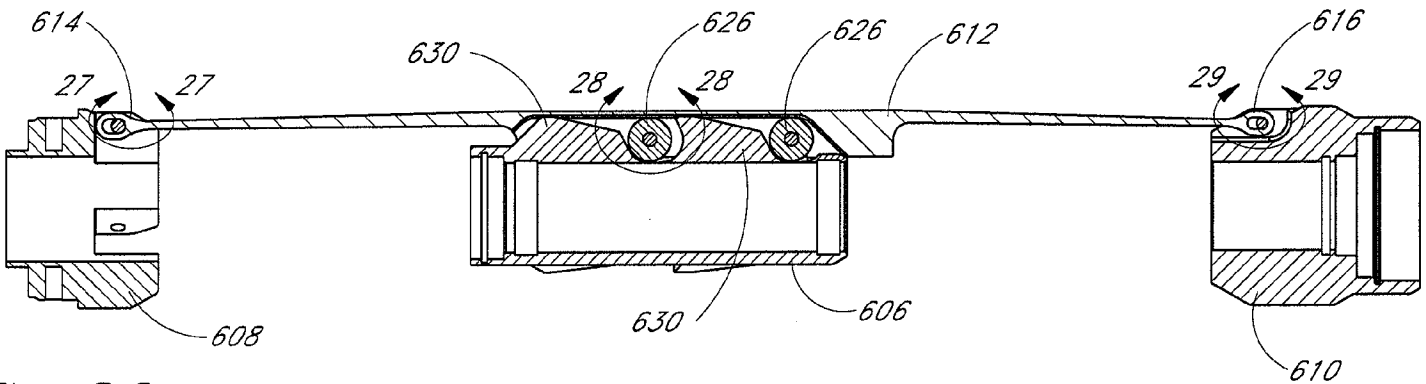
FIG. 26 is a longitudinal sectional view of the toe supports, slider element, and a single toe of the gripper assembly of FIG. 21, shown at a moment when an external load is applied to the toe.

FIGS. 22-29 illustrate the design of the toes 612, toe supports 608 and 610, and the slider element 606. The ends 614 and 616 of the toes 612 include elongated slots 607 and 609, respectively. The slots receive axles 611 secured to the toe supports 608 and 610. The slots 607 and 609 reduce potentially dangerous compression loads in the toes 612 when the toes experience external forces (e.g., sliding friction against the borehole surface). FIGS. 22-25 show a toe 612 in a normal position with respect to the (retracted) slider element 606 and toe supports 114 and 116, as the toe will shift forward due to gravity. FIGS. 26-29 show the toe 612 in a shifted position, which occurs when the toe experiences an aftwardly directed external force. As shown in FIGS. 24 and 28, as the toes 612 shift axially between these positions, the aft rollers 626 remain between the ramps 630 without rolling up the aft ramps. In other words, external forces applied to the toes do not cause the gripper assembly to self-energize.

Figure 32:
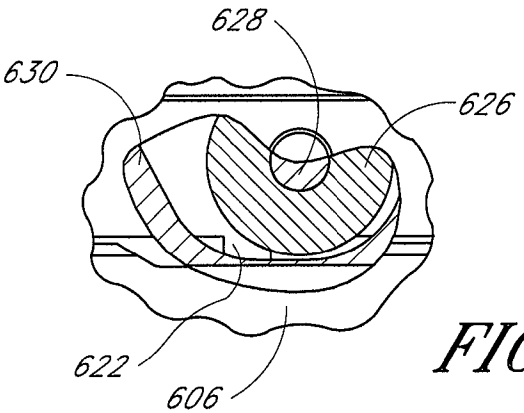
FIG. 32 is an exploded view of one of the rollers of the toe shown in FIG. 30.
Figure 31:
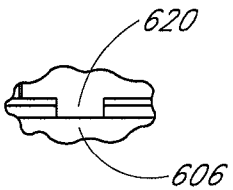
FIG. 31 is an exploded view of one of the spacer tabs of the toe shown in FIG. 30.
Figure 30:
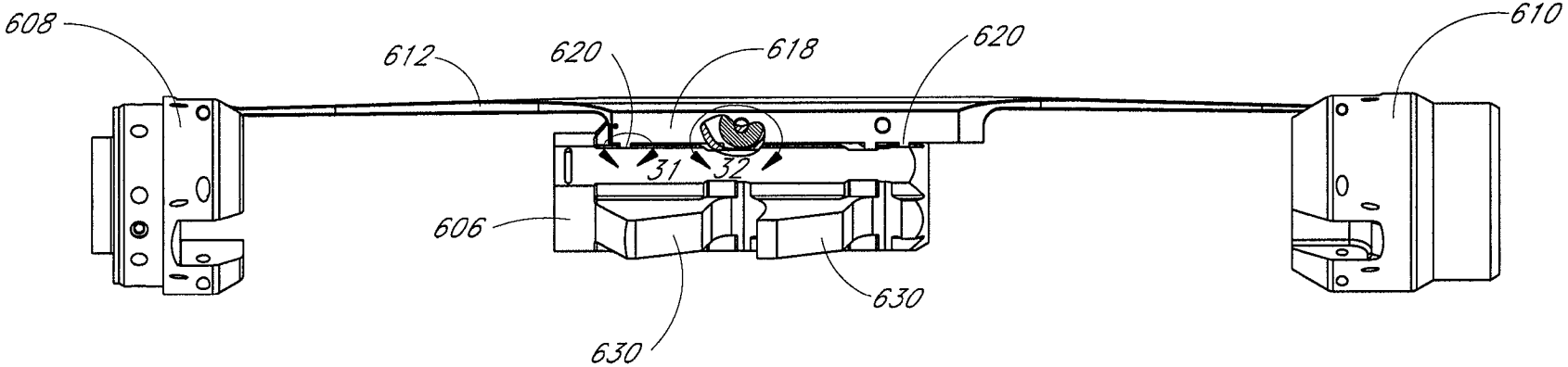
FIG. 30 is a partial cut-away side view of the toe supports, slider element, and a single toe of the gripper assembly of FIG. 21, shown at a moment when the toe is relaxed.

As shown in FIGS. 30 and 31, each toe 612 includes four spacer tabs 620 that extend radially inward from the toe's sidewalls 618. Two spacer tabs 620 are positioned on each sidewall 618, one tab near each end of the sidewall. The spacer tabs 620 are configured to bear against the slider element 606 when the toes 612 are relaxed. Also, as shown in FIG. 32, when the toes 612 are relaxed the rollers 626 do not contact the slider element 606. Thus, when the toes 612 are relaxed, the spacer tabs 620 absorb radial loads between the toes and the slider element 606 and also prevent undesired loading of the rollers 626 and roller axles 628.

Figure 34:
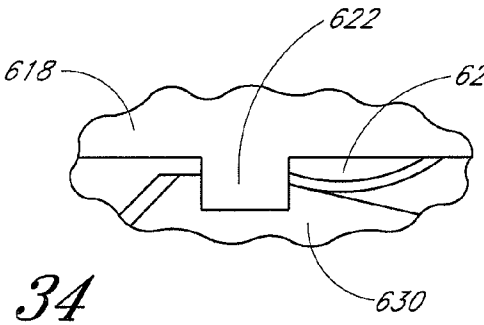
FIG. 34 is an exploded view of one of the alignment tabs of the toe shown in FIG. 33.
Figure 33:
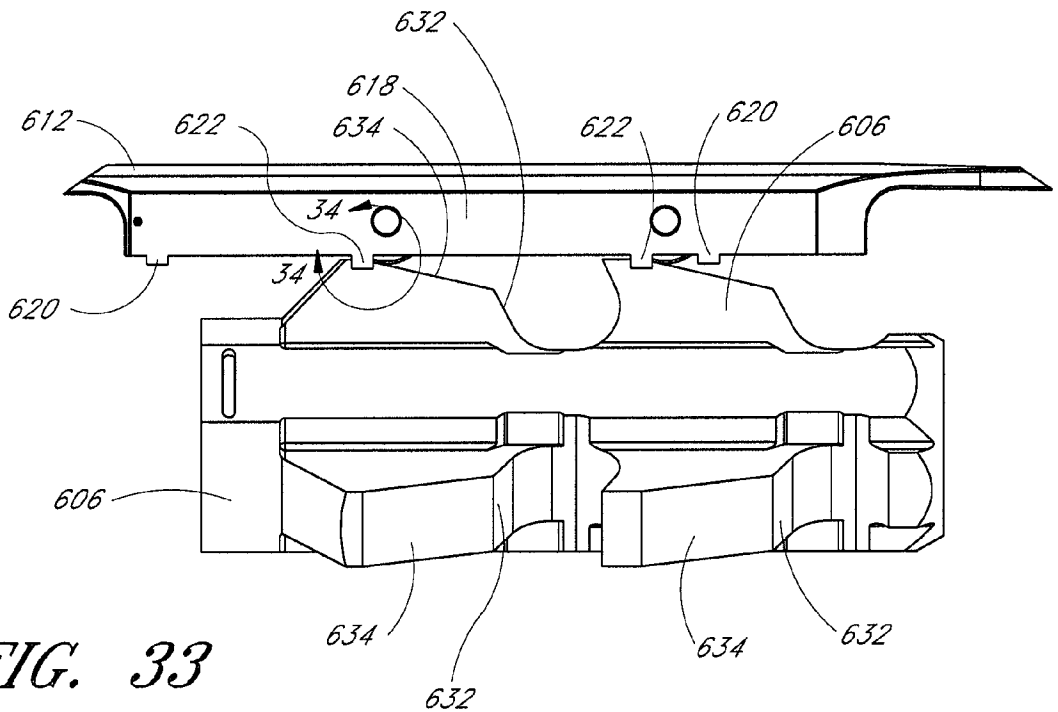
FIG. 33 is a side view of the slider element and a portion of one of the toes of the gripper assembly of FIG. 21, shown at a moment when the toe is radially deflected or energized.

As shown in FIGS. 33 and 34, each toe 612 includes four alignment tabs 622 that, like the spacer tabs 620, extend radially inward from the toe's sidewalls 618. A pair of alignment tabs 622 is provided for each of the ramp/roller combinations, one tab on each sidewall 618. Each pair of alignment tabs 622 straddles one of the ramps 630 and thus maintains the alignment between the roller 626 and the ramp. The alignment tabs 622 prevent the rollers 626 from sliding off of the sides of the ramps 630, particularly when the rollers are near the radial outward ends or tips of the ramps.

With reference to FIG. 33, each ramp 630 of the slider element 606 is configured to have a relatively steeper initial inclined surface 632 followed by a relatively shallower inclined surface 634. This causes the toes 612 to deflect radially outward at an initially high rate, followed by a low rate of deflection. Advantageously, during actuation of the gripper assembly, the toes 612 quickly approach the borehole surface. Before the toes 612 contact the borehole, the rate of expansion is slowed as the rollers roll along the shallower surfaces 634, to permit a degree of fine tuning of the radial expansion.

The gripper assemblies 104 and 106 are preferably formed of CuBe, but other materials can be employed. For example, the flexible toes can be formed of Titanium, and the mandrel can be formed of steel.

It will be understood that the tractor 100 can be utilized with any of a variety of different types of gripper assemblies. For example, U.S. Pat. No. 6,464,003 discloses a compatible gripper assembly in which toggles are utilized to radially expand flexible toes that grip a passage surface. Many compatible gripper designs comprise packerfeet. For example, U.S. Pat. No. 6,003,606 to Moore et al. discloses packerfeet that include borehole engagement bladders. Another reference, U.S. Pat. No. 6,347,674, discloses one packerfoot design having bladders strengthened by attached flexible toes and another packerfoot design in which the bladders and toes are not attached. Yet another reference, U.S. Pat. No. 6,431,291, discloses an improved packerfoot design.

Figure 35:
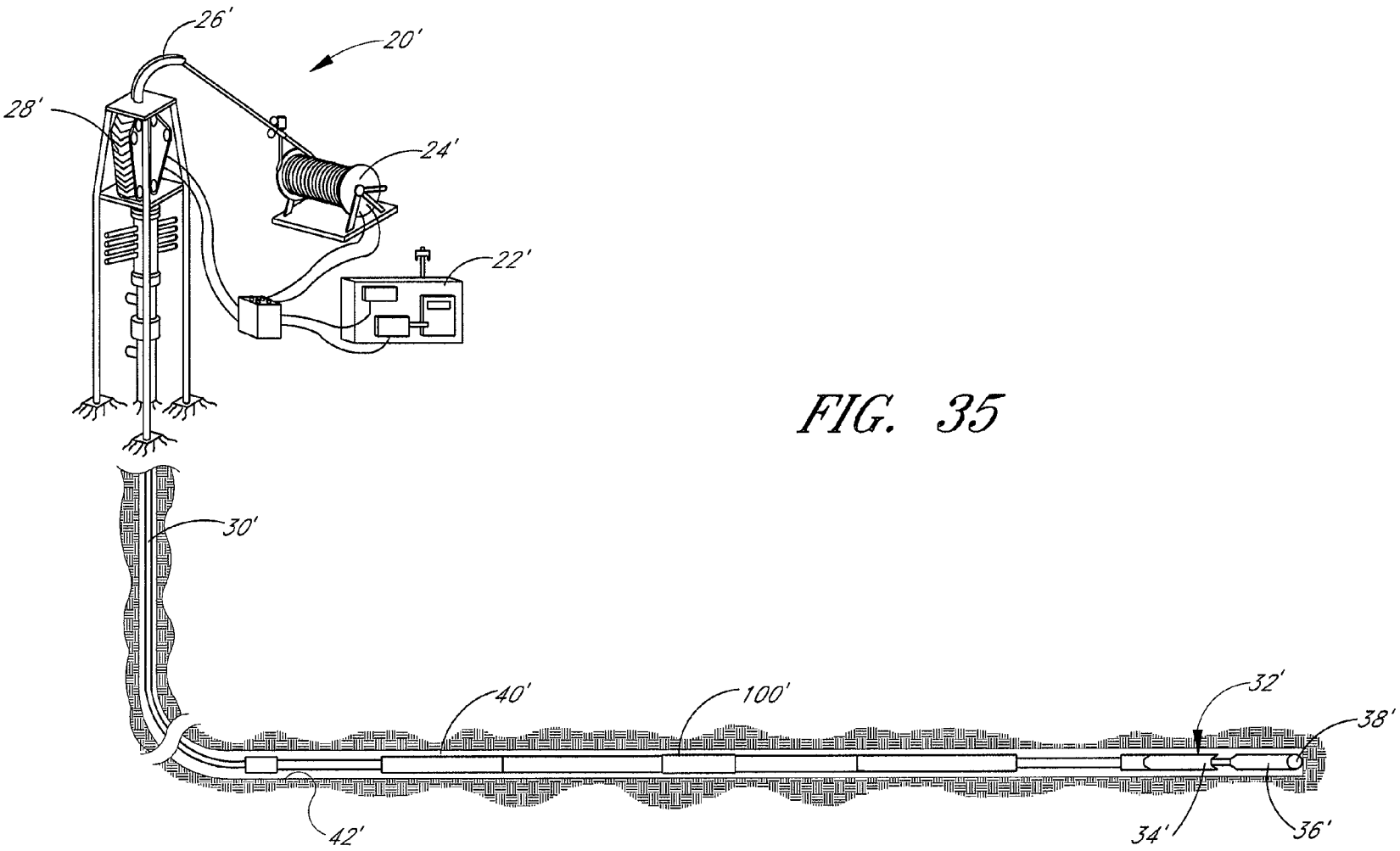
FIG. 35 is a schematic diagram of the major components of one embodiment of a tractor of the present invention, utilized in conjunction with a coiled tubing system.

FIG. 35 is a schematic diagram illustrating a hydraulic tractor 100' during use for moving equipment within a passage. The tractor is shown being used in conjunction with a coiled tubing drilling system 20' and adjoining downhole equipment 32'. The coiled tubing drilling system 20' may include a power supply 22', tubing reel 24', tubing guide 26', tubing injector 28', and coiled tubing 30', all of which are well known in the art. The tractor 100' is configured to move within a borehole having an inner surface 42'. An annulus 40' is provided in the space between the outer surface of the tractor 100' and the inner surface 42' of the borehole.

The downhole equipment 32' may include various types of equipment that the tractor 100' is designed to move within the passage. For example, the equipment 32' may comprise a perforation gun assembly, an acidizing assembly, a sand-washing assembly, a bore plug setting assembly, an E-line, a logging assembly, a bore casing assembly, a measurement while drilling (MWD) assembly, or a fishing tool. Alternatively, the equipment 32' may comprise a combination of these items. If the tractor 100' is used for drilling, the equipment 32' will preferably include an MWD system 34', a downhole motor 36', and a drill bit 38', all of which are also known in the art. Of course, the downhole equipment 32' may include many other types of equipment for non-drilling applications, such as intervention and completion applications. While the equipment 32' is illustrated on the forward end of the tractor, in alternative configurations, the downhole equipment may be connected aft and/or forward of the tractor.

It will be appreciated by those skilled in the art that a hydraulic tractor of the type shown may be used to move a wide variety of tools and equipment within a borehole or other passage. For example, the tractor can be utilized for well completion and production work, pipeline installation and maintenance, laying and movement of communication lines, well logging activities, washing and acidizing of sands and solids, retrieval of tools and debris, and the like. Also, while preferred for intervention operations, the tractor may also be used for drilling applications, including petroleum drilling and mineral deposit drilling. The tractor can be used in conjunction with different types of drilling equipment, including rotary drilling equipment and coiled tubing equipment.

One of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. With the help of a tractor, these completion activities can be accomplished in a variety of inclined and horizontal boreholes. For instance, the tractor can deliver these various types of logging sensors to regions of interest. The tractor can either place the sensors in the desired location, or it can idle in a stationary position to allow the measurements to be taken at the desired locations. The tractor can also be used to retrieve the sensors from the well.

Examples of production work that can be performed with a hydraulic tractor include sands and solids washing and acidizing. It is known that wells sometimes become clogged with sand, hydrocarbon debris, and other solids that prevent the free flow of oil through the borehole. To remove this debris, specially designed washing tools are delivered to the region and fluid is injected to wash the region. The fluid and debris then return to the surface. Such tools include acid washing tools. These washing tools can be delivered to the region of interest for performance of washing activity and then returned to the ground surface by a preferred embodiment of the tractor of the invention.

In another example, a hydraulic tractor can be used to retrieve objects, such as, for example, damaged equipment and debris, from the borehole. Equipment may become separated from the drill string, or objects may fall into the borehole. These objects must be retrieved, or the borehole must be abandoned and plugged. Because abandonment and plugging of a borehole is very expensive, retrieval of the object is usually preferred if possible. A variety of retrieval tools known to the industry are available to capture these lost objects. In use, the tractor is used to transport retrieving tools to the appropriate location, retrieve the object, and then return the retrieved object to the surface.

In yet another example, a hydraulic tractor can be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The tractor can be used in conjunction with the deployment of conventional velocity string and simple primary production tubing installations. The tractor can also be used with the deployment of artificial lift devices such as gas lift and downhole flow control devices.

In yet another example, a tractor can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the tractor so that the cleaning tools can be moved within the pipeline.

In still another example, a tractor can be used to move communication lines or equipment within a passage. Frequently, it is desirable to run or move various types of cables or communication lines through various types of conduits. The tractor can move these cables to the desired location within a passage.

Overview of Tractor Components

Figure 36:
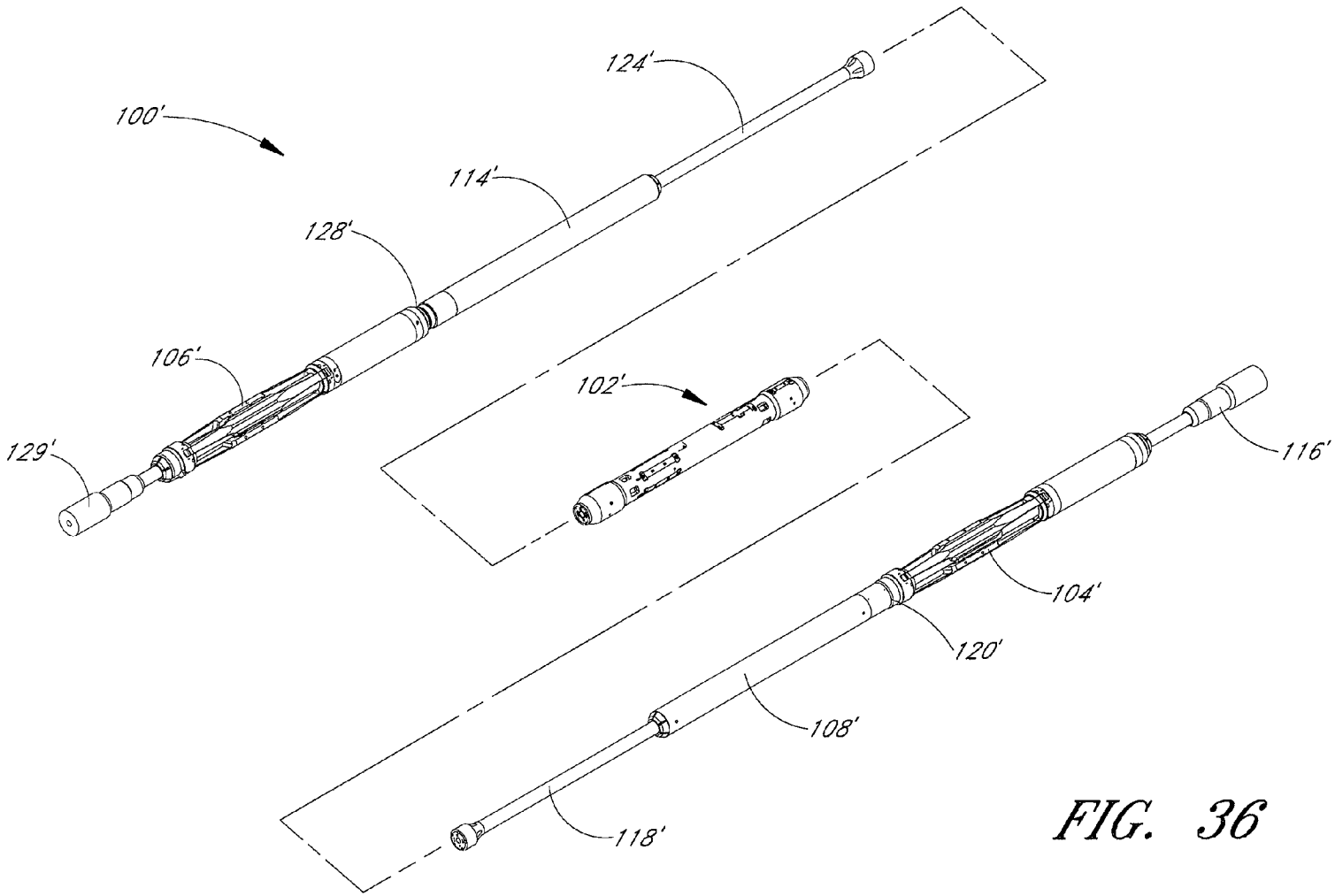
FIG. 36 is a front perspective view of a preferred embodiment of the tractor.

FIG. 36 illustrates one preferred embodiment of the tractor 100', shown with the aft end on the left and the forward end on the right. The tractor 100' generally comprises a central control assembly 102', an aft gripper assembly 104', a forward gripper assembly 106', an aft propulsion cylinder 108', a forward propulsion cylinder 114', an aft shaft assembly 118', a forward shaft assembly 124', tool joint assemblies 116' and 129', and flex joints or adapters 120' and 128'. The tool joint assembly 116' is disposed along the aft end of the aft shaft assembly 118' for connecting the drill string (e.g., coiled tubing) to the aft shaft assembly 118'. The aft gripper assembly 104', aft propulsion cylinder 108', and flex joint 120' are assembled together end-to-end and are all axially slidably engaged with the aft shaft assembly 118'. Similarly, the forward gripper assembly 106', forward propulsion cylinders 114', and flex joint 128' are assembled together end-to-end and are axially slidably engaged with the forward shaft assembly 124'. The tool joint assembly 129' is preferably configured for coupling the tractor 100' to downhole equipment 32', as shown in FIG. 35. The aft shaft assembly 118', the control assembly 200' and the forward shaft assembly 124' are axially fixed with respect to one another and are generally referred to herein as the body of the tractor. Conventionally, the body of the tractor is axially fixed with respect to the drill string and the downhole tools.

The gripper assemblies 104', 106' and propulsion cylinders 108', 114' are axially slidable along the body for providing the tractor 100' with the capability of pulling and/or pushing downhole equipment 32' of various weights through the borehole (or passage). In one embodiment, the tractor 100' is capable of pulling and/or pushing a total weight of 100 lbs, in addition to the weight of the tractor itself. In various other embodiments, the tractor is capable of pulling and/or pushing a total weight of 500, 3000, and 15,000 lbs.

In order to prevent damage to a surrounding formation or casing wall, the gripper assemblies 104', 106' are preferably constructed to limit the radial gripping load (i.e., force) exerted on a surface. In one embodiment, the gripper assemblies 104', 106' exert no more than 25 psi on a surface surrounding the tractor. This embodiment is particularly useful in softer formations, such as gumbo. In various other embodiments, the gripper assemblies 104', 106' exert no more than 100, 3000, and 50,000 psi on a surface surrounding the tractor. At radial gripping loads of 50,000 psi or less, the tractor generally can be used safely in steel tube casing.

The tractor 100' preferably receives pressurized operating fluid from a supply source at the surface. A supply line extends down from the surface and passes through an internal passage in the tractor for supplying operating fluid to the downhole equipment. As the operating fluid passes through the internal passage, a portion of the operating fluid is diverted into the control assembly 102' for providing hydraulic power to the tractor. More particularly, the control assembly 102' houses a valve system that distributes operating fluid to and from the gripper assemblies 104', 106' and the propulsion cylinders 108', 114' for controlling tractor movement. Preferred embodiments of the control assembly and the valve system are described in more detail below. Using the specification and figures of the present application along with the principles of design and space management known to those skilled in the art through Applicant's co-owned U.S. Pat. No. 6,347,674 and U.S. Publication No. 2002/0112859 A1, one of ordinary skill in the art will understand how to build a tractor having an improved valve system as described herein.

The tractor 100' can be any desirable length, but for oilfield applications the length is typically approximately 25 to 35 feet. The maximum diameter of the tractor will vary with the size of the hole, thrust requirements, and the restrictions that the tractor must pass through. The gripper assemblies 104', 106' can be designed to operate within boreholes of various sizes, but typically are configured to expand to a diameter of 3.75 to 7.0 inches.

The flex adapters 120' and 128' are preferably hollow structural members that provide a region of reduced flexural rigidity (i.e., increased flexibility). This region of reduced flexural rigidity facilitates the tractor's ability to negotiate sharp turns. In one preferred embodiment, the adapters are formed of a relatively low modulus material such as Copper Beryllium (CuBe) and/or Titanium. Occasionally, there are applications that require the use of non-magnetic materials for the tractor. Otherwise, depending on the required turning capability of the tractor and resultant stresses, various stainless steels may be used in many areas of the tractor.

The tool joint assembly 116' preferably couples the aft end of the aft shaft assembly 118' to a coiled tubing drill string, preferably via a threaded connection. As discussed above, downhole equipment may also be placed at the aft end of the tractor, connected to the tool joint assembly 116'. However, in a typical operation, the tool joint assembly 129' will be coupled to downhole equipment. The interface threads of the tool joint assemblies are preferably API threads or proprietary threads (such as Hydril casing threads). The tool joint assemblies can be prepared with conventional equipment (tongs) to a specified torque (e.g., 1000-3000 ft-lbs). The tool joint assemblies can be formed from a variety of materials, including CuBe, steel, and other metals.

As discussed above, the aft and forward shaft assemblies 118' and 124', along with the control assembly 102', form the body of the tractor 100'. The aft and forward shaft assemblies 118' and 124' are each preferably formed with a segment having an expanded diameter that forms a piston. Preferably, the aft and forward pistons have outer diameters that are substantially similar to the inner diameters of the aft and forward propulsion cylinders 104', 108'. The aft and forward pistons are slidably housed within the aft and forward propulsion cylinders 104', 108' and separate the interiors of each cylinder into a power chamber and a reset chamber. Accordingly, the aft and forward propulsion cylinder 104', 108' form, at least in part, aft and forward propulsion assemblies that are configured for advancing the tractor body through the borehole relative to the aft and forward gripper assemblies. Although preferred embodiments of the tractor utilize aft and forward propulsion cylinders, it will be appreciated that a wide variety of aft and forward propulsion assemblies may be used for producing advancement of the tractor body.

As will be described in more detail below, pressurized fluid is alternately directed to the power chamber in the aft or forward propulsion cylinder for propelling the body through the borehole when the aft or forward gripper assembly is anchored to the inner surface. Pressurized fluid is alternately directed to the reset chamber in the aft or forward propulsion cylinder for resetting the position of the aft or forward gripper assembly relative to the body (i.e., in preparation for another power stroke) while the aft or forward gripper assembly is disengaged. Accordingly, the tractor steps through the borehole by thrusting itself forward relative to the aft or forward gripper assembly.

The aft and forward shaft assemblies 118' and 124' may be constructed from any suitable material. In one preferred embodiment, the shafts are formed from a flexible material, such as CuBe, in order to permit the tractor 100' to negotiate sharper turns. In other embodiments CuBe is not used, as it is relatively expensive. Other acceptable materials include Titanium and steel (when low flexibility is sufficient). In a preferred configuration, each shaft includes a central internal bore which together form, in part, the internal passage for the flow of pressurized operating fluid to the downhole equipment and to the control assembly 102'. The bore in each shaft assembly preferably extends the entire length of the shaft. Each shaft may also include numerous other passages for the flow of fluid to the gripper assemblies and propulsion cylinders. These fluid passages range in length and are equal to or less than the overall length of the tractor. Multiple fluid passages can be drilled in the shaft for the same function, such as to feed a single propulsion chamber. Preferably, the bore and the other internal fluid passages are arranged so as to minimize stress and provide sufficient space and strength for other design features, such as the pistons slidably housed within the cylinders. Each shaft is preferably provided with threads on one end for connection to the tool joint assemblies 116' and 129', and with a flange on the other end to allow bolting to the control assembly 102'.

It will be appreciated by those skilled in the art that the tractor 100' described herein is particularly well adapted for intervention applications. While intervention tractors can be made any size, they are typically operated within 5-inch or 7-inch casing. The inside diameter of a 5-inch casing can range from 4.5 to 4.8 inches. The inside diameter of a 7-inch casing can range from 5.8 to 6.4 inches. The primary structural components of the tractor 100' are the shafts 118' and 124'. In a preferred embodiment, the shafts have an outside diameter of 1.75 inches and an inside bore diameter of 0.8 inches. The remaining fluid passages of the shafts are preferably smaller. The pistons can have varying outside diameters.

For intervention applications, the tractor 100' described herein is very reliable and efficient. Prior art intervention tools that utilize rotary drill strings are as much as 150% more expensive than the illustrated tractor 100' used with coiled tubing equipment. In addition, the tractor 100' is more time-conservative, as the longer rig-up time associated with rotary equipment is avoided. Furthermore, the use of coiled tubing is particularly advantageous when operating perforation guns.

The tractor 100' is at least in part hydraulically powered by the operating fluid pumped down the drill string, such as brine, sea water, drilling mud, or other hydraulic fluid. As discussed above, the same fluid supply line that operates the downhole equipment 32' (see FIG. 35) also preferably powers the tractor. This avoids the need to provide additional fluid channels in the tool. Preferably, liquid brine or sea water is used in an open system. Alternatively, fluid may be used in a closed system, if desired. Referring again to FIG. 35, in operation, operating fluid flows from the drill string 30' through the tractor 100' and down to the downhole equipment 32'.

Preferred Configuration of Valve System

The control assembly 102' preferably houses a plurality of hydraulically and/or electrically controlled valves configured for selectively controlling the flow of operating fluid to and from the gripper assemblies 104' and 106' and to and from the propulsion cylinders 108' and 114' for producing tractor movement. It will be appreciated that the term "valve" as used herein is a broad term that generally refers to any device capable of regulating or controlling the distribution of fluid. Preferably, the valves contained within the control assembly 102' are entirely hydraulically controlled. Hydraulically controlled tractors are generally more desirable than electrically controlled valves, particularly for intervention applications, because they are less expensive and are generally safer to use in combination with certain types of downhole equipment, such as perforation guns. In addition, hydraulically controlled valves eliminate the need for electronic components, thereby saving space, which allows for larger internal flow passages. As a result, tractors using hydraulically controlled valves are generally faster and more powerful than tractors using electrically controlled valves.

Preferred embodiments of the present invention disclose an improved valve system that provides a significant improvement over valve systems known heretofore. For example, embodiments of the improved valve system disclosed herein provide much greater control of tractor movement as compared with existing hydraulically controlled tractors. The improved valve system also provides improved regulation of fluid pressure and allows the tractor to operate effectively within a larger zone of parameters. Furthermore, the improved valve system is configured to improve the reliability and extend the life of the internal components, thereby saving time and reducing costs. The entire disclosures are incorporated by reference herein: (1) U.S. Pat. No. 6,347,674 to Bloom et al.; (2) U.S. Pat. No. 6,241,031 to Beaufort et al.; (3) U.S. Pat. No. 6,003,606 to Moore et al.; (4) U.S. Pat. No. 6,464,003 to Bloom et al.; (5) U.S. Provisional Patent Application Ser. No. 60/250,847, filed Dec. 1, 2000; (6) U.S. application Ser. No. 10/004,963, entitled "IMPROVED GRIPPER ASSEMBLY FOR DOWNHOLE TRACTORS," filed on Dec. 3, 2001.

Figure 37:
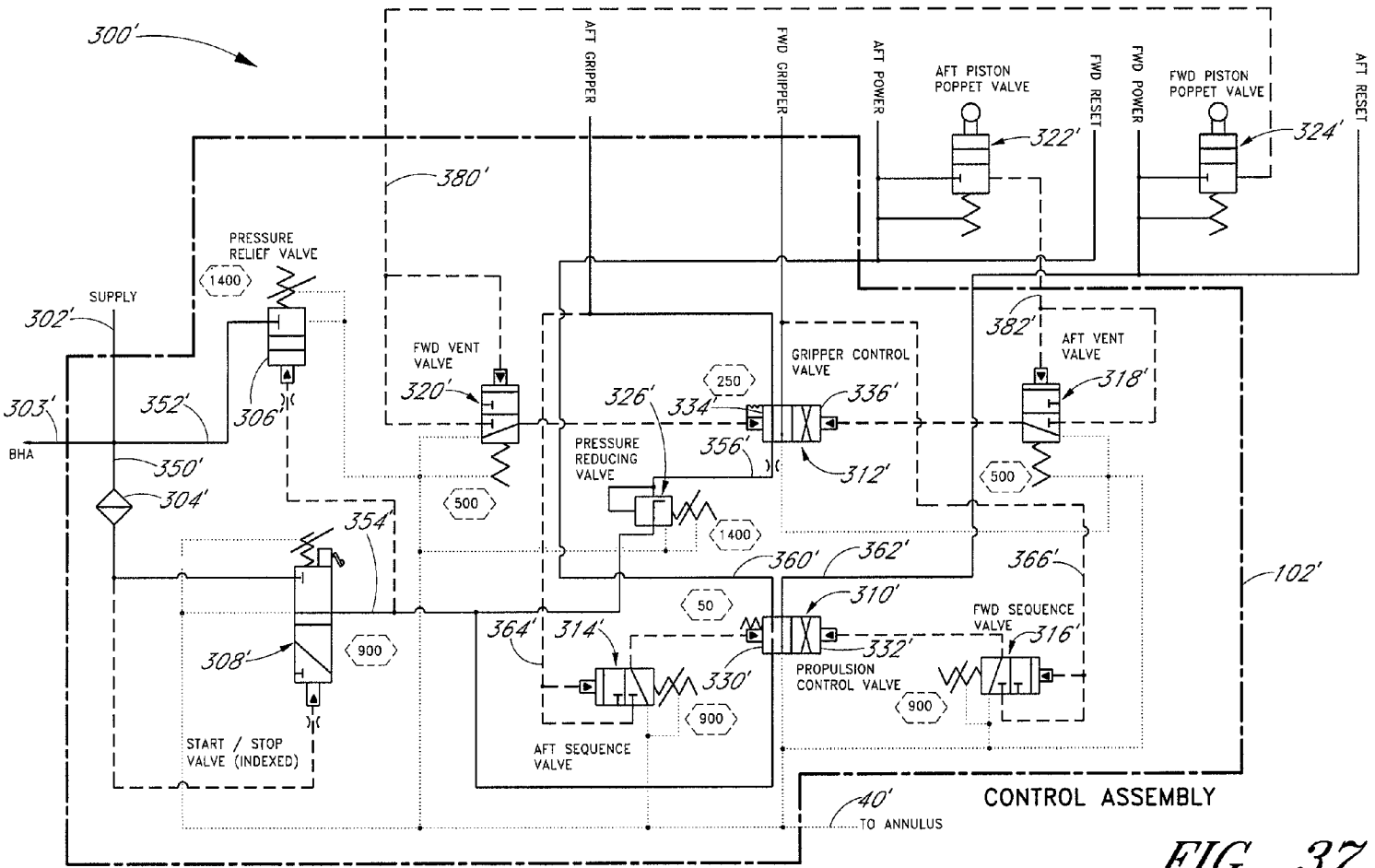
FIG. 37 is a schematic diagram illustrating a preferred embodiment of a valve control assembly for use with the tractor.

Referring now to FIG. 37, for purposes of illustration, one preferred embodiment of an improved valve system 300' is schematically shown. The portion of the valve system 300' housed within the control assembly 102' generally includes a start/stop valve 308', a propulsion control (or main sequence) valve 310', a gripper control (or pilot) valve 312', an aft sequence valve 314', a forward sequence valve 316', an aft vent valve 318', a forward vent valve 320' and a pressure reducing valve 326'. In addition, a pressure relief valve 306' is provided for regulating the supply pressure in the internal passage. The pressure relief valve 306' is preferably included in the control assembly; however, the pressure relief valve may be located elsewhere, such as on the surface.

To effectively control the sequence of valve operation, it is desirable to accurately detect when the tractor body has completed an advancement stroke relative to the anchored aft or forward gripper assembly. Due to pressure fluctuations in the valve system, the use of pressure-responsive valves is not always effective for detecting and signaling the end of an advancement stroke. Accordingly, one embodiment of an improved valve system for an intervention tractor incorporates at least one mechanically actuated valve mechanism into the propulsion control assembly for quickly and accurately detecting and signaling the completion of a piston stroke.

In one preferred embodiment, the mechanically actuated valve is a poppet valve that is integrated into the piston. As the piston completes its stroke, the poppet valve (or other mechanically actuated valve) is mechanically actuated to open a seal and thereby allow fluid to pass through a passage. As a result, the outlet flow from the poppet valve may be used to actuate or pilot another valve. The use of a poppet valve to detect the end of the piston stroke, rather than a pressure-responsive valve, improves the efficiency and reliability of the hydraulic control assembly.

FIG. 37 schematically illustrates an aft piston poppet valve 322' and a forward piston poppet valve 324', each of which cooperates with the valves housed within the control assembly 102' to control tractor movement. As will be described in more detail below, the aft and forward piston poppet valves 322', 324' are preferably integrated into the aft and forward pistons on the aft and forward shaft assemblies. In preferred embodiments, the aft and forward piston poppet valves 322', 324' are preferably substantially identical in structure and operation.

Pressure Relief Valve

With continued reference to FIG. 37, one embodiment of an improved valve system is illustrated wherein the tractor receives pressurized fluid from the surface through a supply line 302'. As the fluid enters the internal passage in the tractor body, a portion of the fluid from the supply line 302' is diverted to a pressure relief valve 306' along flow path 352'. Also, a portion of the pressurized fluid from the supply line 302' is diverted to the start-stop valve 308' along flow path 350'. The remaining pressurized fluid passes through the internal passage to the downhole equipment along flow path 303'.

In the illustrated embodiment, the pressure relief valve 306' regulates the fluid pressure in the supply line 302'. As a result, the pressure relief valve 306' also regulates the pressure of the "working" fluid that enters the start-stop valve 308' along flow path 350'. The working fluid provides hydraulic power for producing movement of the tractor. Accordingly, it will be appreciated that the pressure relief valve regulates the pressure of the fluid entering the gripper assemblies 104', 106' and the propulsion cylinders 108', 114' (see FIG. 36). Still further, the pressure relief valve 306' regulates the pressure of the fluid that is supplied to the downhole equipment along flow path 303'. Although the pressure relief valve is desirably housed within the control assembly (as shown in FIG. 37), the pressure relief valve may also be provided in other locations, such as along other portions of the tractor or on the surface.

In a preferred embodiment, the pressure relief valve 306' has a variable orifice that opens as a function of the fluid pressure. If the pressure in the supply line 302' increases rapidly, the variable orifice will open wider to vent more fluid. As a result, the pressure relief valve 306' responds quickly and fluid in the supply line 302' may be advantageously maintained at a regulated pressure.

During use, when the differential pressure between the supply line 302' and the annulus 40' increases above a pre-selected threshold pressure, the pressure relief valve 306' opens to vent fluid to the annulus 40', thereby lowering the pressure in the supply line. In various embodiments, the pre-selected threshold pressure is desirably at least 600 psid, 800 psid, 900 psid, 1100 psid, 1200 psid, 1400 psid and 1600 psid. In a preferred embodiment, the pre-selected threshold pressure is 1400 psid. Other pre-selected threshold pressures may also be desirable in some circumstances. The pressure relief valve is preferably sized for diverting fluid to the annulus 40' at a maximum rate of up to 20 to 25 gallons per minute. In preferred embodiments, the pressure relief valve 306' may be selectively rendered non-operational (i.e., turned off) when it is desirable to supply high-pressure fluid to the downhole equipment for certain operations.

The pressure relief valve 306' is particularly advantageous for use with valve systems that use a relatively large percentage of the flow through the supply line 302' for powering the tractor. Valve systems that use a large percentage of the system flow typically produce large pressure fluctuations in the system pressure during operation. For example, when the tractor completes a power stroke, the shifting in valve positions may temporarily stop the flow of fluid through the valve system. Without the pressure relief valve, the reduction in flow could produce a large swing in system pressure that could produce surges in motion, valve instability or stalling of the tractor. Accordingly, those skilled in the art will appreciate that the embodiments of the pressure relief valve 306' disclosed herein provide a significant advancement in the field of tractors.

Figure 38:
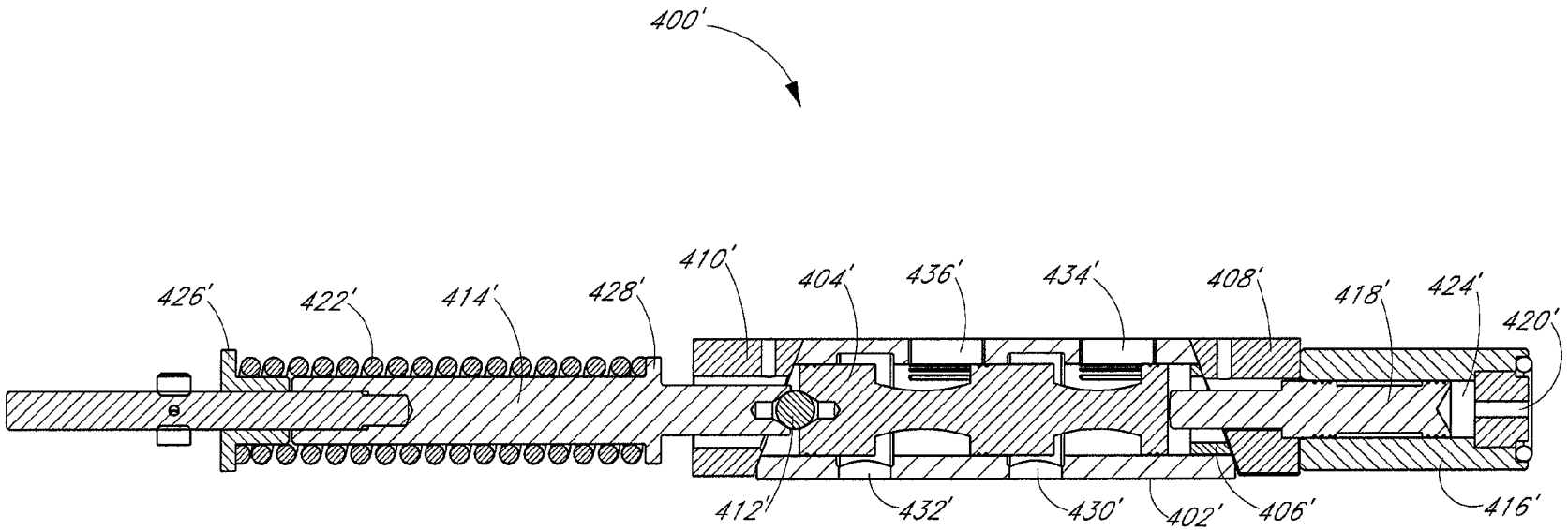
FIG. 38 is a longitudinal sectional view illustrating a preferred embodiment of a pressure relief valve.

With reference now to FIG. 38, a cross-sectional view of the internal components 400' of one preferred embodiment of a pressure relief valve is shown. The pressure-relief valve is preferably a pilot operated, spring return, two-position valve that is piloted by the pressure in the fluid path 354' from the start-stop valve 308' (as illustrated in FIG. 37). The internal components 400' of the pressure relief valve generally comprise a body 402' formed with a hollow interior and a spool 404' slidably housed within the hollow interior. First and second inlet ports 430', 432' and first and second outlet ports 434', 436' are provided through the body 402' for providing fluid communication with the hollow interior.

In the illustrated embodiment, a spring cartridge 414' is coupled to the left end of the spool 404' via a ball 412'. The spring cartridge 414' and the spool 404' are axially fixed with respect to each other. The right end of the cartridge 414' is slidably maintained within the body 404' by a retainer 410'. A coiled spring 422' extends around a middle portion of the spring cartridge 414'. As illustrated, the left end of the spring 422' is in contact with a fixed stop 426', which prevents movement of the spring 422' away from the body 402' (to the left in FIG. 38). The spring 422' is preferably compressed between the fixed stop 426' and a flange 428' on the cartridge 414'. The spring 404' provides a biasing force that urges the cartridge 414' and the spool 404' away from the body 402' (to the right in FIG. 38). Preferably, the pressure relief valve is configured such that the biasing force varies according to the pressure in the annulus such that the pressure relief valve operates off a differential pressure between the supply line and the annulus. A stop 406' is provided within the housing 402' for limiting the translation of the spool to the right. A pilot assembly 416' is attached to the right end of the body 402' opposite the spring 404'. A pilot stem 418' is slidably housed within the pilot assembly 416' such that the left end of the stem 418' is in contact with the right end of the spool 404'.

FIG. 38 shows the internal components 400' of the pressure relief valve in an open position such that pressurized fluid may pass therethrough. In operation, pressurized fluid enters the pilot assembly 416' through a pilot port 420'. The fluid passes into a chamber 424' wherein the fluid pressure acts on one end of the pilot stem 418'. When the spool is in contact with the stop 406', the inlet ports 430', 432' are blocked such that no fluid passes through the pressure relief valve. However, when the fluid pressure is sufficient to overcome the biasing force of the spring, the stem 418' moves to the left, thereby causing the spool 404' to translate to the left through the body 402'. As the spool 404' moves to the left, the spring 422' is compressed. As the spool 404' translates to the left relative to the body 402', the inlet ports 430', 432' open to allow fluid to enter into the interior chamber of the body. The fluid passes around the spool and exits through the outlet ports 434', 436', preferably to the annulus. Due to the configuration of the spool and inlet ports, the first and second inlet ports 430', 432' open further as the spool moves further to the left to allow more fluid to pass therethrough. In a preferred configuration, the first and second inlet ports 430', 432' are staggered such that the first inlet port 430' opens before the second inlet port 432'. Accordingly, the pressure relief valve vents only a small amount of fluid when the fluid pressure is only slightly above the threshold. However, when the fluid pressure is significantly larger than the threshold pressure, both the first and second inlet ports 430', 432' are open for allowing a large volume of fluid to pass.

With reference again to FIG. 37, the pressure relief valve 306' advantageously provides the ability to regulate the pressure of the fluid that is supplied to both the valve system (via flow path 350') and to the downhole equipment (via flow path 303'). In one advantage of this arrangement, the working fluid entering the valve system is regulated independently of the tractor load and speed. In another advantage, the valve system is protected from large pressure fluctuations that can damage the internal hardware. In another advantage, the tractor is prevented from surging or stalling due to large pressure fluctuations in the supply line. Still further, because the pressure in flow path 303' is regulated, the tractor has improved compatibility with downhole equipment. Still further, the regulated pressure allows preferred embodiments of the tractor to be used over a substantially greater range of flow rates. The increased range further enhances the tractor's ability to be used with a wide variety of downhole equipment in a various field applications.

Start/Stop Valve

With reference again to FIG. 37, a portion of the pressurized fluid is preferably diverted from the supply line 302' (i.e., internal passage) into flow path 350' for providing hydraulic power to move the tractor through the borehole. Preferably, a filter 304' is provided along flow path 350' for removing particles from the fluid. The removal of large particles from the fluid protects internal valve system components (e.g., valve spools) that are used for controlling the operation of the tractor.

As illustrated in FIG. 37, the pressurized fluid in flow path 350' enters the start-stop valve 308'. The start/stop valve 308' is preferably a pilot operated, spring return, indexed, two position, two-way valve that is piloted by the pressure of the fluid in flow path 350'. When in a closed position, the start/stop valve 308' prevents fluid from passing through the valve system, thereby rendering the tractor non-operational. When in an open position, the start/stop valve 308' allows pressurized fluid to pass through to flow path 354'. The pressurized fluid in flow path 354' flows to the propulsion control valve 310' and the pressure reducing valve 326', thereby allowing for tractor operation. The start-stop valve 308' is configured to move into the open position when the fluid pressure in flow path 350' (i.e., the supply line) exceeds a pre-selected threshold pressure. However, the start-stop valve 308' is preferably indexed such that the valve may be selectively prevented from opening when the fluid pressure exceeds the pre-selected threshold.

Figure 39:
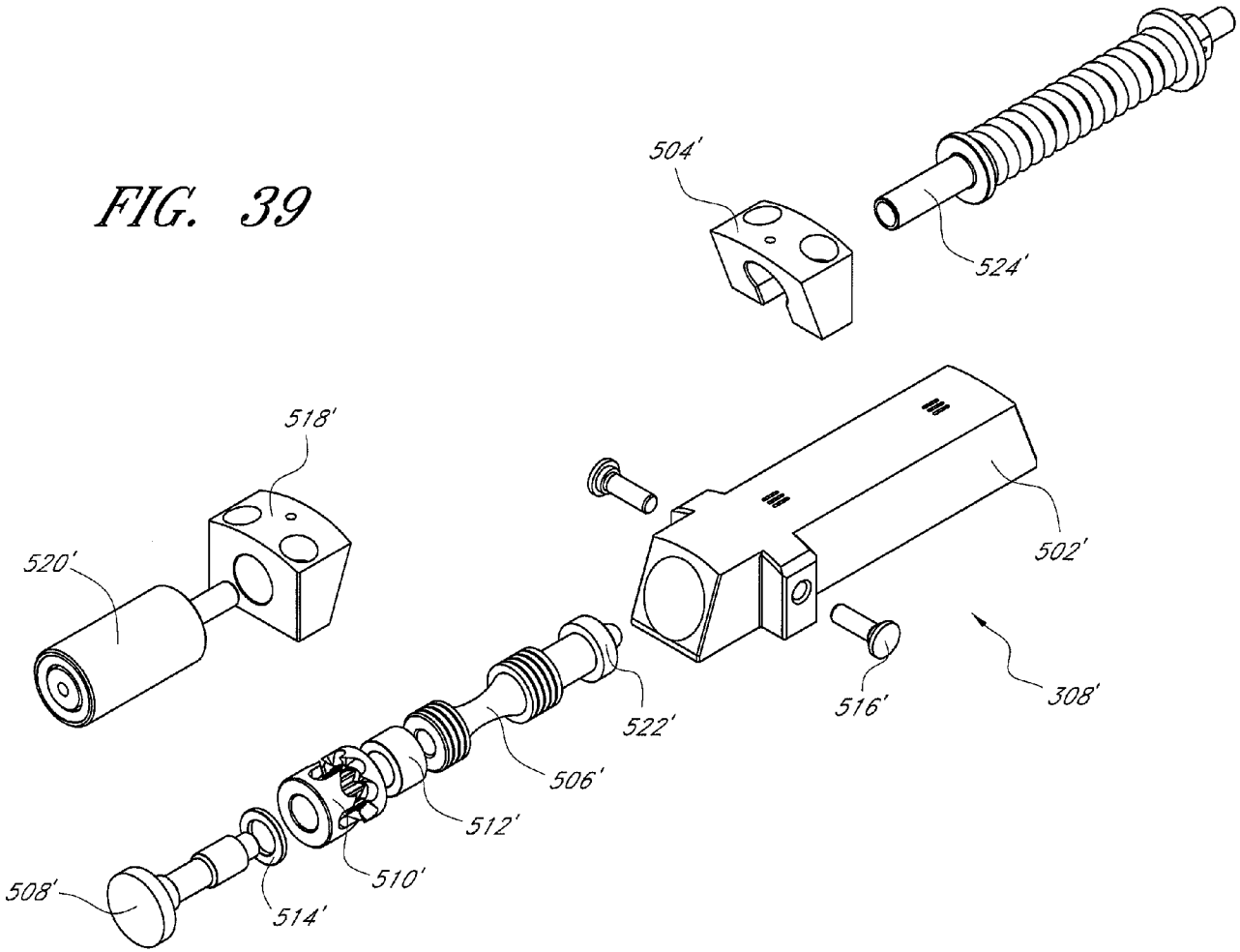
FIG. 39 is an exploded view illustrating the components of a preferred embodiment of a start-stop valve.

With reference now to FIG. 39, an exploded view of one preferred embodiment of a start-stop valve 308' is shown. The primary components of the start-stop valve 308' generally comprise a body 502' formed with a hollow interior and a spool 506' slidably housed within the hollow interior. The slidable spool 506' is preferably coupled at a first end to a spring cartridge 524' via a ball 522'. In one embodiment, the ball 522' is made of stainless steel. The spool 506' is preferably coupled at a second end to an index sleeve 510' with a spacer 512' located therebetween. An index guide 508' extends through a center portion of the index sleeve 510' and a washer 514' is provided therebetween. The spool 506', the index guide 508', and the index sleeve 510' are all slidably housed within the body 502'. The spring cartridge 524' is preferably coupled to a first end of the body 502' by a slotted retainer 504'. The spring cartridge is configured to urge the spool 506' into the closed position. A pilot assembly 520' is preferably coupled to a second end of the body 502' via a retainer 518'. Under sufficient fluid pressure, the pilot assembly 520' compresses the spring on the spring cartridge 524' for changing the position of the index sleeve 510' and moving the spool into the open position.

During use, as the pressure in the flow path 350' increases above a pre-selected threshold (e.g., 900 psi), the fluid pressure acts on the pilot assembly 520', which in turn causes the index sleeve 510' to rotate about the index guide 508'. The rotational position of the index sleeve 510' determines whether the start-stop valve 308' opens or remains closed as the pressure of the fluid increases above the pre-selected threshold. Accordingly, the start-stop valve 308' provides a mechanism for turning the tractor on and off by varying the supply pressure. If the index sleeve 510' is in the off position, a pressure cycle (e.g., dropping the pressure to 0 psi and then back up to 900 psi) will change the index sleeve 510' into the on position. When the index sleeve 510' is in the on position, the spool may slide within the hollow interior of the body 502' for opening a passage between the inlet and outlet ports (not shown) and thereby allowing fluid to pass through the start-stop valve 308'. More details on valves having indexed drums can be found in U.S. Publication No. 2002/0112859 A1, which is incorporated herein by reference.

With reference again to FIG. 37, in preferred embodiments, the fluid pressure in the flow path 354' from the start-stop valve 308' is used to pilot the pressure relief valve 306'. As a result, the pressure relief valve 306' is only operational when the start-stop valve 308' is in the open position. Accordingly, the pressure relief valve 306' is effectively "turned off" when the index sleeve is in the off position such that the start-stop valve will not open regardless of the fluid pressure in flow path 350'. This is an important feature because it allows the fluid pressure in the internal passage 302', 303' to be increased above the pressure threshold of the pressure relief valve. This advantageously allows the operator to provide fluid at any pressure to a bottom hole assembly or other downhole equipment when desired.

Propulsion Control Valve

As discussed above, when the start/stop valve 308' is open, pressurized operating fluid flows through the passage 354' to the propulsion control valve 310'. In a preferred embodiment, the propulsion control valve 310' is a two-position, sliding-spool directional flow valve. In a first position, as shown in FIG. 37, the spool of the valve 310' provides a flow path 360' for the flow of fluid to the power chamber of the aft cylinder, and also to the reset chamber of the forward cylinder. In the first position, the valve 310' also provides a flow path 362' for the flow of fluid from the power chamber of the forward cylinder to the annulus 40', and from the reset chamber of the aft cylinder to the annulus 40'.

The spool of the propulsion control valve 310' also has a second position, (e.g., which would be shifted to the left in FIG. 37). When the spool of the valve 310' is in its second position, the valve 310' provides a flow path 362' for the flow of fluid to the power chamber of the forward cylinder, and also to the reset chamber of the aft cylinder. In the second position, the valve 310' also provides a flow path 360' for the flow of fluid from the power chamber of the aft cylinder to the annulus 40', and also from the reset chamber of the forward cylinder to the annulus 40'.

With continued reference to FIG. 37, the spool of the propulsion control valve 310' has a first end surface 330' and a second end surface 332'. The first end surface 330' is in fluid communication with the aft gripper assembly along fluid path 364'. The second end surface 332' is in fluid communication with the forward gripper assembly along fluid path 366'. The first and second end surfaces 330' and 332' of the propulsion control valve 310' are configured to receive respective fluid pressure forces that act on the valve spool. The first end surface 330' receives a pressure force from the fluid in the aft gripper assembly that tends to move the spool of the valve 310' toward its first position, (e.g., to the right as shown in FIG. 37). The second end surface 332' receives a pressure force from the fluid in the forward gripper assembly that tends to move the spool toward its second position, (e.g., which would be shifted to the left in FIG. 37).

Aft and Forward Sequence Valves

With continued reference to FIG. 37, an aft sequence valve 314' is preferably provided along the fluid path 364' extending from the aft gripper assembly to the first end surface 330'. In addition, a forward sequence valve 316' is preferably provided along the fluid path 366' extending from the forward gripper assembly to the second end surface 332'.

Referring only to the aft sequence valve 314' for purposes of illustration, the aft sequence valve 314' opens when the fluid pressure in the flow path 364' exceeds a pre-selected threshold (e.g., 900 psid). When the aft sequence valve 314' is open, the fluid pressure in flow path 364' acts on the first end surface 330' for urging the propulsion control valve to the right as shown in FIG. 37. When the fluid pressure in the flow path 364' is below the pre-selected threshold, the aft sequence valve 314' is closed such that the fluid pressure in flow path 364' cannot act on the first end surface 330'. In addition, when the aft sequence valve 314' is closed, and the fluid in the portion of the flow path between the aft sequence valve 314' and the propulsion control valve 310' is vented to the annulus 40', thereby removing any remaining force acting on the first end surface 330'. It will be understood that the forward sequence valve 316' preferably operates in the same manner as the aft sequence valve 314'.

The aft and forward sequence valves 314', 316' used in combination with the propulsion control valve 310' significantly improve the efficiency of the tractor operation. In particular, the aft and forward sequence valves 314', 316' provide a reliable and constant pressure threshold in the flow paths 364', 366' that must be overcome in order to pilot the propulsion control valve 310'. Because the aft and forward sequence valves 314', 316' provide a reliable pressure threshold, the fluid flow rates through the valve system may be increased substantially without having an adverse effect on the operation of the tractor. As a result, the gripper assemblies may be actuated more quickly, which in turn decreases the dwell time (i.e., the delay time between power strokes) and substantially increases the overall tractor speed through the borehole. Furthermore, due to the reliability of the tractor, the educational and skill requirements for service personnel are reduced, which thereby reduces operational costs.

Figure 40:
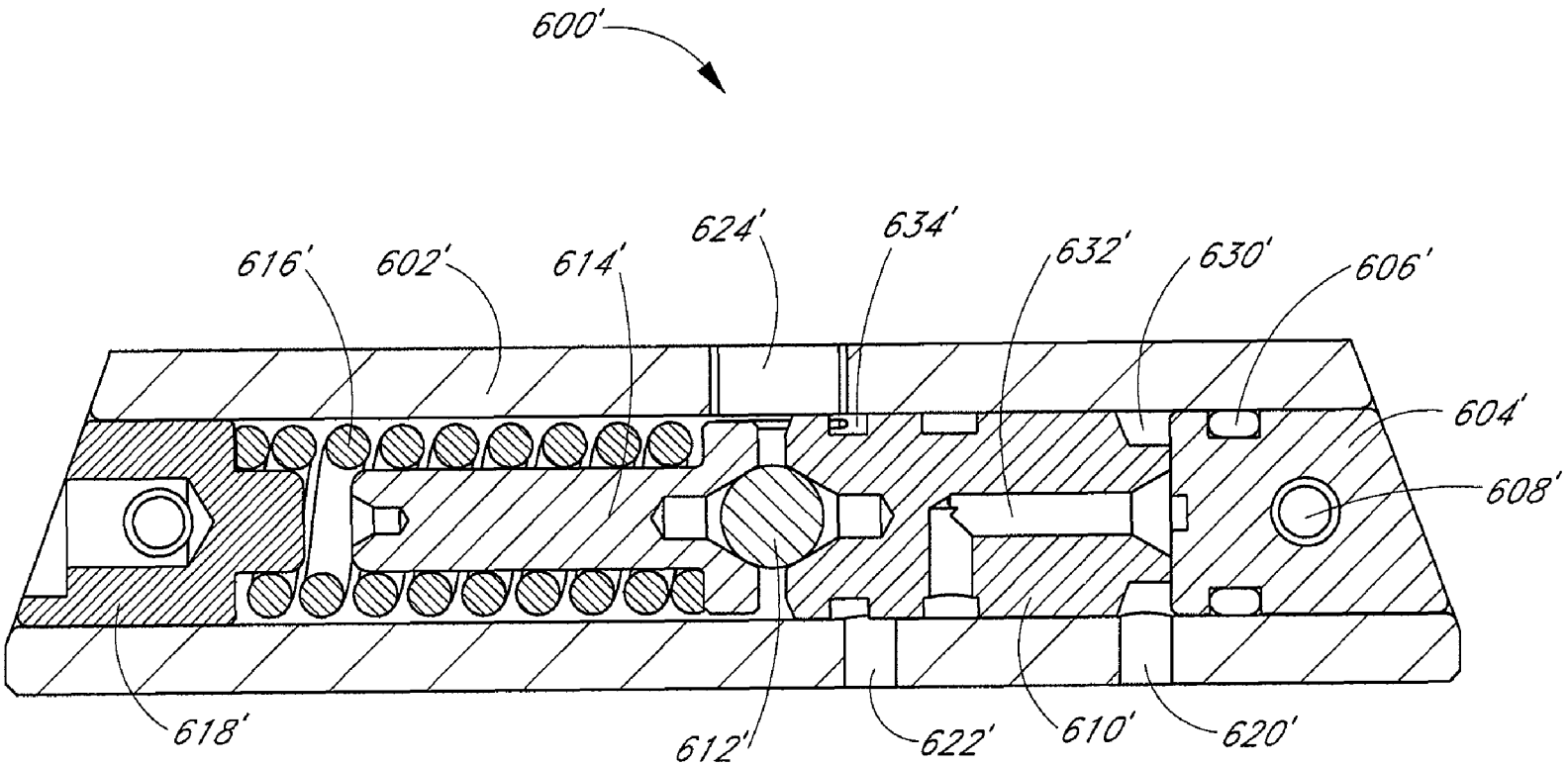
FIG. 40 is a longitudinal sectional view illustrating a preferred embodiment of a vent valve assembly.

With reference now to FIG. 40, the primary components 600' of one preferred embodiment of an aft sequence valve (see element 314' in FIG. 37) are shown in a longitudinal sectional view. The components 600' of the aft sequence valve are preferably identical to the components of the forward sequence valve and therefore only the components of the aft sequence valve will be described. The illustrated components 600' of the aft sequence valve generally comprises a body 602' formed with a hollow interior and a spool 610' slidably housed within the hollow interior. An inlet port 620', a working port 622' and an exhaust port 624' are provided through the body 602' for communication with the hollow interior. A bore 632' is formed through the spool 610'. The slidable spool 610' is preferably coupled to a spring guide 614' via a ball 612'. In one embodiment, the ball 612' is made of siliconnitride. A spring 616' extends around the guide 614' and contacts a stop 618' at one end. A plug 604' at the other end of the body 602' provides a fluid tight seal. The plug 604' and stop 618' are preferably coupled to the body 602' via a pin or dowel 608'.

During use, pressurized fluid (e.g., from fluid passage 364' as shown in FIG. 37) enters the inlet port 620' of the aft sequence valve. The fluid enters the annular region 630' located between the spool 610', the body 602' and the plug 604'. The fluid pressure urges the spool 610' to move to the left. At the same time, the spring 616' provides a biasing force that urges the spool to the right. When the fluid pressure in the annular region 630' exceeds a pre-selected threshold (e.g., 900 psid), the spool 610' will move to the left a sufficient distance such that the bore 632' communicates with the working port 622'. As a result, fluid may pass from the inlet port through the bore 632' and out through the working port 622' (e.g. for piloting the propulsion control valve 310' in FIG. 37). When the pressure is below the threshold, the spool 610' is located hardover to the right, as shown in FIG. 40. In this position, fluid may travel back through the working port 622', into the annular region 634' and out through the exhaust port 624' to the annulus. This feature allows fluid to vent to the annulus when the fluid in the flow path 364' or 366' (see FIG. 37) is not pressurized.

Pressure Reducing Valve

With reference again to FIG. 37, in a preferred embodiment, the outlet flow from the start/stop valve 308' along fluid path 354' passes through the pressure reducing valve 326' before entering the gripper control valve 312'. The pressure reducing valve 326' is preferably a direct operating valve that limits the pressure of the operating fluid in the aft and forward gripper assemblies, and thus provide a means for preventing possible damage to the gripper assembly components.

When the pressure downstream of the pressure reducing valve 326' increases above a pre-selected threshold (e.g., 1400 psid), the pressure reducing valve closes to protect the gripper assemblies from becoming over-pressurized. Thus, the pressure reducing valve 326' imposes an upper limit on the pressure in the passage 356' and thereby prevents over-pressurization of the gripper assemblies by bleeding excess pressure to the annulus 40'.

Gripper Control Valve

With continued reference to FIG. 37, the gripper control valve 312' directs fluid to either the aft gripper assembly or the forward gripper assembly. In the illustrated embodiment, the gripper control valve 312' is preferably a two-position, sliding-spool directional valve that functions in essentially the same manner as the propulsion control valve 310' described above. For additional details regarding preferred embodiments of the valves 310' and 312', see Applicant's U.S. Publication No. 2002/0112859 A1, which is incorporated herein by reference.

The spool of the gripper control valve 312' has a first position (as shown in FIG. 37) in which the gripper control valve 312' provides a flow path 370' to the aft gripper assembly. When the spool of the valve 312' is in its first position, the valve 312' also provides a flow path 372' for the flow of fluid from the forward gripper assembly to the annulus 40'. The spool of the gripper control valve 312' also has a second position, not shown in FIG. 37. In the second position, the gripper control valve 312' provides a flow path 372' to the forward gripper assembly. When the spool of the valve 312' is in its second position, the valve also provides a flow path 370' for the flow of fluid from the aft gripper assembly to the annulus 40'.

The spool of the gripper control valve 312' has a first end surface 334' and a second end surface 336'. The first end surface 334' is in fluid communication with the forward piston poppet valve 324' along flow path 380'. The second end surface 336' is in fluid communication with the aft piston poppet valve 322' along flow path 382'. The first and second end surfaces 334' and 336' are configured to receive respective fluid pressures from flow paths 380' and 382' that act on the spool of the valve. The first end surface 334' receives a pressure force from the outlet of the forward piston poppet valve 324' that tends to move the spool of the gripper control valve 312' toward its first position, as shown in FIG. 37. The second end surface 336' receives a pressure force from the outlet of the aft piston poppet valve 322' that tends to move the spool toward its second position, which would be shifted to the left in FIG. 37. The structure and function of preferred embodiments of the aft and forward poppet valves 322', 324' are described in more detail below.

Vent Valves

With continued reference to FIG. 37, an aft vent valve 318' is preferably provided along the fluid path 382' extending from the aft piston poppet valve 322' to the first end surface 336' of the gripper control valve 312'. In addition, a forward vent valve 320' is preferably provided along the fluid path 380' extending from the forward piston poppet valve 324' to the second end surface 334' of the gripper control valve 312'. Similar to the aft and forward sequence valves 314', 316' described above, the aft and forward vent valves 318', 320' each prevents fluid from passing through their respective fluid path unless the pressure fluid in the path exceeds a pre-selected threshold. As a result, the aft and forward vent valves provide for reliable shifting of the spool in the gripper control valve 312' and further improve the timing and efficiency of the valve system. When the pressure drops below the pre-selected threshold, the aft and forward vent valves 318', 320' allow the fluid in the flow paths between the vent valves and end surfaces to be vented to the annulus 40'. In preferred embodiments, the structure of the aft and forward vent valves 318', 320' is substantially identical to the aft and forward sequence valves 314', 316' described above with reference to FIG. 40.

Preferred Configurations of Shaft Assemblies/Piston Poppet Valves

With reference again to FIG. 36, aft and forward shaft assemblies 118', 124' are coupled to the aft and forward ends of the control assembly 102'. The aft and forward shaft assemblies 118', 124', along with the control assembly 102', form the body of the tractor 100'. The aft gripper assembly 104' and aft propulsion cylinder 108' are slidably coupled to the aft shaft assembly 118'. The forward gripper assembly 106' and forward propulsion cylinder 114' are slidably coupled to the forward shaft assembly 124'.

Figures 41A, 41B:
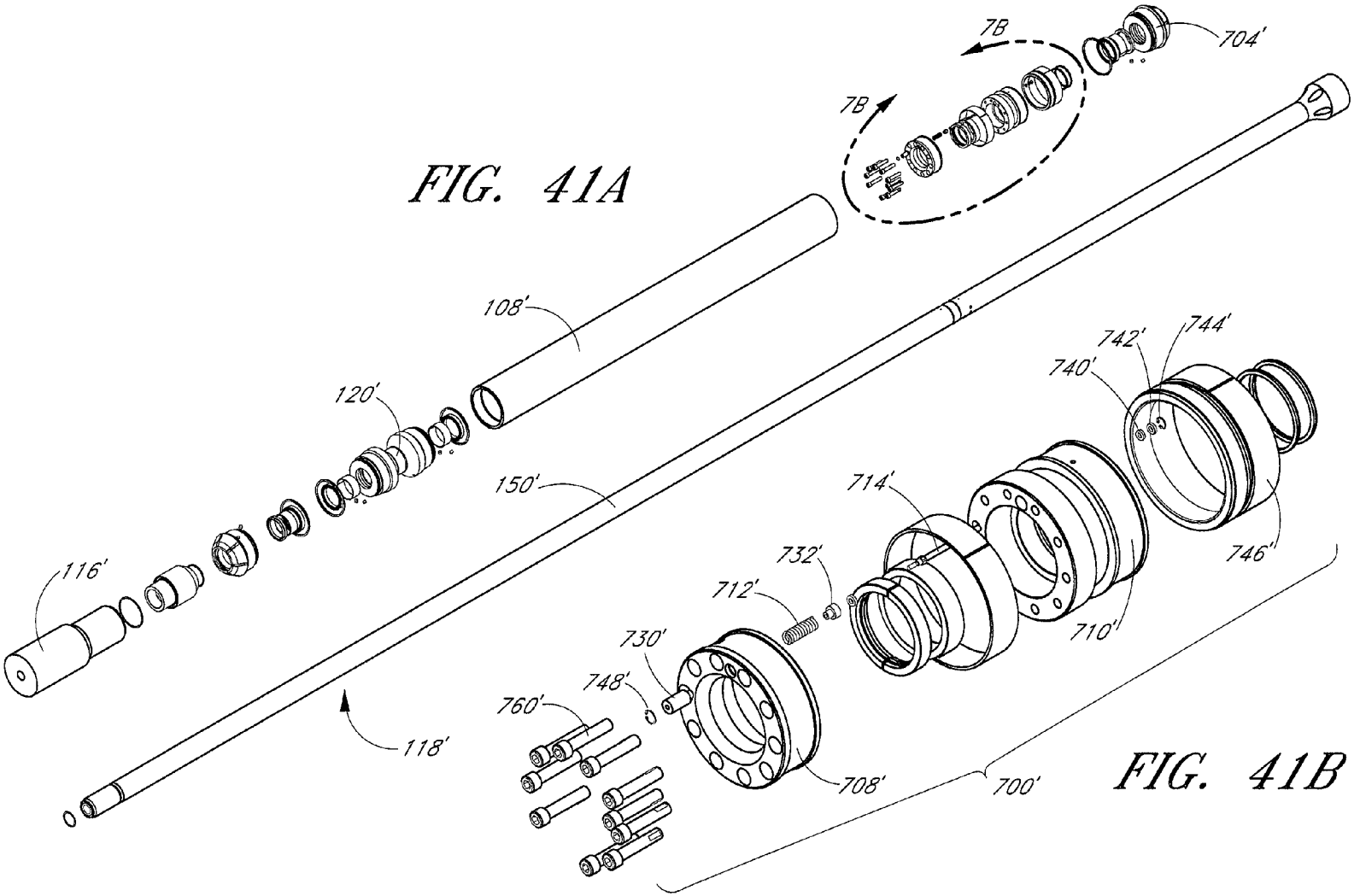
FIGS. 41A and 41B are exploded views of a shaft assembly for use with the tractor.

With reference now to FIG. 41A, for purposes of illustration, an exploded view of the aft shaft assembly 118' is shown in combination with the aft cylinder 108' and aft tool joint assembly 116'. The aft shaft assembly 118' generally includes an elongate shaft 150' formed with a substantially cylindrical shape. In a preferred embodiment, the aft cylinder 108' is substantially tubular in shape and is slidably disposed over the shaft 150' such that an annular region is formed therebetween. The aft cylinder 108' is sealed at the aft end by the flex joint 120'. The aft cylinder 108' is sealed at the forward end by a gland seal 704'. The aft cylinder 108' is thus sealed at both ends and slidably houses the aft piston for providing the aft propulsion assembly. When fully assembled, a gripper assembly (not shown) is also slidably disposed over the shaft 150' and is preferably coupled to the flex joint 120' along the aft end.

With reference now to FIG. 41B, an enlarged view of the aft piston 700' is shown for purposes of illustration. The aft piston 700' is rigidly connected to the aft shaft 150' and includes the aft piston poppet valve (see element 322' of FIG. 37). The aft piston 700' slides within the aft cylinder 108' and separates the power chamber from the retract chamber.

Figure 42:
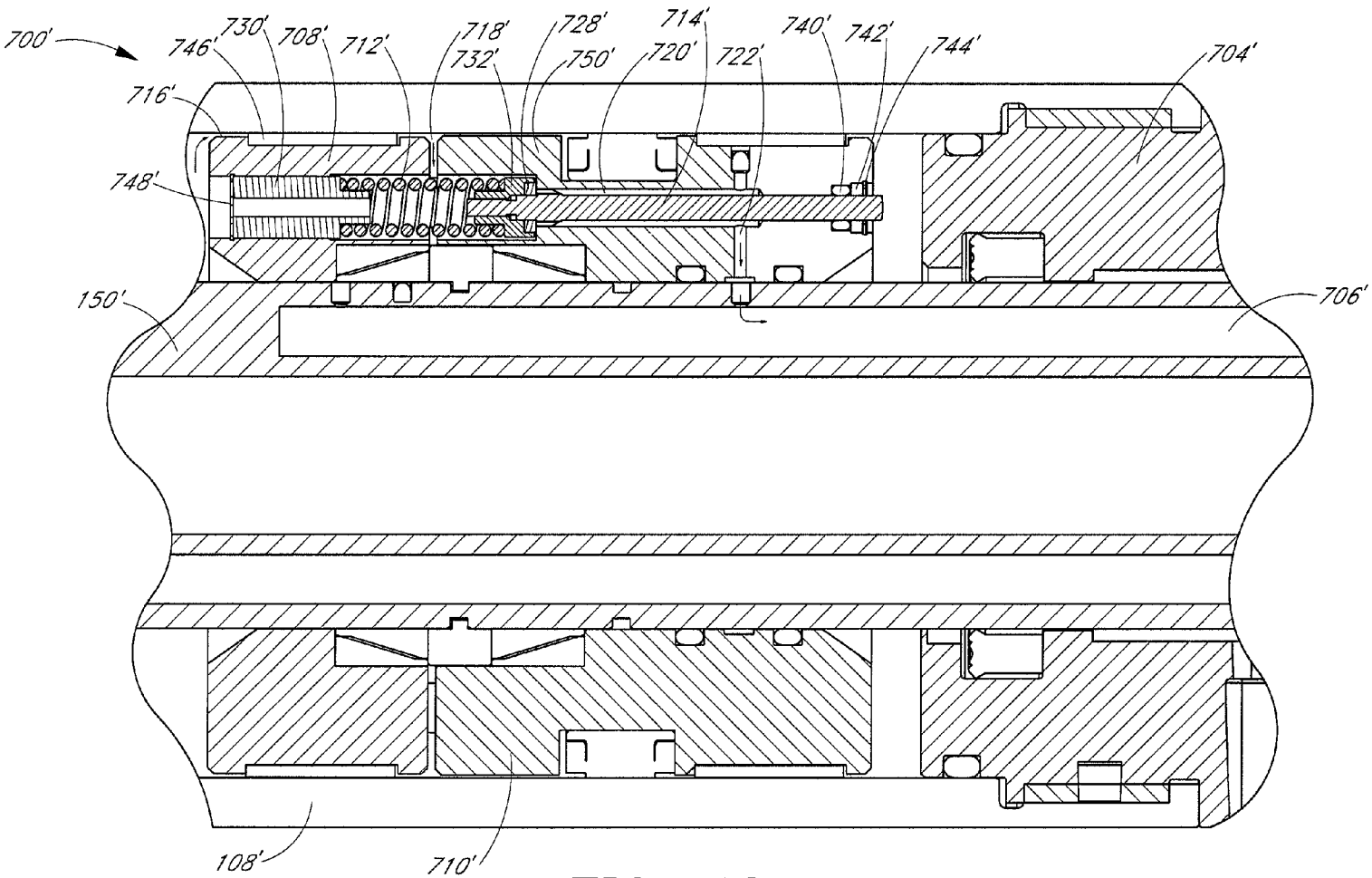
FIG. 42 is a longitudinal sectional view illustrating a preferred embodiment of a piston poppet valve integrated into a piston.

FIG. 42 is a longitudinal sectional view illustrating the aft piston 700', which includes the aft piston poppet valve (see element 322' of FIG. 37). With reference now to both FIG. 41B and FIG. 42, the aft piston 700' generally comprises a flange 708' and a hub 710'. The flange 708' and hub 710' separate the power and retract chambers within the aft cylinder 108'. The flange 708' is surrounded by a wear guide 746' and houses a seat 730'. The seat 730' is maintained in place by an internal retaining ring 748' at the aft end. A spring 712' is adjacent the seat 730' and extends from the flange 708' into the hub 710'. A stem 714' is coupled to the spring 712' and is slidably housed within the hub 710'. A portion of the stem 714' extends from an end surface of the hub for contacting the seal gland 704'. The protruding end of the stem 714' is guided by a stem guide 742', which is supported by an o-ring 740' and a retaining ring 744'.

The protruding end of the poppet valve stem 714' is located for contacting the seal gland 704', or other inner wall, as the piston reaches the end of the power stroke. As the valve stem 714' contacts the seal gland 704', the valve stem slides axially with respect to the hub 710'. As the stem slides, a seal washer 728' and a valve cap 732' are displaced from a valve seat 750' of the piston hub 710'. As a result, pressurized fluid from the power chamber of the cylinder flows through a gap 716' between the outer diameter of the piston flange 708' and the inner diameter of the cylinder 108'. The fluid continues to flow through a gap 718' located between the flange 708' and the hub 710', around the valve stem 714', and through the piston hub 710'. The fluid then flows in a radial direction through a port 722' and then into the pilot passage 716'. The fluid in the pilot passage 716' may then be ported to the control assembly for controlling the position of the gripper control valve, as schematically illustrated and described above with respect to FIG. 37.

With continued reference to FIGS. 41B and 42, as the piston 700' moves away from the seal gland 704', the valve spring 712' applies a biasing force that reseats the seal washer 728' onto the valve seat 750' of the piston hub 708'. As a result, the pilot passage 706' becomes sealed from the fluid pressure on both sides of the piston. In an important aspect of the above-described embodiment, the presence of pressurized fluid in the pilot passage 706' provides a means for accurately detecting and indicating the completion of the aft power stroke. This provides a significant advantage over pressure-responsive valves that may shift prematurely due to pressure fluctuations.

As illustrated, the mechanically actuated valve is desirably provided as a piston poppet valve. When used with preferred embodiments of the tractor, piston poppet valves have certain advantages over other mechanically actuated valves, such as, for example, reliability, small size and reliability. However, in alternative embodiments, other types of mechanically actuated valves may also be used for detecting the completion of a power stroke. For example, a diaphragm valve may be used to signal the completion of a power stroke. The diaphragm valve is mechanically actuated in a manner similar to that described above for the poppet valve to detect the completion of a power stroke. In another preferred embodiment, a shear valve may be used to signal the completion of the piston stroke. The shear valve includes a floating seal that slides to open or close an orifice. The shear valve may be mechanically actuated in a manner similar to that described above for the poppet valve to detect the completion of a power stroke. In addition, it will be appreciated that a piston poppet valves (or other mechanically actuated valve) may be located in a variety of different locations while still providing the ability to detect the completion of the piston stroke. In one alternative configuration, the valve may be integrated into the cylinder, rather than into the piston. Still further, in embodiments of a tractor that is reversible in direction, piston poppet valves, or other mechanically actuated valves, may be provided on both sides of a piston for detecting the completion of a power stroke in either direction.

Preferred Configuration of Control Assembly

Figure 43:
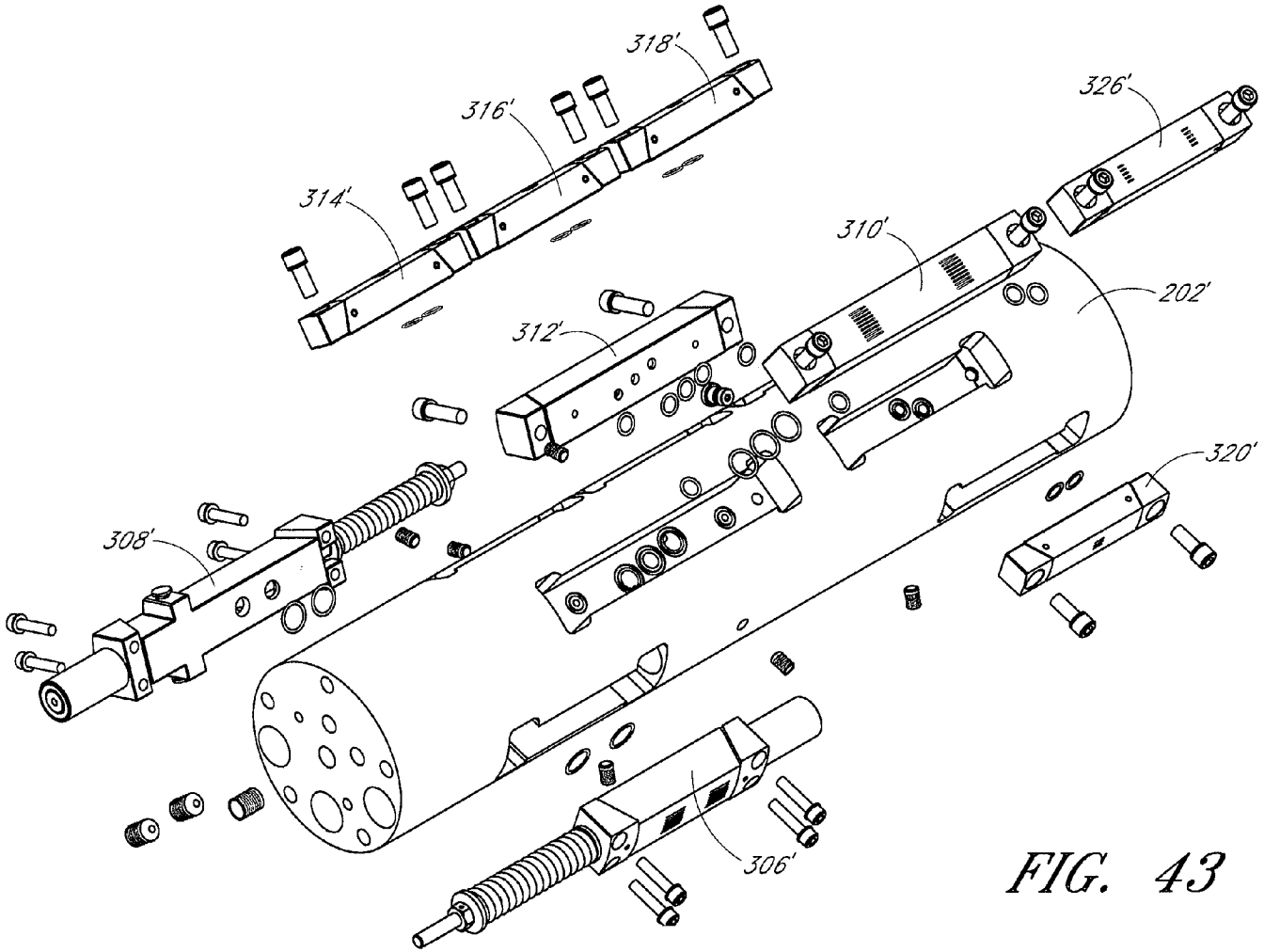
FIG. 43 is an exploded view of the central housing of the valve control assembly.
Figure 44:
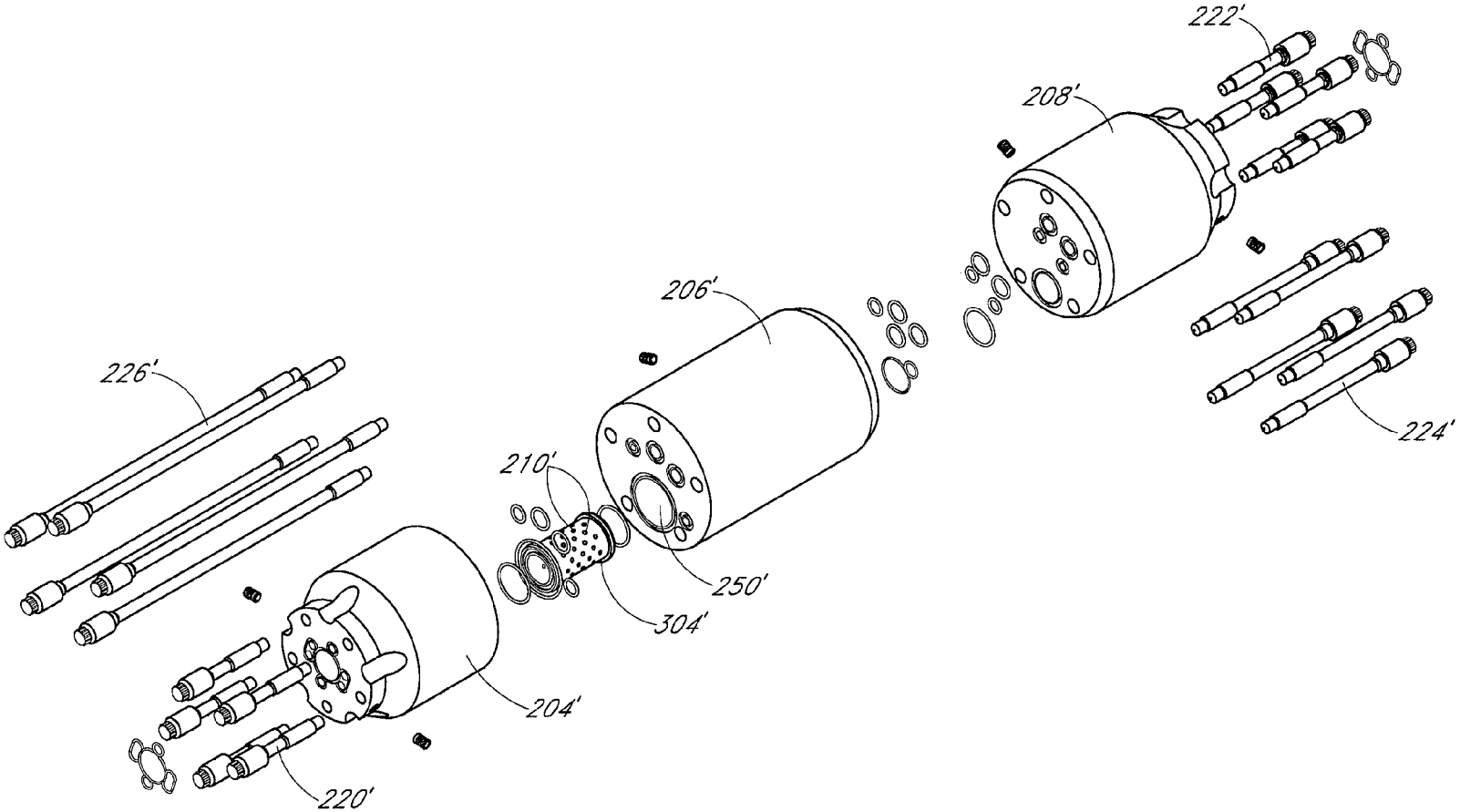
FIG. 44 is an exploded view of the transition regions located at the aft and forward ends of the valve control assembly.

With reference now to FIGS. 43 and 44, a preferred embodiment of the control assembly (see element 102' of FIG. 36) is shown partially disassembled. FIG. 43 illustrates a control housing 202', which forms the central portion of the control assembly. FIG. 44 illustrates the aft transition housing 204', the filter housing 206' and the forward transition housing 206'. Connectors 220' are provided for coupling the aft transition housing 204' to the aft shaft and connectors 222' are provided for coupling the forward transition housing 206' to the forward shaft. Connectors 226' couple the aft transition housing 204' and the filter housing 206' to the control assembly 202'. Connectors 224' couple the forward transition housing 208' to the control assembly 202'.

With reference again to FIG. 43, one preferred embodiment of the control housing 202' houses the propulsion control valve 310', the gripper control valve 312', the pressure relief valve 306', the pressure reducing valve 326', the start/stop valve 308', the aft sequence valve 314', the forward sequence valve 316', the aft vent valves 318', and the forward vent valve 320'. Each of the valves preferably comprises a spool housed within an elongate valve housing defining a spool passage. In one configuration, the valves are positioned within recesses along the outer surface of the control housing 202'.

The propulsion control valve 310', gripper control valve 312', pressure reducing valve 326', vent valves 318', 320' and sequence valves 314', 316' are preferably all configured in a similar manner for ease of manufacture. In particular, each of the valves is provided in an elongate housing that fits within a recess along the outer surface of the control assembly 202'. The valve housings are each attached to the body of the control assembly via two bolts or other appropriate attachment means. The pressure relief valve 306' and the start/stop valve 308' are preferably configured in a similar manner. In one embodiment, the pressure relief valve 306' and start/stop valve 308' are both attached to the body of the control assembly via four bolts or other appropriate means for attachment.

The central housing 202' includes numerous internal fluid passages for the controlled flow of operating fluid to the downhole equipment (see element 32' of FIG. 35), between the valves, to the gripper assemblies, and to the propulsion cylinders. In one preferred embodiment, the fluid passages are configured to create the valve system shown schematically in FIG. 37. Some of the fluid passages extend to corresponding fluid passages in the end surfaces of the transition housings 204', 206' and 208'. In a preferred embodiment, the primary internal passage is shifted off center to maximize available space for the various valves and internal fluid passages.

An internal passage 250' extends through the aft transition housing 204', the filter housing 206' and the forward transition housing 208'. The internal passage also extends through the aft and forward shafts and the control housing 202' such that pressurized fluid from the supply line may pass through the tractor body to the downhole assembly. As shown in FIG. 44, the filter housing 206' houses the filter/diffuser 304'. The filter/diffuser 304' is generally cylindrical and has a plurality of side holes 210' for allowing filtered fluid to pass from the internal passage to the start/stop valve 308' (as shown schematically in FIG. 37). In one preferred embodiment, the side holes 210' are angled so that the fluid passing forward through the filter/diffuser 304' must turn somewhat aftward to pass through. This prevents larger particles within the operating fluid from entering the start-stop valve 308', as it is more difficult for the larger particles to overcome forward momentum and flow through the side holes. Those of ordinary skill in the art will understand that any of a variety of different types of filters can be used instead of the illustrated diffuser 304'.

Tractor Operation

With reference again to FIG. 37, pressurized fluid is provided to the control assembly from a supply source (e.g., on the surface) via a supply line 302'. The supply line 302' preferably extends through an internal passage in the elongate tractor body for providing pressurized fluid to the downhole equipment. When the pressure in the supply line 302' increases above a pre-selected threshold (e.g., 900 psi), the start-stop valve 308' opens if the index is in the on position. If the index is in the off position, a pressure cycle (e.g., dropping the pressure to 0 psi and then back up to 900 psi) will change the drum index to the on position. When the start/stop valve 308' is open, the supply flow takes parallel paths to the pressure relief valve 306', the propulsion control valve 310' and the pressure reducing valve 326'.

As discussed above, it has been found that the pressure of the operating fluid in the supply line 302' can fluctuate significantly during movement of the tractor and/or operation of the downhole equipment. Under certain circumstances, the pressure fluctuations can be substantial and can damage internal components and render other hydraulically coupled tools inoperable or incompatible. Accordingly, the pressure relief valve 306' is provided for regulating the fluid pressure in the supply line 302' (i.e., in the internal passage), and thus in the valve system located within the control assembly. In an important feature, the pressure of the fluid flowing to both the control assembly and the downhole equipment is desirably regulated. This feature improves the efficiency of the bottom hole assemblies and extends the life of the hardware components. In addition, the pressure relief valve 306' is off when the start-stop valve 308' is closed. This feature advantageously allows high-pressure (i.e., non-regulated) fluid to be selectively directed to the downhole equipment when desired.

After passing through the start-stop valve 308', the pressurized fluid flows along path 354' to the pressure reduction valve 326' and then on to the gripper control valve 312'. In the illustrated configuration, the gripper control valve 312' is shifted to the right such that the fluid in flow path 370' is pressurized and the fluid in flow path 372' is depressurized. As a result, the aft gripper assembly begins expanding in a radial direction for engagement with the inner surface of the borehole and the forward gripper assembly contracts radially for disengagement from the inner surface of the borehole. When the aft gripper assembly become fully actuated, the fluid flow through flow path 370' stops and, as a result, the fluid pressure increases substantially (i.e., to the system pressure) in flow paths 370' and 364'. During this time, the pressure reducing valve 326' protects the aft gripper assembly from damage due to over-pressurization.

When the aft gripper assembly has becomes sufficiently fully engaged, the pressure in the flow path 364' exceeds the preset threshold (e.g., 900 psid) of the aft sequence valve 314'. As a result, fluid flows through the aft sequence valve 314' and acts on the first end surface 330' of the propulsion control valve 310', thereby causing the spool to shift to the right (as shown in FIG. 37). Accordingly, the valve system is configured such that the gripper assembly becomes fully actuated before the propulsion control valve initiates a power stroke.

In this position, pressurized fluid passes through the propulsion control valve 310' to the power chamber of the aft cylinder and to the reset chamber of the forward cylinder. As fluid enters the power chamber of the aft cylinder, the pressurized fluid pushes on the aft piston and thereby causes the tractor body to advance forward through the borehole relative to the aft gripper assembly (which is anchored to the inner surface). Movement of this type is generally referred to herein as a power stroke. At the same time, as fluid enters the reset chamber of the forward cylinder, the pressurized fluid pushes the forward cylinder and forward gripper assembly forward relative to the tractor body. This movement resets the position of the forward gripper assembly prepares the forward cylinder for a subsequent power stroke. Movement of this type is generally referred to herein as a reset stroke. Because the resistance to a reset stroke is relatively small, the reset stroke is typically completed before the power stroke is completed.

As the tractor body reaches the end of the power stroke with respect to the aft cylinder, the aft piston poppet valve 322' is actuated. This occurs when a stem on the aft piston poppet valve comes into contact with a portion of the aft cylinder such that the stem is mechanically depressed. When the stem is depressed, pressurized fluid enters a flow passage 382'. When the pressure in flow path 382' becomes sufficiently large, the aft vent valve 318' opens to allow pressurized fluid to pass through to the second end surface 336' of the gripper control valve 312'. The fluid pressure causes the spool in the gripper control valve 312' to shift to the left (i.e., to the position not shown in FIG. 37).

After the gripper control valve 312' switches its position, the fluid within the flow path 370' becomes depressurized and the fluid within the flow paths 366' and 372' becomes pressurized. When the pressure in flow path 366' becomes sufficiently large, the forward sequence valve 316' opens such that pressurized fluid acts on second end surface 332' of the propulsion control valve 310' and causes the spool to shift to the left (i.e., to the position not shown in FIG. 37). The pressure in flow path 366' becomes sufficiently large to open the forward sequence valve 316' after the forward gripper assembly comes into contact with the inner surface of the borehole and is therefore prevented from expanding any further. When the forward gripper assembly stops expanding, the flow to the forward gripper assembly through flow path 372' is stopped, thereby producing an increase in fluid pressure.

Due to the shifting of the spool in the propulsion control valve 310', pressurized fluid within the flow path 354' flows through the propulsion control valve 310' and into the forward chamber of the forward cylinder and the aft chamber of the aft cylinder. Simultaneously, fluid within the aft chamber of the forward cylinder, as well as fluid within the forward chamber of the aft cylinder, flows back through the propulsion control valve 310' into the annulus 40'. This causes the forward piston, and thus the entire tractor body, to be thrust forward through the borehole with respect to the actuated forward gripper assembly in another power stroke. Simultaneously, the aft cylinder is thrust forward with respect to the piston and the tractor body in a reset stroke.

As the tractor body reaches the end of the power stroke with respect to the forward cylinder, the forward piston poppet valve 324' is actuated. This occurs when a stem on the forward piston poppet valve comes into contact with a portion of the forward cylinder such that the stem on the forward piston poppet valve is mechanically depressed. When the stem is depressed, pressurized fluid enters flow passage 380'. When the pressure in flow path 380' is sufficiently large to overcome the pre-selected threshold pressure, the forward vent valve 320' opens to allow pressurized fluid to pass through to the first end surface 334' of the gripper control valve 312'. The fluid pressure causes the spool in the gripper control valve 312' to shift back to the right (i.e., to the position shown in FIG. 37). At this point, all of the valves have returned back to their original positions (i.e., to the positions generally shown in FIG. 37). Thus, the above describes a complete cycle of operation of the valve system during forward motion.

Note that during forward or aft (i.e., backward) motion, the gripper assemblies preferably shuttle between two extreme positions. First, the gripper assemblies move as far apart as possible toward opposite ends of the tractor. Second, the gripper assemblies move as close together as possible (with the propulsion cylinders and control assembly between them). During most of the operation of the tractor, one gripper assembly is in a power stroke while the other is in a reset stroke. When they switch directions they also switch gripper action. Hence, the tractor continually moves in one longitudinal direction.

A significant advantage of the preferred configuration of the valve system is that the tractor body is assured of completing its forward advancement (i.e., power stroke) before the gripper assemblies are switched between their actuated and retracted positions. As described above, the reliability and efficiency of the tractor movement may be improved by the incorporation of the mechanically-actuated valves (e.g., piston poppet valve) into the valve system. The piston poppet valves provide a mechanism to detect and signal the completion of a power stroke. In addition, in a preferred configuration, the outlet from the gripper control valve 312' is used to pilot the propulsion control valve 310'. As a result, the system ensures that the gripper is fully actuated before a power stroke commences.

In one preferred embodiment, the flow rate of operating fluid into the valve system in the control assembly can be up to about 23 gallons per minute. Typically, large positive displacement pumps are utilized at the ground surface to pump fluid down the coiled tubing and through the internal passage of the tractor. Such pumps usually supply a system flow rate of up to about 120 gpm. In one typical mode of operation, the valve system receives approximately 20% of the fluid passing through the internal passage of the tractor body. In other modes of operation, the valve system receives approximately 5%, 10%, 15% or 25% of the fluid passing through the internal passage.

In a preferred embodiment of the tractor wherein the valve system is all-hydraulic, the tractor's maximum speed may be greater than that of an electrically controlled tractor. The valve system does not include electrical conductors and other electrical elements, which allows for larger internal fluid passages, greater flow rates, and improved power density. The faster maximum speed of the tractor results in lower operational costs, especially for intervention applications. In one preferred embodiment of the invention, the tractor is capable of moving at speeds greater than or equal to 1350 feet per hour.

Reversible Tractor

Figure 45:
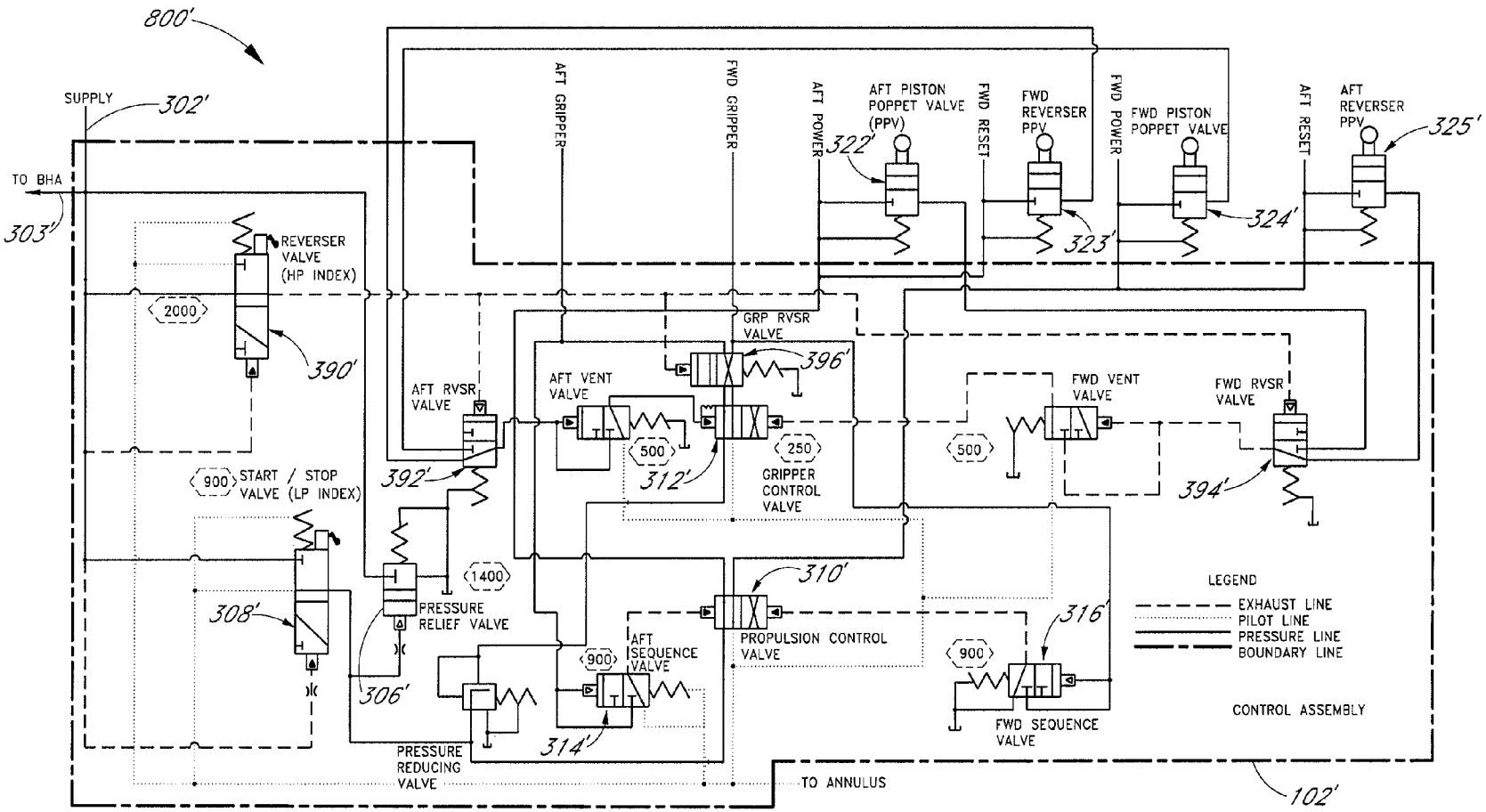
FIG. 45 is a schematic diagram illustrating another preferred embodiment of a valve control assembly for use with the reversible tractor.

In another preferred embodiment, the tractor may be capable of movement through a passage in both forward and aft directions. With reference now to FIG. 45, one embodiment of an improved valve system 800' is illustrated for use with a reversible tractor. Similar to the valve system described above with reference to FIG. 37, the improved valve system 800' illustrated in FIG. 45 receives pressurized fluid from a supply line 302'. The pressurized fluid passes through a start-stop valve 308' for providing hydraulic power to the tractor control assembly 102'. To provide the tractor operator with the ability to selectively reverse directions, the valve system 800' in the control assembly further comprises a main reverser valve 390', an aft reverser valve 392', a forward reverser valve 394', and a gripper reverser valve 396'. The main reverser valve 390' is piloted by fluid pressure in the supply line 302'. The main reverser valve 390', in turn, pilots the aft reverser valve 392', the forward reverser valve 394' and the gripper reverser valve 396'.

Similar to the embodiment described above with respect to FIG. 37, the improved valve system 800' for use with a reversible tractor preferably comprises an aft piston poppet valve 322', and a forward piston poppet valve 324'. The aft and forward piston poppet valves 322', 324' are adapted for detecting the completion of the piston stroke during forward advancement through the passage. In addition, the improved valve system shown in FIG. 45 comprises a forward reverser piston poppet valve 323', and an aft reverser piston poppet valve 325' for detecting completion of the piston stroke during aft movement through the passage. Therefore, as shown in FIG. 45, the improved valve system 800' is provided with two piston poppet valves on both the forward and aft pistons. As a result, the tractor is capable of providing accurate and efficient valve sequencing during movement in either the forward or aft direction. Because each piston includes two piston poppet valves, two independent pilot passages are preferably provided in the wall of the shaft for each piston.

During use, when the main reverser valve 390' is in the closed position (as shown in FIG. 45), no fluid passes through the main reverser valve and the valve system 800' operates in a manner similar to the manner described above with respect to FIG. 37. However, when the pressure in the supply line 302' is increased above a pre-selected threshold (e.g., 2000 psi), the main reverser valve 390' is indexed to the open position. As a result, the pressurized fluid in the supply line 302' passes through the main reverser valve 390' to the aft reverser valve 392', the forward reverser valve 394', and the gripper reverser valve 396'. The fluid pressure causes the aft reverser valve 392', the forward reverser valve 394', and the gripper reverser valve 396' to change positions, thereby altering the sequencing of the valve operation. In particular, the aft and forward reverser valves 392', 394' allow the forward reverser piston poppet valve 323' and aft reverser piston poppet valve 325' to pilot the aft and forward vent valves during aft movement through the passage. Furthermore, the gripper reverser valve 396' changes the flow path from the gripper control valve 312' such that the desired gripper assembly is actuated before initiation of a power stroke.

In preferred alternative configurations, the improved valve system illustrated in FIG. 45 may also include a pressure relief valve 306' and aft and forward sequence valves 314', 316', as generally described above with reference to FIG. 37. Additional details of a tractor having the ability to reverse directions may be found in Applicant's U.S. Publication No. 2002/0112859 A1, which is incorporated herein by reference.

Gripper Assemblies

Preferred embodiments of the tractor described herein may be used with a wide variety of different gripper assemblies. However, in preferred embodiments, the gripper assemblies 104' and 106' are embodied as a plurality of toes that are radially expandable for engaging the inner surface of the borehole. FIGS. 46-53 illustrate various preferred configurations of preferred gripper assemblies adapted for use with a tractor. Additional details can be found in Applicant's copending U.S. application Ser. No. 10/004,963, entitled "IMPROVED GRIPPER ASSEMBLY FOR DOWNHOLE TRACTORS," filed on Dec. 3, 2001. In a preferred embodiment, the gripper assemblies 104' and 106' are substantially identical. Thus, the gripper assembly configurations shown in FIGS. 46-53 may be considered to describe both aft and forward gripper assemblies 104' and 106'.

Figure 46:
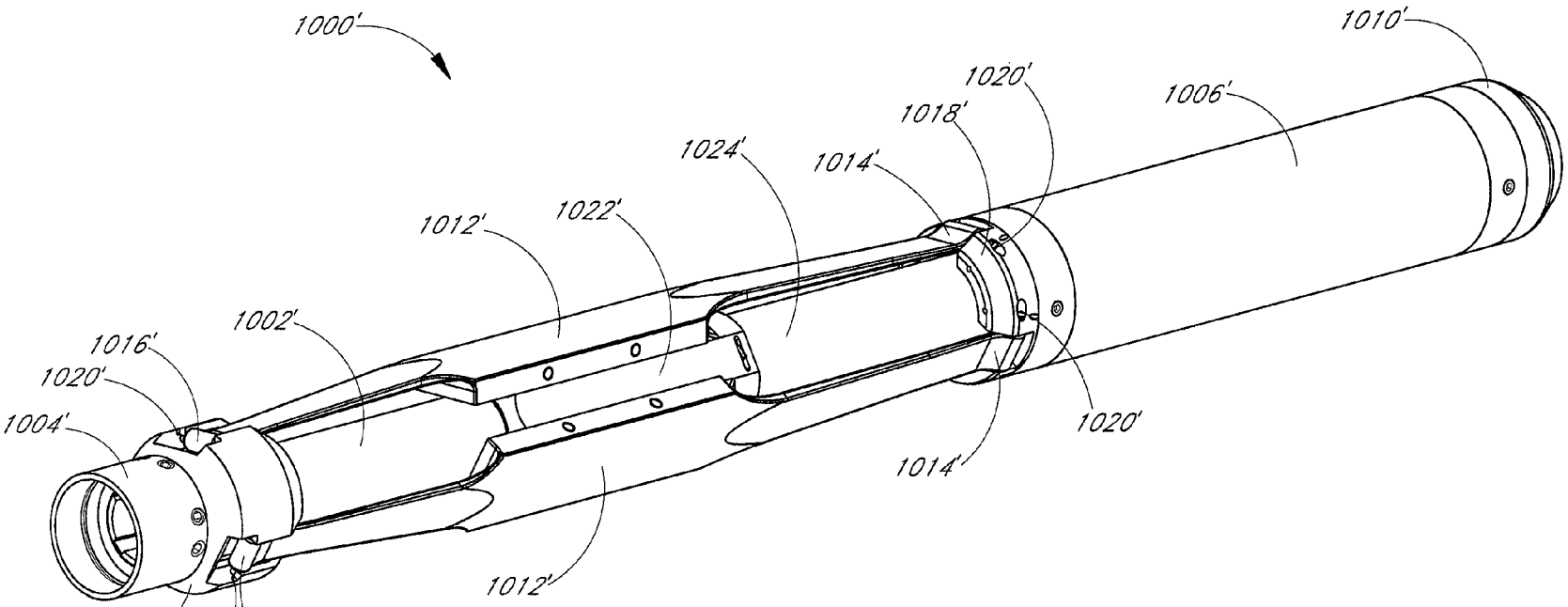
FIG. 46 is a perspective view of a gripper assembly having rollers secured to its toes, shown in a retracted or non-gripping position.

FIG. 46 shows one preferred embodiment of a gripper assembly 1000'. The illustrated gripper assembly includes an elongated generally tubular mandrel 1002' configured to slide longitudinally along a length of the tractor 50'. Preferably, the interior surface of the mandrel 1002' has a splined interface (e.g., tongue and groove configuration) with the exterior surface of the shaft, so that the mandrel 1002' is free to slide longitudinally yet is prevented from rotating with respect to the shaft. In another embodiment, splines are not included. Fixed mandrel caps 1004' and 1010' are connected to the forward and aft ends of the mandrel 1002', respectively. On the forward end of the mandrel 1002', near the mandrel cap 1004', a sliding toe support 1006' is longitudinally slidably engaged on the mandrel 1002'. Preferably, the sliding toe support 1006' is prevented from rotating with respect to the mandrel 1002', such as by a splined interaction therebetween. On the aft end of the mandrel 1002', a cylinder 1008' is positioned next to the mandrel cap 1010' and concentrically encloses the mandrel so as to form an annular space therebetween. As shown in FIG. 46, this annular space contains a piston 1038', an aft portion of a piston rod 1024', a spring 1044', and fluid seals, for reasons that will become apparent.

The cylinder 1008' is fixed with respect to the mandrel 1002'. A toe support 1018' is fixed onto the forward end of the cylinder 1008'. A plurality of gripper portions 1012' are secured onto the gripper assembly 1000'. In the illustrated embodiment the gripper portions comprise flexible toes or beams 1012'. The toes 1012' have ends 1014' pivotally or hingedly secured to the fixed toe support 1018' and ends 1016' pivotally or hingedly secured to the sliding toe support 1006'. As used herein, "pivotally" or "hingedly" describes a connection that permits rotation, such as by an axle, pin, or hinge.

The ends of the toes 1012' are preferably engaged on axles, rods, or pins secured to the toe supports.

Those of skill in the art will understand that any number of toes 1012' may be provided. As more toes are provided, the maximum radial load that can be transmitted to the borehole surface is increased. This improves the gripping power of the gripper assembly 1000', and therefore permits greater radial thrust and drilling power of the tractor. However, it is preferred to have three toes 1012' for more reliable gripping of the gripper assembly 1000' onto the inner surface of a borehole. For example, a four-toed embodiment could result in only two toes making contact with the borehole surface in oval-shaped holes. Additionally, as the number of toes increases, so does the potential for synchronization and alignment problems of the toes. In addition, at least three toes 1012' are preferred, to substantially prevent the potential for rotation of the tractor about a transverse axis, i.e., one that is generally perpendicular to the longitudinal axis of the tractor body. For example, the three-bar linkage gripper described above has only two linkages. Even when both linkages are actuated, the tractor body can rotate about the axis defined by the two contact points of the linkages with the borehole surface. A three-toe embodiment of the present invention substantially prevents such rotation. Further, gripper assemblies having at least three toes 1012' are more capable of traversing underground voids in a borehole.

A driver or slider element 1022' is slidably engaged on the mandrel 1002' and is longitudinally positioned generally at about a longitudinal central region of the toes 1012'. The slider element 1022' is positioned radially inward of the toes 1012', for reasons that will become apparent. A tubular piston rod 1024' is slidably engaged on the mandrel 1002' and connected to the aft end of the slider element 1022'. The piston rod 1024' is partially enclosed by the cylinder 1008'. The slider element 1022' and the piston rod 1024' are preferably prevented from rotating with respect to the mandrel 1002', such as by a splined interface between such elements and the mandrel.

Figure 47:
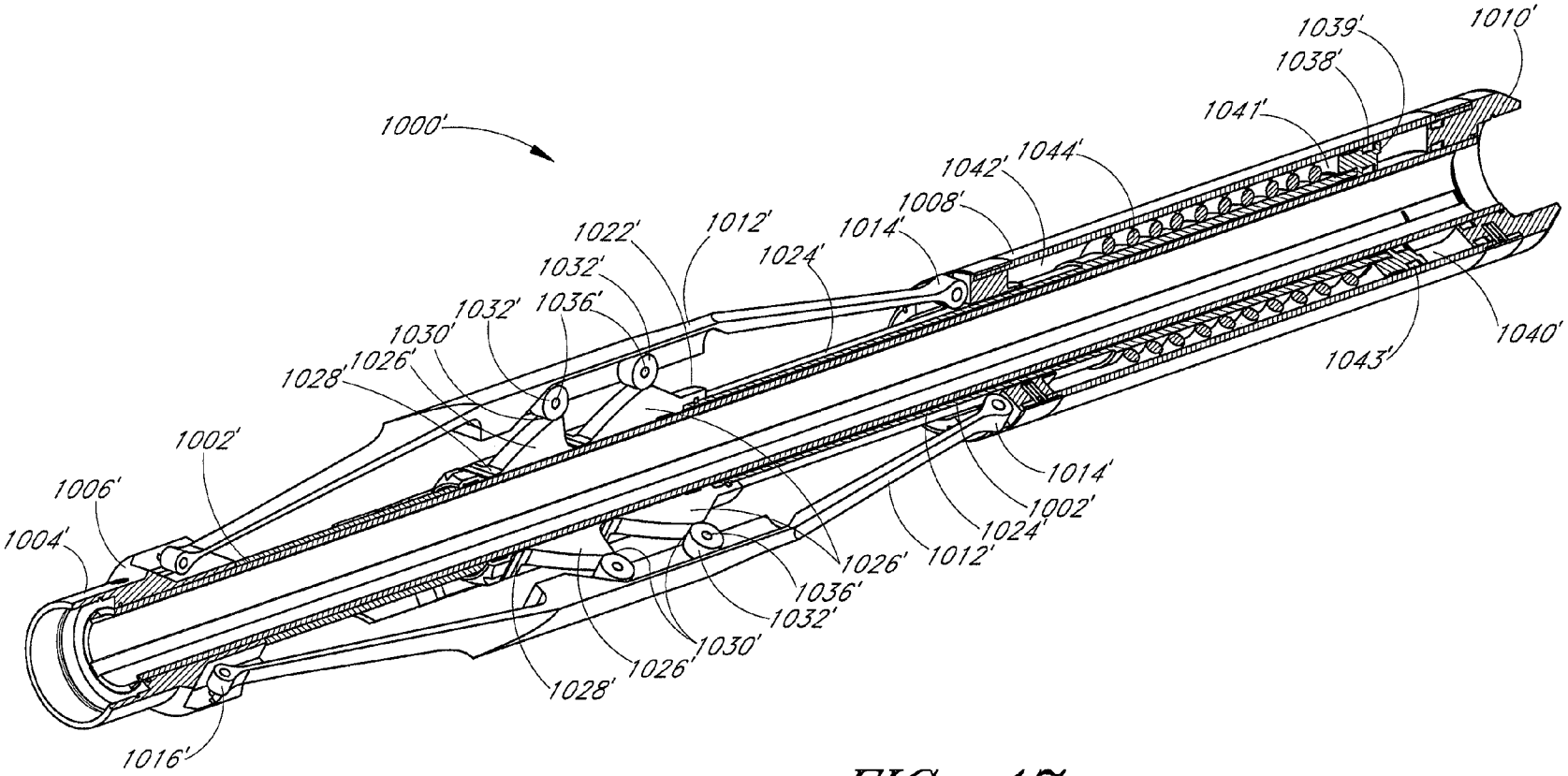
FIG. 47 is a longitudinal cross-sectional view of a gripper assembly having rollers secured to its toes, shown in an actuated or gripping position.
Figure 48:
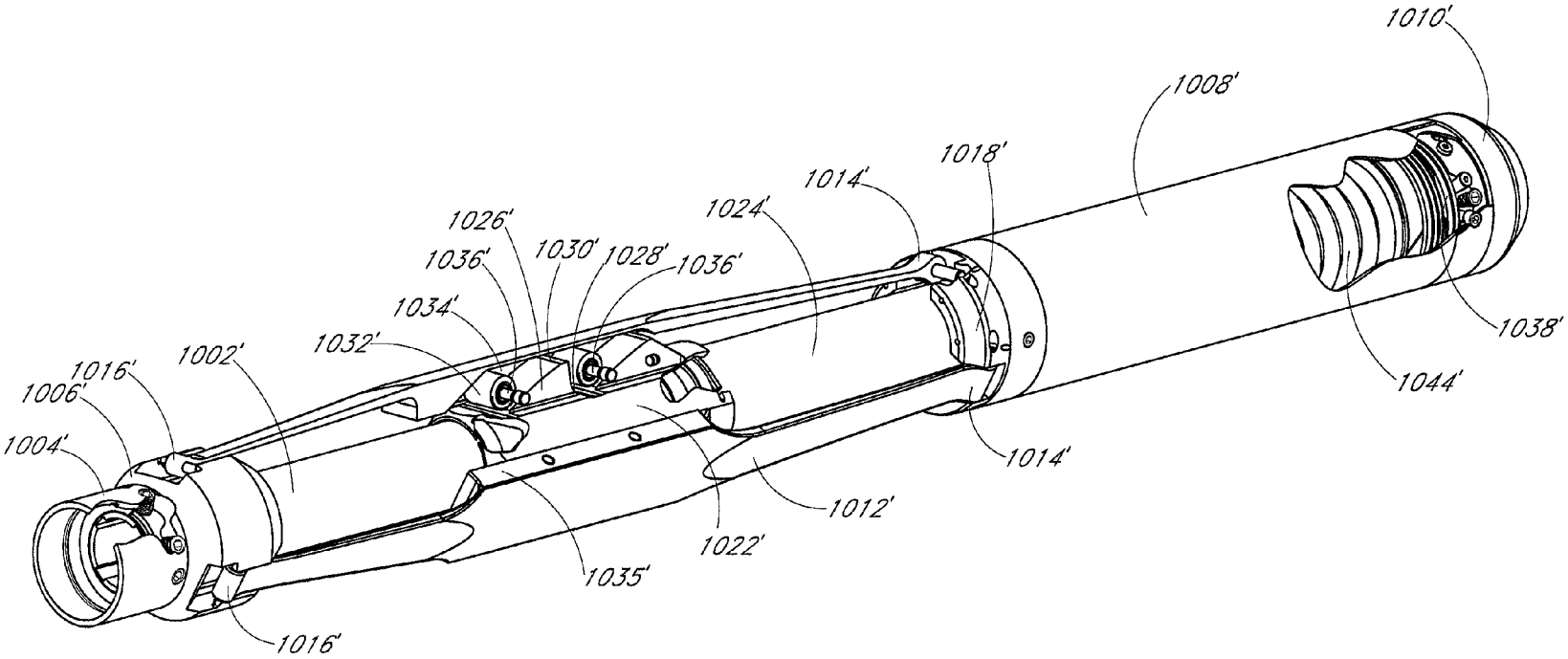
FIG. 48 is a perspective partial cut-away view of the gripper assembly of FIG. 12.
Figure 49:
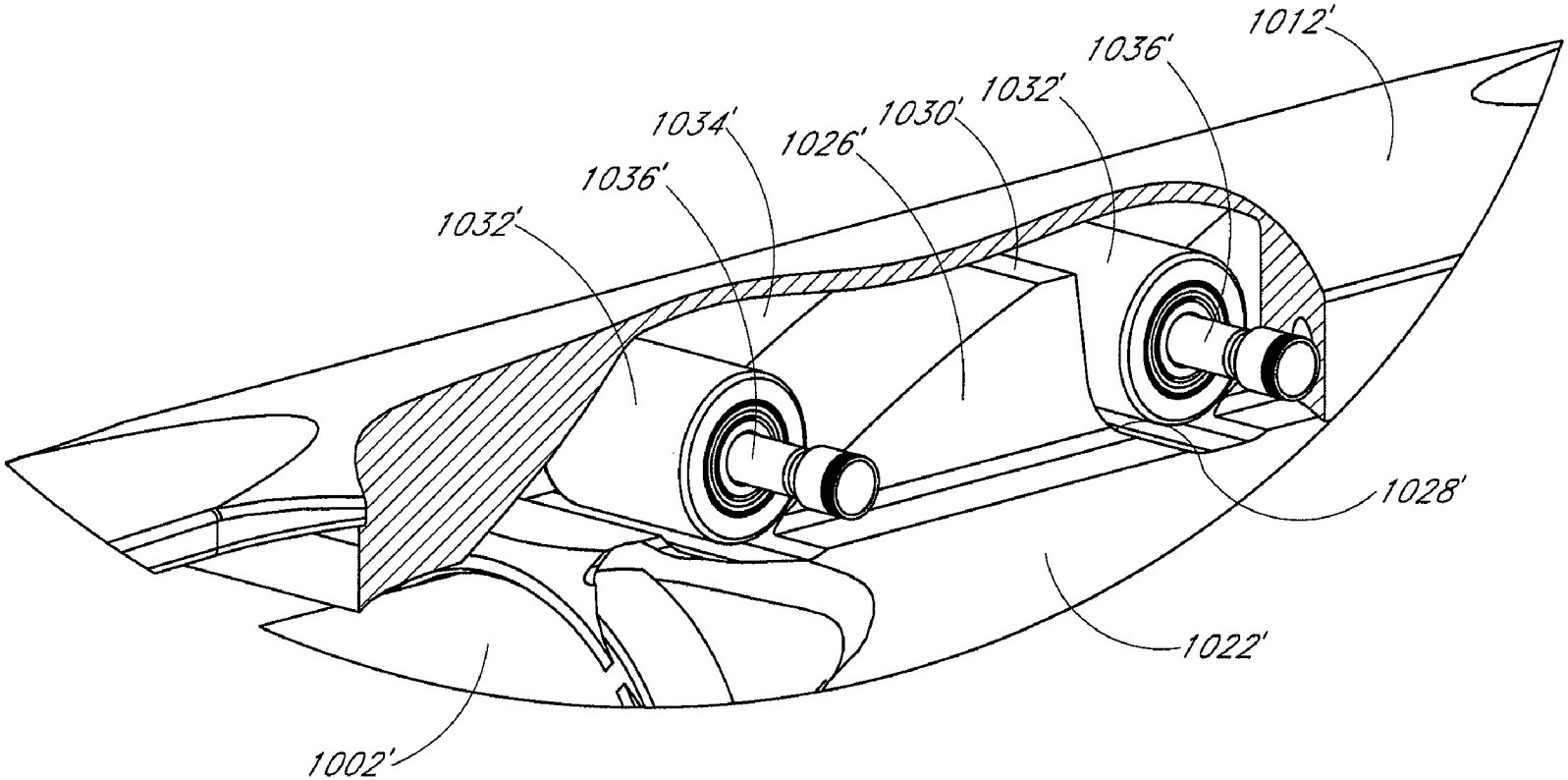
FIG. 49 is an exploded view of one set of rollers for a toe of the gripper assembly of FIG. 14.

FIG. 47 shows a longitudinal cross-section of a gripper assembly 1000'. FIGS. 48 and 49 show a gripper assembly 1000' in a partial cut-away view. As seen in the figures, the slider element 1022' includes a multiplicity of wedges or ramps 1026'. Each ramp 1026' slopes between an inner radial level 1028' and an outer radial level 1030', the inner level 1028' being radially closer to the surface of the mandrel 1002' than the outer level 1030'. Desirably, the slider element 1022' includes at least one ramp 1026' for each toe 1012'. Of course, the slider element 1022' may include any number of ramps 1026' for each toe 1012'. In the illustrated embodiments, the slider element 1022' includes two ramps 1026' for each toe 1012'. As more ramps 1026' are provided for each toe, the amount of force that each ramp must transmit is reduced, producing a longer fatigue life of the ramps. Also, the provision of additional ramps results in more uniform radial displacement of the toes 1012', as well as radial displacement of a relatively longer length of the toes 1012', both resulting in better overall gripping onto the borehole surface.

In a preferred embodiment, two ramps 1026' are spaced apart generally by the length of the central region 1048' of each toe 1012'. In this embodiment, when the gripper assembly is actuated to grip onto a borehole surface, the central regions 1048' of the toes 1012' have a greater tendency to remain generally linear. This results in a greater surface area of contact between the toes and the borehole surface, for better overall gripping. Also, a more uniform load is distributed to the toes to facilitate better gripping. With more than two ramps, there is a greater proclivity for uneven load distribution as a result of manufacturing variations in the radial dimensions of the ramps 1026', which can result in premature fatigue failure.

Each toe 1012' is provided with a driver interaction element on the central region of the toe. The driver interaction element interacts with the driver or slider element 1022' to vary the radial position of the central region 1048' of the toe 1012'. Preferably, the driver and driver interaction element are configured to interact substantially without production of sliding friction therebetween. In the illustrated embodiments, the driver interaction element comprises one or more rollers 1032' that are rotatably secured on the toes 1012' and configured to roll upon the inclined surfaces of the ramps 1026'. Preferably, there is one roller 1032' for every ramp 1026' on the slider element 1022'. In the illustrated embodiments, the rollers 1032' of each toe 1012' are positioned within a recess 1034' on the radially interior surface of the toe, the recess 1034' extending longitudinally and being sized to receive the ramps 1026'. The rollers 1032' rotate on axles 1036' that extend transversely within the recess 1034'. The ends of the axles 1036' are secured within holes in the sidewalls 1035' that define the recess 1034'.

The piston rod 1024' connects the slider element 1022' to a piston 1038' enclosed within the cylinder 1008'. The piston 1038' has a generally tubular shape. The piston 1038' has an aft or actuation side 1039' and a forward or retraction side 1041'. The piston rod 1024' and the piston 1038' are longitudinally slidably engaged on the mandrel 1002'. The forward end of the piston rod 1024' is attached to the slider element 1022'. The aft end of the piston rod 1024' is attached to the retraction side 1041' of the piston 1038'. The piston 1038' fluidly divides the annular space between the mandrel 1002' and the cylinder 1008' into an aft or actuation chamber 1040' and a forward or retraction chamber 1042'. A seal 1043', such as a rubber O-ring, is preferably provided between the outer surface of the piston 1038' and the inner surface of the cylinder 1008'. A return spring 1044' is engaged on the piston rod 1024' and enclosed within the cylinder 1008'. The spring 1044' has an aft end attached to and/or biased against the retraction side 1041' of the piston 1038'. A forward end of the spring 1044' is attached to and/or biased against the interior surface of the forward end of the cylinder 1008'. The spring 1044' biases the piston 1038', piston rod 1024', and slider element 1022' toward the aft end of the mandrel 1002'. In the illustrated embodiment, the spring 1044' comprises a coil spring. The number of coils and spring diameter is preferably chosen based on the required return loads and the space available. Those of ordinary skill in the art will understand that other types of springs or biasing means may be used.

Figure 50:
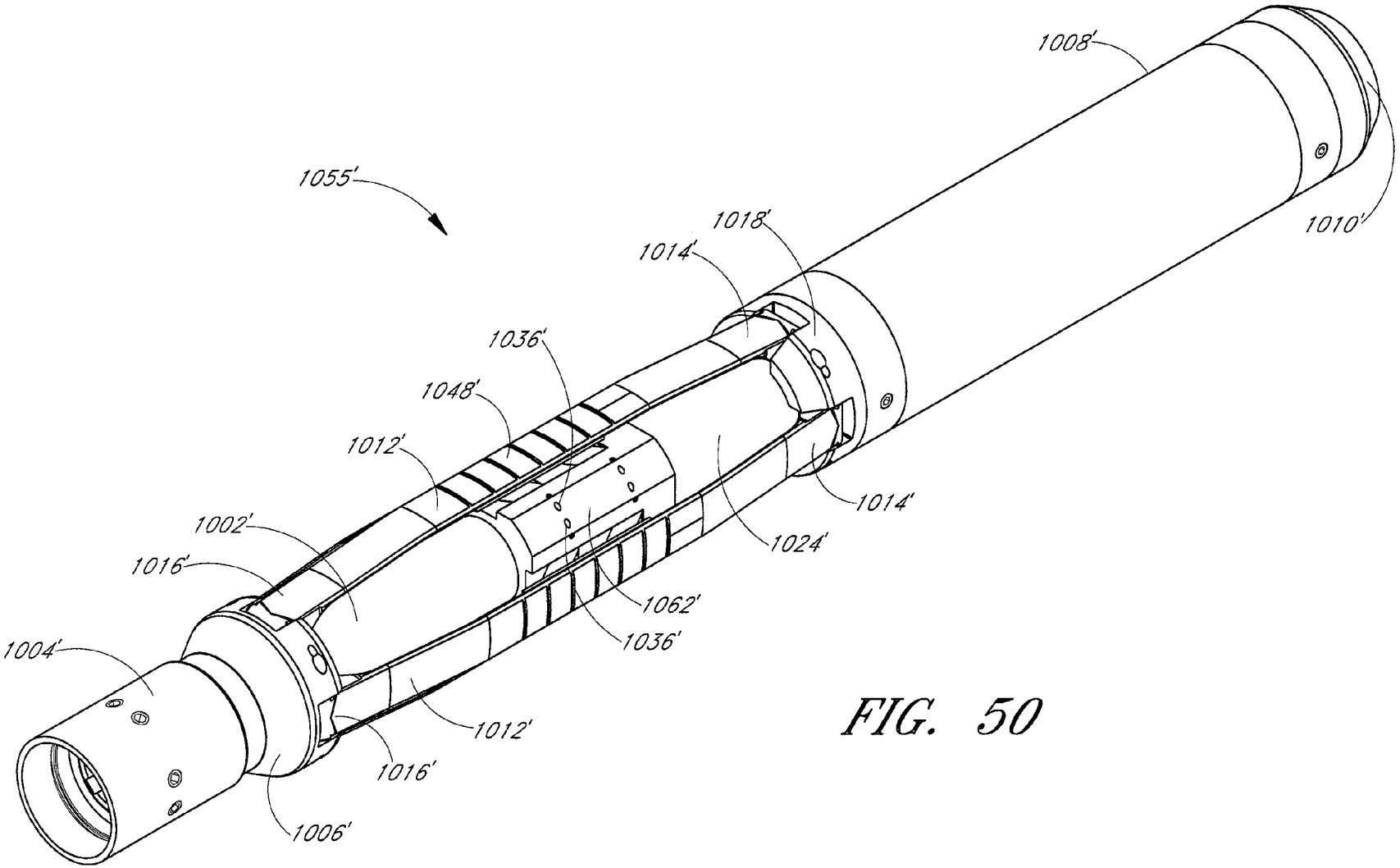
FIG. 50 is a perspective view of a gripper assembly having rollers secured to its slider element.
Figure 51:
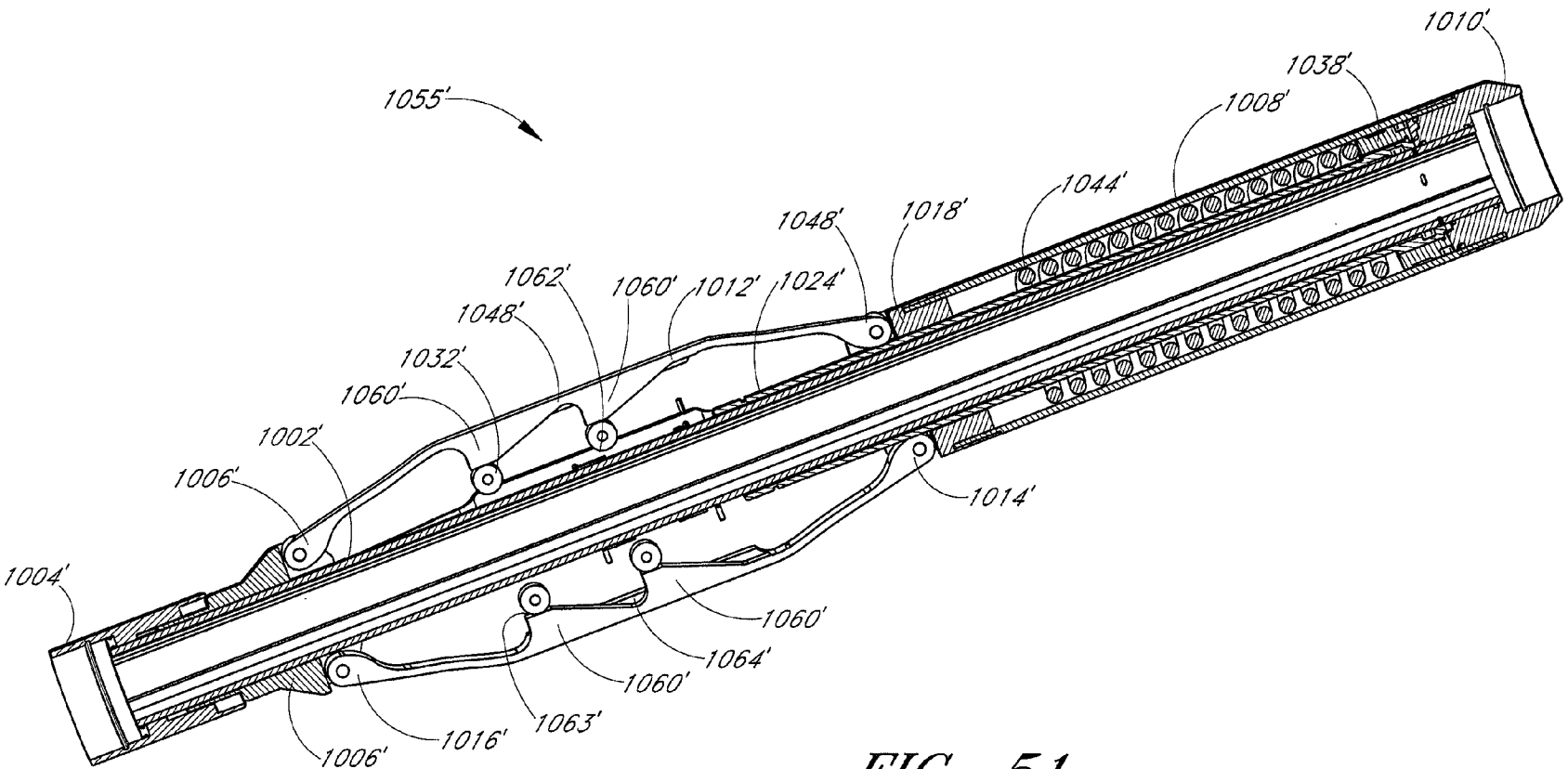
FIG. 51 is a longitudinal cross-sectional view of a gripper assembly having rollers secured to its slider element.

FIGS. 50 and 51 show a gripper assembly 1055' according to an alternative embodiment of the invention. In this embodiment, the rollers 1032' are located on a driver or slider element 1062'. The toes 1012' include a driver interaction element that interacts with the driver to vary the radial position of the central sections 1048' of the toes. In the illustrated embodiment, the driver interaction element comprises one or more ramps 1060' on the interior surfaces of the central sections 1048'. Each ramp 1060' slopes from a base 1064' to a tip 1063'. The slider element 1062' includes external recesses sized to receive the tips 1063' of the ramps 1060'. The roller axles 1036' extend transversely across these recesses, into holes in the sidewalls of the recesses. Preferably, the ends of the roller axles 1036' reside within one or more lubrication reservoirs in the slider element 1062'. More preferably, such lubrication reservoirs are pressure-compensated by pressure compensation pistons, as described above in relation to the embodiments shown in FIGS. 46-49.

Although the gripper assembly 1055' shown in FIGS. 50 and 51 has four toes 1012', those of ordinary skill in the art will understand that any number of toes 1012' can be included. However, it is preferred to include three toes 1012', for more efficient and reliable contact with the inner surface of a passage or borehole. As in the previous embodiments, each toe 1012' may include any number of ramps 1060', although two are preferred. Desirably, there is at least one ramp 1060' per roller 1032'.

The gripper assembly 1055' shown in FIGS. 50 and 51 operates similarly to the gripper assembly 1000' shown in the FIGS. 46-48. The actuation and retraction of the gripper assembly is controlled by the position of the piston 1038' inside the cylinder 1008'. The fluid pressure in the actuation chamber 1040' controls the position of the piston 1038'. Forward motion of the piston 1038' causes the slider element 1062' and the rollers 1032' to move forward as well. The rollers roll against the inclined surfaces or slopes of the ramps 1060', forcing the central regions 1048' of the toes 1012' radially outward.

Figure 52:
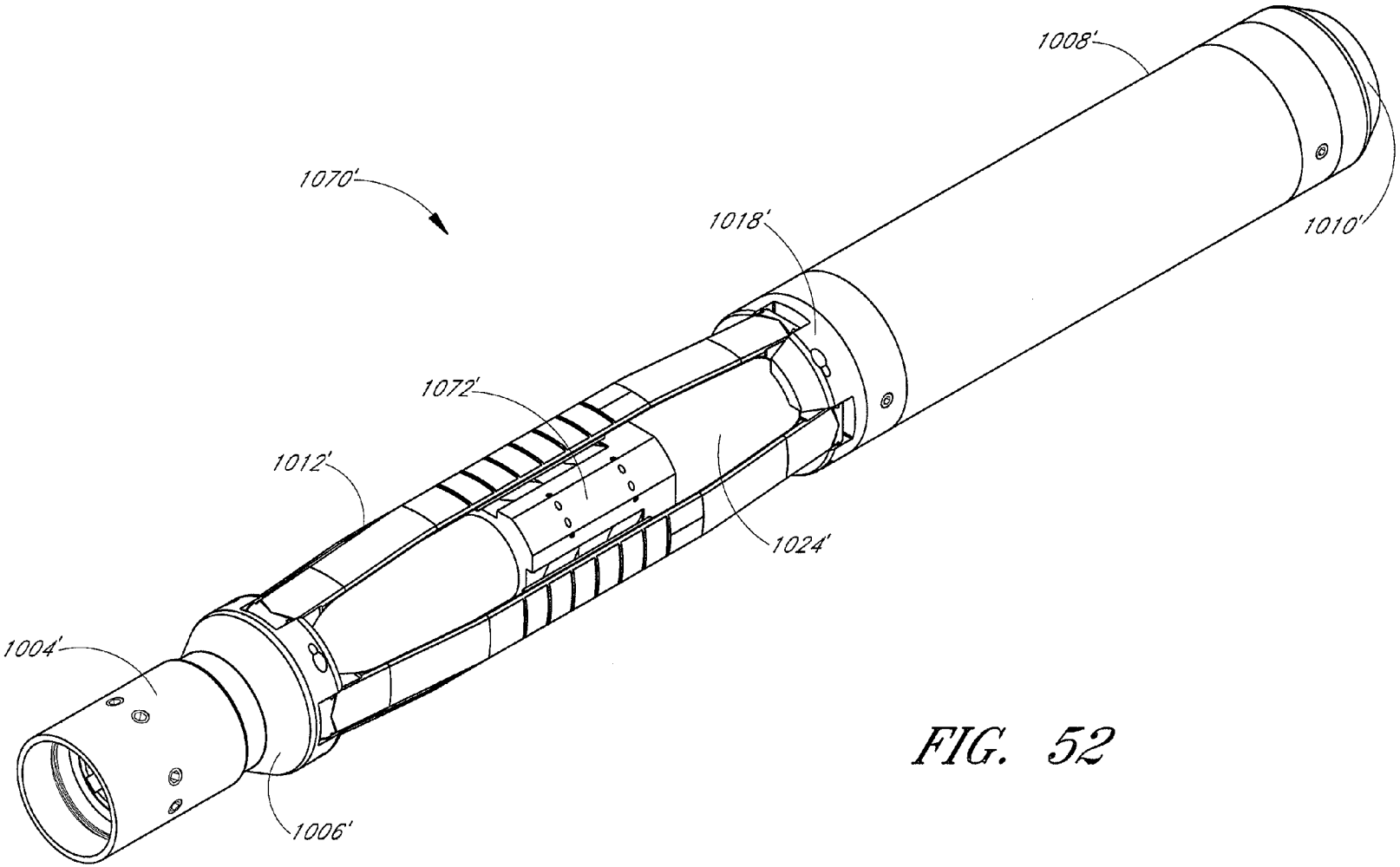
FIG. 52 is a perspective view of a retracted gripper assembly having toggles for causing radial displacement of the toes.
Figure 53:
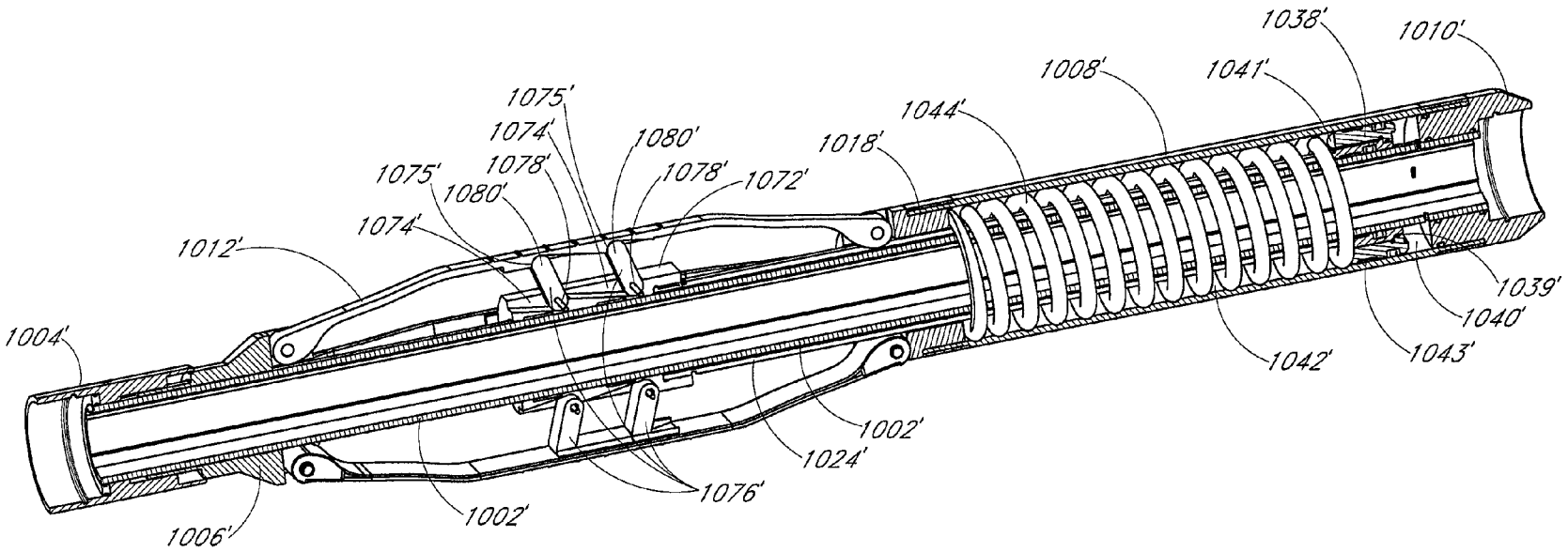
FIG. 53 is a longitudinal cross-sectional view of the gripper assembly of FIG. 18, shown in an actuated or gripping position.

FIGS. 52 and 53 show a gripper assembly 1070' having toggles 1076' for radially displacing the toes 1012'. A slider element 1072' has toggle recesses 1074' configured to receive ends of the toggles 1076'. Similarly, the toes 1012' include toggle recesses 1075' also configured to receive ends of the toggles. Each toggle 1076' has a first end 1078' received within a recess 1074' and rotatably maintained on the slider element 1072'. Each toggle 1076' also has a second end 1080' received within a recess 1075' and rotatably maintained on one of the toes 1012'. The ends 1078' and 1080' of the toggles 1076' can be pivotally secured to the slider element 1072' and the toes 1012', such as by dowel pins or hinges connected to the slider element 1062' and the toes 1012'. Those of ordinary skill in the art will understand that the recesses 1074' and 1075' are not necessary. The purpose of the toggles 1076' is to rotate and thereby radially displace the toes 1012'. This may be accomplished without recesses for the toggle ends, such as by pivoted connections of the ends.

In the illustrated embodiment, there are two toggles 1076' for each toe 1012'. Those of ordinary skill in the art will understand that any number of toggles can be provided for each toe 1012'. However, it is preferred to have two toggles having second ends 1080' generally at or near the ends of the central section 1048' of each toe 1012'. This configuration results in a more linear shape of the central section 1048' when the gripper assembly 1070' is actuated to grip against a borehole surface. This results in more surface area of contact between the toe 1012' and the borehole, for better gripping and more efficient transmission of loads onto the borehole surface.

The gripper assembly 1070' operates similarly to the gripper assemblies 1000' and 1055' described above. The gripper assembly 1070' has an actuated position in which the toes 1012' are flexed radially outward, and a retracted position in which the toes 1012' are relaxed. In the retracted position, the toggles 1076' are oriented substantially parallel to the mandrel 1002', so that the second ends 1080' are relatively near the surface of the mandrel. As the piston 1038', piston rod 1024', and slider element 1072' move forward, the first ends 1078' of the toggles 1076' move forward as well. However, the second ends 1080' of the toggles are prevented from moving forward by the recesses 1075' on the toes 1012'. Thus, as the slider element 1072' moves forward, the toggles 1076' rotate outward so that they are oriented diagonally or even nearly perpendicular to the mandrel 1002'. As the toggles 1076' rotate, the second ends 1080' move radially outward, which causes radial displacement of the central sections 1048' of the toes 1012'. This corresponds to the actuated position of the gripper assembly 1070'. If the piston 1038' moves back toward the aft end of the mandrel 1002', the toggles 1076' rotate back to their original position, substantially parallel to the mandrel 1002'.

Compared to the gripper assemblies 1000' and 1055' described above, the gripper assembly 1070' does not transmit significant radial loads onto the borehole surface when the toes 1012' are only slightly radially displaced. However, the gripper assembly 1070' comprises a significant improvement over the three-bar linkage gripper design of the prior art. The toes 1012' of the gripper assembly 1055' comprise continuous beams, as opposed to multi-bar linkages. Continuous beams have significantly greater torsional rigidity than multi-bar linkages, due to the absence of hinges, pin joints, or axles connecting different sections of the toe. Thus, the gripper assembly 1070' is much more resistant to undesired rotation or twisting when it is actuated and in contact with the borehole surface. Also, continuous beams involve few if any stress concentrations and thus tend to last longer than linkages. Another advantage of the gripper assembly 1070' over the multi-bar linkage design is that the toggles 1076' provide radial force at the central sections 1048' of the toes 1012'. In contrast, the multi-bar linkage design involves moving together opposite ends of the linkage to force a central link radially outward against the borehole surface. Thus, the gripper assembly 1070' involves a more direct application of force at the central section 1048' of the toe 1012', which contacts the borehole surface. Another advantage of the gripper assembly 1070' is that it can be actuated and retracted substantially without any sliding friction.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A tractor for moving a component through a borehole, comprising:

an elongate body;

aft and forward gripper assemblies longitudinally movably engaged with said body, said aft and forward gripper assemblies each being hydraulically actuated and defining engagement surfaces configured to selectively engage an inner surface of the borehole;

aft and forward propulsion assemblies configured to advance said body through the borehole relative to said aft and forward gripper assemblies, respectively;

a gripper control valve having a first position in which said gripper control valve directs pressurized fluid to said aft gripper assembly and a second position in which said gripper control valve directs pressurized fluid to said forward gripper assembly; and aft and forward mechanically actuated valves positioned along said body and configured to detect advancement of said body relative to said aft or forward gripper assembly, respectively;

wherein said aft and forward mechanically actuated valves are in fluid communication with said gripper control valve such that fluid pressure causes said gripper control valve to change positions after said body has completed an advancement stroke through the borehole relative to said aft or forward gripper assembly.

2. The tractor of claim 1, further comprising an aft vent valve which allows fluid to flow from said aft mechanically actuated valve to said gripper control valve only when a pressure in the fluid exceeds a pre-selected threshold pressure.

3. The tractor of claim 2, further comprising a forward vent valve which allows fluid to pass from said forward mechanically actuated valve to said gripper control valve only when a pressure in the fluid exceeds a pre-selected threshold.

4. The tractor of claim 1, further comprising aft and forward vent valves, said aft and forward mechanically actuated valves being configured to direct fluid to pilot said aft and forward vent valves, respectively, said aft and forward vent valves being configured to direct fluid to pilot said gripper control valve.

5. The tractor of claim 4, further comprising a propulsion control valve, said propulsion control valve having a first position in which said propulsion control valve directs pressurized fluid to said aft propulsion assembly and a second position in which said propulsion control valve directs pressurized fluid to said forward propulsion assembly.

6. The tractor of claim 5, wherein said propulsion control valve is piloted by fluid pressures in said aft and forward gripper assemblies and wherein pressure exerted by said surfaces of said aft or forward gripper assembly exceeds a pre-selected threshold before said propulsion control valve changes positions.

7. The tractor of claim 1, wherein said aft and forward propulsion assemblies comprise aft and forward cylinders, respectively, and wherein said body further comprises aft and forward pistons which are slidably housed within said aft and forward cylinders, respectively, said aft and forward pistons being configured to be displaced by the pressurized fluid within said aft and forward cylinders for advancing said body through the borehole.

8. The tractor of claim 1, further comprising a propulsion control valve, said propulsion control valve having a first position in which said propulsion control valve directs pressurized fluid to said aft propulsion assembly and a second position in which said propulsion control valve directs pressurized fluid to said forward propulsion assembly.

9. The tractor of claim 8, wherein said propulsion control valve is piloted by fluid pressures in said aft and forward gripper assemblies and wherein pressure exerted by said surfaces of said aft or forward gripper assembly exceeds a pre-selected threshold before said propulsion control valve changes positions.

* * * * *